US012213530B2

(12) United States Patent
Illidge et al.

(10) Patent No.: US 12,213,530 B2
(45) Date of Patent: Feb. 4, 2025

(54) SMOKING SUBSTITUTE APPARATUS

(71) Applicant: Imperial Tobacco Limited, Bristol (GB)

(72) Inventors: Benjamin Illidge, Liverpool (GB); Huanghai Lu, Liverpool (GB); Benjamin Astbury, Liverpool (GB); Nikhil Aggarwal, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 499 days.

(21) Appl. No.: 17/696,414

(22) Filed: Mar. 16, 2022

(65) Prior Publication Data

US 2022/0202098 A1 Jun. 30, 2022

Related U.S. Application Data

(63) Continuation of application No. PCT/EP2020/076268, filed on Sep. 21, 2020.

(30) Foreign Application Priority Data

Sep. 20, 2019 (EP) ..... 19198534
Sep. 20, 2019 (EP) ..... 19198555
Sep. 20, 2019 (EP) ..... 19198574

(51) Int. Cl.
*A24F 40/485* (2020.01)
*A24F 40/10* (2020.01)

(52) U.S. Cl.
CPC ..... *A24F 40/485* (2020.01); *A24F 40/10* (2020.01)

(58) Field of Classification Search
CPC ..... A24F 40/10
See application file for complete search history.

(56) References Cited

U.S. PATENT DOCUMENTS

2011/0094523 A1 4/2011 Thorens et al.
2013/0061851 A1 3/2013 Jones et al.
(Continued)

FOREIGN PATENT DOCUMENTS

CN 106 136 326 A 11/2016
CN 107 156 909 A 9/2017
(Continued)

OTHER PUBLICATIONS

International Search Report and Written Opinion (PCT/EP2020/076268), dated Dec. 4, 2020, 14 pages.
(Continued)

*Primary Examiner* — Christopher M Rodd
*Assistant Examiner* — Daniel Edward Vakili
(74) *Attorney, Agent, or Firm* — Dunlap Codding, P.C.

(57) ABSTRACT

A smoking substitute apparatus for generating an aerosol, comprising: a housing; an air inlet and an outlet formed at the housing; a passage extending between the air inlet and outlet, air flowing in use along the passage for inhalation by a user drawing on the apparatus; and an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage; wherein the downstream portion of the passage comprises a flow converging section having a curved sidewall tapered towards the outlet, and wherein an upstream end of the flow converging section substantially conforms to a cross sectional profile of the aerosol generation chamber.

12 Claims, 34 Drawing Sheets

(56) References Cited

U.S. PATENT DOCUMENTS

| | | | | |
|---|---|---|---|---|
| 2014/0144429 | A1 | 5/2014 | Wensley et al. | |
| 2015/0020822 | A1 | 1/2015 | Janardhan et al. | |
| 2016/0081394 | A1 | 3/2016 | Alarcon et al. | |
| 2016/0106155 | A1 | 4/2016 | Reevell | |
| 2017/0325505 | A1 | 11/2017 | Force et al. | |
| 2018/0177958 | A1* | 6/2018 | Wilder | A61M 15/0021 |
| 2018/0338538 | A1* | 11/2018 | Zheng | A24F 40/48 |
| 2019/0083720 | A1 | 3/2019 | Leadley et al. | |
| 2019/0090538 | A1 | 3/2019 | Li et al. | |

FOREIGN PATENT DOCUMENTS

| | | | |
|---|---|---|---|
| CN | 107 343 670 | A | 11/2017 |
| CN | 110 089 779 | A | 8/2019 |
| EP | 3 292 772 | A1 | 3/2018 |
| GB | 2 566 766 | A | 3/2019 |
| WO | WO 2016/050244 | A1 | 4/2016 |
| WO | WO 2017/153270 | A1 | 9/2017 |
| WO | WO 2018/099999 | A1 | 6/2018 |
| WO | WO 2018/211390 | A1 | 11/2018 |
| WO | WO 2019/171417 | A1 | 9/2019 |

OTHER PUBLICATIONS

International Search Report (19198534.0-1004), dated Mar. 30, 2020, 12 pages.
International Search Report (19198555.5-1004), dated Apr. 14, 2020, 7 pages.
International Search Report (19198574.6-1004), dated Apr. 6, 2020, 8 pages.

* cited by examiner $I = 0.55\ \%$ $I = 0.55\ \%$ $I = 0.55\ \%$ $I = 0.77\ \%$ $I = 0.77\ \%$ $I = 0.77\ \%$ $I = 1.06\ \%$ $I = 1.06\ \%$ $I = 1.06\ \%$

SMOKING SUBSTITUTE APPARATUS

CROSS-REFERENCE TO RELATED APPLICATIONS/INCORPORATION BY REFERENCE STATEMENT

This application is a non-provisional application claiming benefit to the international application no. PCT/EP2020/076268 filed on Sep. 21, 2020, which claims priority to EP 1919855.5 filed on Sep. 20, 2019, EP 19198574.6 filed on Sep. 20, 2019, and EP 19198534.0 filed on Sep. 20, 2019. The entire contents of each of the above-referenced applications are hereby incorporated herein by reference in their entirety.

FIELD OF THE DISCLOSURE

The present disclosure relates to a smoking substitute apparatus and, in particular, a smoking substitute apparatus that is able to reduce fluid leakage during use, as well as to deliver nicotine to a user in an effective manner.

BACKGROUND

The smoking of tobacco is generally considered to expose a smoker to potentially harmful substances. It is thought that a significant amount of the potentially harmful substances are generated through the burning and/or combustion of the tobacco and the constituents of the burnt tobacco in the tobacco smoke itself.

Low temperature combustion of organic material such as tobacco is known to produce tar and other potentially harmful by-products. There have been proposed various smoking substitute systems in which the conventional smoking of tobacco is avoided.

Such smoking substitute systems can form part of nicotine replacement therapies aimed at people who wish to stop smoking and overcome a dependence on nicotine.

Known smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or a flavorant without, or with fewer of, the health risks associated with conventional smoking.

In general, smoking substitute systems are intended to provide a substitute for the rituals of smoking, whilst providing the user with a similar, or improved, experience and satisfaction to those experienced with conventional smoking and with combustible tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. There are a number of different categories of smoking substitute systems, each utilising a different smoking substitute approach. Some smoking substitute systems are designed to resemble a conventional cigarette and are cylindrical in form with a mouthpiece at one end. Other smoking substitute devices do not generally resemble a cigarette (for example, the smoking substitute device may have a generally box-like form, in whole or in part).

One approach is the so-called "vaping" approach, in which a vaporizable liquid, or an aerosol former or aerosol precursor, sometimes typically referred to herein as "e-liquid", is heated by a heating device (sometimes referred to herein as an electronic cigarette or "e-cigarette" device) to produce an aerosol vapor which is inhaled by a user. The e-liquid typically includes a base liquid, nicotine and may include a flavorant. The resulting vapor therefore also typically contains nicotine and/or a flavorant. The base liquid may include propylene glycol and/or vegetable glycerine.

A typical e-cigarette device includes a mouthpiece, a power source (typically a battery), a tank for containing e-liquid and a heating device. In use, electrical energy is supplied from the power source to the heating device, which heats the e-liquid to produce an aerosol (or "vapor") which is inhaled by a user through the mouthpiece.

E-cigarettes can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a main body which includes the power source, wherein the main body is configured to be physically and electrically couplable to a consumable including the tank and the heating element. In this way, when the tank of a consumable has been emptied of e-liquid, that consumable is removed from the main body and disposed of. The main body can then be reused by connecting it to a new, replacement, consumable. Another subset of closed system vaping smoking substitute systems are completely disposable, and intended for one-use only.

There are also "open system" vaping smoking substitute systems which typically have a tank that is configured to be refilled by a user. In this way the entire device can be used multiple times.

An example vaping smoking substitute system is the Myblu™ e-cigarette. The Myblu™ e-cigarette is a closed system which includes a main body and a consumable. The main body and consumable are physically and electrically coupled together by pushing the consumable into the main body. The main body includes a rechargeable battery. The consumable includes a mouthpiece and a sealed tank which contains e-liquid. The consumable having an air inlet which is fluidly connected to an outlet at the mouthpiece by an air flow channel. The consumable further includes a heater, which for this device is a heating filament coiled around a portion of a wick positioned across the width of the air flow passage. The wick is partially immersed in the e-liquid, and conveys e-liquid from the tank to the heating filament. The system is controlled by a microprocessor on board the main body. The system includes a sensor for detecting when a user is inhaling through the mouthpiece, the microprocessor then activating the device in response. When the system is activated, electrical energy is supplied from the power source to the heating device, which heats e-liquid from the tank to produce a vapor, which promptly condenses to form an aerosol as it is cooled by an airflow passing through the air flow passage. A user may therefore inhale the generated aerosol through the mouthpiece.

SUMMARY OF THE DISCLOSURE

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Accordingly, there is a need for improvement in the delivery of nicotine to a user.

Development A

The present disclosure (Development A) has been devised in the light of the above considerations.

In a general aspect of Development A, the present disclosure provides a smooth, curved transition for flow of aerosol from the aerosol generation chamber to the outlet of a smoking substitute apparatus. As such, the smoking substitute apparatus may allow an aerosol to converge from the aerosol generation chamber towards the outlet with reduced turbulence in comparison to prior art consumable, and therefore it may lead to larger aerosol droplets to be drawn out at the outlet.

According to a first preferred aspect of Development A there is provided a smoking substitute apparatus for generating an aerosol, comprising:

- a housing;
- an air inlet and an outlet formed at the housing;
- a passage extending between the air inlet and outlet, air flowing in use along the passage for inhalation by a user drawing on the apparatus; and
- an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage;
- wherein the downstream portion of the passage comprises a flow converging section having a curved sidewall tapered towards the outlet, and wherein an upstream end of the flow converging section substantially conforms to a cross sectional profile of the aerosol generation chamber.

The aerosol generation chamber may be provided at or towards a first end of the housing. The outlet may open at a second end of the housing opposite to the first end, the second end of the housing may comprise a mouthpiece onto which a user may puff onto for drawing out an aerosol through the outlet. Said first end of the housing may be engageable with a main body of a smoking substitute system. The aerosol generator inside the aerosol generation chamber may be fluidly connected to the outlet via a downstream portion of the passage extending along a longitudinal axis of the housing. In use, the aerosol generator may vaporize an aerosol precursor to form a vapor. Said vapor may cool and condense to from an aerosol in the aerosol generation chamber and discharge along the downstream portion towards the outlet.

As set out above, the passage comprises a flow converging section having curved sidewall tapered towards the outlet. The curved sidewall may extend along a part and/or all of the downstream portion of the passage. More specifically, the flow converging section may reduce in cross sectional area, or hydraulic diameter, from an upstream end towards the outlet in the direction of aerosol flow. The phrase "upstream" and "downstream" refers to the direction of aerosol flow towards the outlet. Furthermore, the curved sidewall may have a curvature along a longitudinal cross section of the passage. Therefore, with the curved sidewall, the flow converging section of the passage may differ to a cone in that the cross section area along said converging section may reduce in a non-linear manner along its length. For example, such flow converging section may resemble a champagne flute or one half of an hourglass.

The upstream end of the flow converging section may substantially conform to a cross sectional profile of the aerosol generation chamber. For example, the upstream end, or the widest end, of the flow converging section may have the same shape and hydraulic diameter as the aerosol generation chamber downstream of the aerosol generator. Therefore, the upstream end of the flow converging section may have a cross sectional area that is substantially equal to that of a downstream end of the aerosol generation chamber. In some embodiment, the downstream end of the aerosol generation chamber may be adjacent and seamlessly connected to the upstream end of the flow converging section along the longitudinal axis of the housing.

Advantageously, such arrangement may allow the aerosol formed in the aerosol generation chamber to gradually converge towards a narrower outlet, and thereby minimizing the amount of turbulence and shear in the aerosol flow that may otherwise cause a reduction in aerosol droplet size. As explained above, aerosol particles of a small (e.g., sub-micron) particle size are undesirable as they can be inhaled into the lungs but may be exhaled without delivering nicotine to the lungs. The $d_{50}$ particle size of the aerosol particles is preferably at least 1 micron or more preferably at least 2 microns. Typically, the $d_{50}$ particle size is not more than 10 microns, preferably not more than 9 microns, not more than 8 microns, not more than 7 microns, not more than 6 microns, not more than 5 microns, not more than 4 microns or not more than 3 microns. It is considered that providing aerosol particle sizes in such ranges permits improved interaction between the aerosol particles and the user's lungs.

The aerosol precursor may comprise a liquid aerosol precursor. The aerosol generator may comprise a heater configured to generate the aerosol by vaporizing the liquid aerosol precursor. The liquid aerosol precursor may be an e-liquid and may comprise nicotine and a base liquid such as propylene glycol and/or vegetable glycerin and may include a flavorant. The aerosol generator may be a heater such as a heater coil wounded around a wick.

Optionally, the curved sidewall of the flow converging section comprises a sigmoidal profile, or an S-shaped profile, along the longitudinal axis of the downstream portion of the passage. Advantageously, such arrangement may allow gradual reduction of cross sectional area along the flow converging section.

Optionally, a maximum angle subtended by an internal surface of a sidewall of the downstream portion of the passage is less than 30 degrees from a longitudinal axis of said downstream portion, said angle measured in a plane including the longitudinal axis. Optionally, a maximum angle subtended by an internal surface of a sidewall of the downstream portion of the passage is less than 20 degrees from a longitudinal axis of said downstream portion, said angle measured in a plane including the longitudinal axis. Optionally, a maximum angle subtended by an internal surface of a sidewall of the downstream portion of the passage is less than 10 degrees from a longitudinal axis of said downstream portion, said angle measured in a plane including the longitudinal axis. Said sidewall of downstream portion may encompass the curved sidewall of the converging section, as well as the remaining sidewall along the downstream portion. For example, the sidewall of the downstream portion may be free of any abrupt change in direction, therefore advantageously such arrangement may result in a smooth aerosol flow path and therefore reduces the amount of turbulence therein.

Optionally, the passage extends longitudinally through the aerosol generation chamber so as to allow an airflow to pass over the aerosol generator. For example, the aerosol generation chamber may form part of the passage. In the case of where the aerosol generator is a heat, such arrangement may advantageously allow the airflow to cool the vapor as it is being generated at the heater, and thereby allowing aerosol droplets to form more effectively.

Optionally, a chamber inlet is opened at a base of the aerosol generation chamber, wherein the passage extends through said chamber inlet. For example, such arrangement may allow the air flow to sweep through the aerosol generation chamber. Thereby advantageously, such arrangement may reduce the likelihood of aerosol condensation formation along the sidewall of the aerosol generation chamber.

Optionally, the downstream portion of the passage extends without discontinuity, or seamlessly, from the aerosol generation chamber towards the outlet. For example, the connection or intersection between the aerosol generation chamber and the downstream portion of the passage may be substantially free of protrusion and/or indentation that may induce turbulence and/or a change in direction in the aerosol flow.

In some embodiments, an upstream portion of the passage extends externally to the aerosol generation chamber. Said upstream portion of the passage may be configured to allow some or all of the air flow entering the housing through the air inlet to bypass the aerosol generation chamber. For example, the upstream portion of the passage may coaxially extend alongside the aerosol generation chamber. In some embodiments, the upstream portion of the passage and the aerosol generation chamber may share the sidewall of the aerosol generation chamber. In such embodiments, the air flow may not directly pass over the aerosol generator but may only come into contact with the vapor and/or aerosol once it is formed.

Therefore, the aerosol generator may be positioned in a stagnant cavity of the aerosol generation chamber, the stagnant cavity being substantially free of the airflow, in use. For example, because the airflow does not pass through the internal volume of the aerosol generation chamber, said internal volume may form the stagnant cavity during a user puff. "Stagnant" may not necessarily mean a complete lack of convection, e.g., a degree of convection may result from vapor and/or aerosol generated during vaporization. For example, as the aerosol precursor is being vaporized in the aerosol generation chamber, the vaporized aerosol precursor, or the vapor, may expand in the aerosol generation chamber and thereby it may increase the internal pressure at the aerosol generation chamber. Such elevated internal pressure may advantageously aid the convection of the vapor and/or aerosol towards the downstream portion of the passage. In comparison to prior art consumables, such arrangement may significantly reduce the turbulence in the vicinity of the heater. Advantageously, such reduction in turbulence may allow an aerosol with larger droplets to be formed.

In such embodiments, the aerosol generation chamber may resemble an open end container or a cup. An open end of the aerosol generation chamber may open towards the outlet at the second end of the housing. More specifically, the open end of the aerosol generation chamber may direct towards an upward direction during use. Advantageously, this may help containing any excess aerosol precursor and coalesced aerosol droplets formed in the aerosol generation chamber.

Optionally, a junction is provided along the passage to fluidly connect the upper portion and the downstream portion of the passage with the aerosol generation chamber, the junction is configured to allow the aerosol in the aerosol generation chamber to entrain with the airflow passing across the junction. For example, the junction may locate at an intersection between a chamber outlet of the aerosol generation chamber and the downstream portion of passage, as such the aerosol discharging through the chamber outlet may entrain with the airflow passing from the upstream portion to the downstream portion of the passage through the junction.

Optionally, the smoking substitute apparatus is configured to generate an aerosol having a droplet size, $d_{50}$, of at least 1 μm. Optionally, the smoking substitute apparatus is configured to generate an aerosol having a droplet size, $d_{50}$, ranged between 1 μm to 4 μm. Optionally, the smoking substitute apparatus is configured to generate an aerosol having a droplet size, $d_{50}$, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

Optionally, the aerosol generation chamber comprises a sealed base for preventing fluid leakage through said base. More specifically, the base of the aerosol generation chamber may be completely closed or it may comprise sealed apertures for allowing electrical contact to extending therethrough. Advantageously, such arrangement may prevent excess aerosol precursor and coalesced aerosol droplets in the aerosol generation chamber to leak through the base of the apparatus.

Optionally, the aerosol generator is adjacent to the base of the aerosol generation chamber. Advantageously, such arrangement may allow the heater to be located at a position furthest away from the junction, and therefore it may limit the turbulence in the vicinity of the heater. Further, such arrangement may increase the residence time of the vapor in the aerosol generation chamber and thus it may allow some aerosol droplets to form and even coalesce before being entrained in the airflow. Additionally in the case where the aerosol generator is a heater, at such location, the wick of the heater may absorb excess aerosol precursor that is collected at the base of aerosol generation chamber, and subsequently allowing it to be vaporized.

Optionally, the aerosol generation chamber is configured to have a uniform cross sectional profile along its length. For example, the aerosol flow path along the length of the aerosol generation chamber may have the same cross-sectional area. Advantageously, this may reduce turbulence, as well as fluctuation in pressure along the aerosol flow path and thereby such arrangement may lead to an increase in the size of aerosol droplets.

Optionally, one or more electrical contacts are provided on the first end of the housing and electrically connected with the aerosol generator, wherein the one or more electrical contacts are configured to engage with corresponding electrical terminals on a main body of a smoking substitute system. For example, electrical connectors may extend from the aerosol generator, through respective sealed apertures at the base of the aerosol generation chamber, to establish electrical connection with the one or more electrical contacts. Advantageously, such arrangement may allow electrical connection between the main body and the aerosol generator to establish by biasing the housing towards the main body.

According to a second aspect of Development A there is provided a smoking substitute system for generating an aerosol, comprising:

i) the smoking substitute apparatus of the first aspect of Development A; and ii) a main body configured to engage with the smoking substitute apparatus; wherein the main body comprises a controller and a power source configured to energize the aerosol generator.

According to a third aspect of Development A there is provided a method of using the smoking substitute apparatus of the first aspect of Development A, comprising:

i) generating the aerosol with the aerosol generator;

ii) drawing on the apparatus to induce an air flow along the passage for entraining the generated aerosol.

There now follows a disclosure of various optional features. These are intended to be applicable to Development A, disclosed above, and may also be applied in any combination (unless the context demands otherwise) to any aspect, embodiment or optional feature set out with respect to Development B and/or Development C.

The smoking substitute apparatus may be in the form of a consumable. The consumable may be configured for engagement with a main body. When the consumable is engaged with the main body, the combination of the consumable and the main body may form a smoking substitute system such as a closed smoking substitute system. For example, the consumable may comprise components of the system that are disposable, and the main body may comprise non-disposable or non-consumable components (e.g., power supply, controller, sensor, etc.) that facilitate the generation and/or delivery of aerosol by the consumable. In such an embodiment, the aerosol precursor (e.g., e-liquid) may be replenished by replacing a used consumable with an unused consumable.

Alternatively, the smoking substitute apparatus may be a non-consumable apparatus (e.g., that is in the form of an open smoking substitute system). In such embodiments an aerosol precursor (e.g., e-liquid) of the system may be replenished by re-filling, e.g., a reservoir of the smoking substitute apparatus, with the aerosol precursor (rather than replacing a consumable component of the apparatus).

In light of this, it should be appreciated that some of the features described herein as being part of the smoking substitute apparatus may alternatively form part of a main body for engagement with the smoking substitute apparatus. This may be the case in particular when the smoking substitute apparatus is in the form of a consumable.

Where the smoking substitute apparatus is in the form of a consumable, the main body and the consumable may be configured to be physically coupled together. For example, the consumable may be at least partially received in a recess of the main body, such that there is an interference fit between the main body and the consumable. Alternatively, the main body and the consumable may be physically coupled together by screwing one onto the other, or through a bayonet fitting, or the like.

Thus, the smoking substitute apparatus may comprise one or more engagement portions for engaging with a main body. In this way, one end of the smoking substitute apparatus may be coupled with the main body, whilst an opposing end of the smoking substitute apparatus may define a mouthpiece of the smoking substitute system.

The smoking substitute apparatus may comprise a reservoir configured to store an aerosol precursor, such as an e-liquid. The e-liquid may, for example, comprise a base liquid. The e-liquid may further comprise nicotine. The base liquid may include propylene glycol and/or vegetable glycerin. The e-liquid may be substantially flavorless. That is, the e-liquid may not contain any deliberately added additional flavorant and may consist solely of a base liquid of propylene glycol and/or vegetable glycerin and nicotine.

The reservoir may be in the form of a tank. At least a portion of the tank may be light-transmissive. For example, the tank may comprise a window to allow a user to visually assess the quantity of e-liquid in the tank. A housing of the smoking substitute apparatus may comprise a corresponding aperture (or slot) or window that may be aligned with a light-transmissive portion (e.g., window) of the tank. The reservoir may be referred to as a "clearomizer" if it includes a window, or a "cartomizer" if it does not.

As set out above, the smoking substitute apparatus comprises a passage for fluid flow therethrough. The passage extends through (at least a portion of) the smoking substitute apparatus, between openings that define an air inlet and an outlet of the passage. The outlet may be at a mouthpiece of the smoking substitute apparatus. In this respect, a user may draw fluid (e.g., air) into and through the passage by inhaling at the outlet (i.e., using the mouthpiece). The passage may be at least partially defined by the tank. The tank may substantially (or fully) define the passage, for at least a part of the length of the passage. In this respect, the tank may surround the passage, e.g., in an annular arrangement around the passage.

The aerosol generator may comprise a wick. The aerosol generator may further comprise a heater. The wick may comprise a porous material, capable of wicking the aerosol precursor. A portion of the wick may be exposed to air flow in the passage. The wick may also comprise one or more portions in contact with liquid stored in the reservoir. For example, opposing ends of the wick may protrude into the reservoir and an intermediate portion (between the ends) may extend across the passage so as to be exposed to air flow in the passage. Thus, liquid may be drawn (e.g., by capillary action) along the wick, from the reservoir to the portion of the wick exposed to air flow.

The heater may comprise a heating element, which may be in the form of a filament wound about the wick (e.g., the filament may extend helically about the wick in a coil configuration). The heating element may be wound about the intermediate portion of the wick that is exposed to air flow in the passage. The heating element may be electrically connected (or connectable) to a power source. Thus, in operation, the power source may apply a voltage across the heating element so as to heat the heating element by resistive heating. This may cause liquid stored in the wick (i.e., drawn from the tank) to be heated so as to form a vapor and become entrained in air flowing through the passage. This vapor may subsequently cool to form an aerosol in the passage, typically downstream from the heating element.

The aerosol generation chamber (sometimes called a vaporization chamber in this disclosure) may form part of the passage in which the heater is located. The aerosol generation chamber may be arranged to be in fluid communication with the air inlet and outlet of the passage. For example, the passage may pass through the chamber inlet and chamber outlet of the aerosol generation chamber. The aerosol generation chamber may be an enlarged portion of the passage, subject to the features set out above with respect to the shape of the passage. In this respect, the air as drawn in by the user may entrain the generated vapor in a flow away from heater. The entrained vapor may form an aerosol in the aerosol generation chamber, or it may form the aerosol further downstream along the passage. The aerosol generation chamber may be at least partially defined by the tank. The tank may substantially (or fully) define the aerosol generation chamber. In this respect, the tank may surround the aerosol generation chamber, e.g., in an annular arrangement around the aerosol generation chamber.

In use, the user may puff on a mouthpiece of the smoking substitute apparatus, i.e., draw on the smoking substitute apparatus by inhaling, to draw in an air stream therethrough. A portion, or all, of the air stream (also referred to as a "main air flow") may pass through the aerosol generation chamber so as to entrain the vapor generated at the heater. That is, such a main air flow may be heated by the heater (although typically only to a limited extent) as it passes through the aerosol generation chamber. Alternatively, or in addition, a portion of the air stream (also referred to as a "dilution air flow" or "bypass air flow)) may bypass the aerosol generation chamber and be directed to mix with the generated aerosol downstream from the aerosol generation chamber. That is, the dilution air flow may be an air stream at an ambient temperature and may not be directly heated at all by the heater. The dilution air flow may combine with the main air flow for diluting the aerosol contained therein. The dilution air flow may merge with the main air flow along the passage downstream from the aerosol generation chamber. Alternatively, the dilution air flow may be directly inhaled by the user without passing though the passage of the smoking substitute apparatus.

As a user puffs on the mouthpiece, vaporized e-liquid entrained in the passing air flow may be drawn towards the outlet of passage. The vapor may cool, and thereby nucleate and/or condense along the passage to form a plurality of aerosol droplets, e.g., nicotine-containing aerosol droplets. A portion of these aerosol droplets may be delivered to and be absorbed at a target delivery site, e.g., a user's lung, whilst a portion of the aerosol droplets may instead adhere onto other parts of the user's respiratory tract, e.g., the user's oral cavity and/or throat. Typically, in some known smoking substitute apparatuses, the aerosol droplets as measured at the outlet of the passage, e.g., at the mouthpiece, may have a median droplet size, $d_{50}$, of less than 1 μm.

The median particle droplet size, $d_{50}$, of an aerosol may be measured by a laser diffraction technique. For example, the stream of aerosol output from the outlet of the passage may be drawn through a Malvern Spraytec laser diffraction system, where the intensity and pattern of scattered laser light are analyzed to calculate the size and size distribution of aerosol droplets. As will be readily understood, the particle size distribution may be expressed in terms of $d_{10}$, $d_{50}$ and $d_{90}$, for example. Considering a cumulative plot of the volume of the particles measured by the laser diffraction technique, the $d_{10}$ particle size is the particle size below which 10% by volume of the sample lies. The $d_{50}$ particle size is the particle size below which 50% by volume of the sample lies. The $d_{90}$ particle size is the particle size below which 90% by volume of the sample lies. Unless otherwise indicated herein, the particle size measurements are volume-based particle size measurements, rather than number-based or mass-based particle size measurements.

The smoking substitute apparatus (or main body engaged with the smoking substitute apparatus) may comprise a power source. The power source may be electrically connected (or connectable) to a heater of the smoking substitute apparatus (e.g., when the smoking substitute apparatus is engaged with the main body). The power source may be a battery (e.g., a rechargeable battery). A connector in the form of, e.g., a USB port may be provided for recharging this battery.

When the smoking substitute apparatus is in the form of a consumable, the smoking substitute apparatus may comprise an electrical interface for interfacing with a corresponding electrical interface of the main body. One or both of the electrical interfaces may include one or more electrical contacts. Thus, when the main body is engaged with the consumable, the electrical interface of the main body may be configured to transfer electrical power from the power source to a heater of the consumable via the electrical interface of the consumable.

The electrical interface of the smoking substitute apparatus may also be used to identify the smoking substitute apparatus (in the form of a consumable) from a list of known types. For example, the consumable may have a certain concentration of nicotine and the electrical interface may be used to identify this. The electrical interface may additionally or alternatively be used to identify when a consumable is connected to the main body.

Again, where the smoking substitute apparatus is in the form of a consumable, the main body may comprise an identification means, which may, for example, be in the form of an RFID reader, a barcode or QR code reader. This identification means may be able to identify a characteristic (e.g., a type) of a consumable engaged with the main body. In this respect, the consumable may include any one or more of an RFID chip, a barcode or QR code, or memory within which is an identifier and which can be interrogated via the identification means.

The smoking substitute apparatus or main body may comprise a controller, which may include a microprocessor. The controller may be configured to control the supply of power from the power source to the heater of the smoking substitute apparatus (e.g., via the electrical contacts). A memory may be provided and may be operatively connected to the controller. The memory may include non-volatile memory. The memory may include instructions which, when implemented, cause the controller to perform certain tasks or steps of a method.

The main body or smoking substitute apparatus may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

A puff sensor may be provided that is configured to detect a puff (i.e., inhalation from a user). The puff sensor may be operatively connected to the controller so as to be able to provide a signal to the controller that is indicative of a puff state (i.e., puffing or not puffing). The puff sensor may, for example, be in the form of a pressure sensor or an acoustic sensor. That is, the controller may control power supply to the heater of the consumable in response to a puff detection by the sensor. The control may be in the form of activation of the heater in response to a detected puff. That is, the smoking substitute apparatus may be configured to be activated when a puff is detected by the puff sensor. When the smoking substitute apparatus is in the form of a consumable, the puff sensor may be provided in the consumable or alternatively may be provided in the main body.

The term "flavorant" is used to describe a compound or combination of compounds that provide flavor and/or aroma. For example, the flavorant may be configured to interact with a sensory receptor of a user (such as an olfactory or taste receptor). The flavorant may include one or more volatile substances.

The flavorant may be provided in solid or liquid form. The flavorant may be natural or synthetic. For example, the flavorant may include menthol, licorice, chocolate, fruit flavor (including, e.g., citrus, cherry etc.), vanilla, spice (e.g., ginger, cinnamon) and tobacco flavor. The flavorant may be evenly dispersed or may be provided in isolated locations and/or varying concentrations.

The present inventors consider that a flow rate of 1.3 L $min^{-1}$ is towards the lower end of a typical user expectation of flow rate through a conventional cigarette and therefore through a user-acceptable smoking substitute apparatus. The present inventors further consider that a flow rate of 2.0 L $min^{-1}$ is towards the higher end of a typical user expectation of flow rate through a conventional cigarette and therefore through a user-acceptable smoking substitute apparatus. Embodiments of the present disclosure therefore provide an aerosol with advantageous particle size characteristics across a range of flow rates of air through the apparatus.

The aerosol may have a Dv50 of at least 1.1 μm, at least 1.2 μm, at least 1.3 μm, at least 1.4 μm, at least 1.5 μm, at least 1.6 μm, at least 1.7 μm, at least 1.8 μm, at least 1.9 μm or at least 2.0 μm.

The aerosol may have a Dv50 of not more than 4.9 μm, not more than 4.8 μm, not more than 4.7 μm, not more than 4.6 μm, not more than 4.5 μm, not more than 4.4 μm, not more than 4.3 μm, not more than 4.2 μm, not more than 4.1 μm, not more than 4.0 μm, not more than 3.9 μm, not more than 3.8 μm, not more than 3.7 μm, not more than 3.6 μm, not more than 3.5 μm, not more than 3.4 μm, not more than 3.3 μm, not more than 3.2 μm, not more than 3.1 μm or not more than 3.0 μm.

A particularly preferred range for Dv50 of the aerosol is in the range 2-3 μm.

The air inlet, flow passage, outlet and the vaporization chamber may be configured so that, when the air flow rate inhaled by the user through the apparatus is 1.3 L $min^{-1}$, the average magnitude of velocity of air in the vaporization chamber is in the range 0-1.3 $ms^{-1}$. The average magnitude velocity of air may be calculated based on knowledge of the geometry of the vaporization chamber and the flow rate.

When the air flow rate inhaled by the user through the apparatus is 1.3 L $min^{-1}$, the average magnitude of velocity of air in the vaporization chamber may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 1.3 L $min^{-1}$, the average magnitude of velocity of air in the vaporization chamber may be at most 1.2 $ms^{-1}$, at most 1.1 $ms^{-1}$, at most 1.0 $ms^{-1}$, at most 0.9 $ms^{-1}$, at most 0.8 $ms^{-1}$, at most 0.7 $ms^{-1}$ or at most 0.6 $ms^{-1}$.

The air inlet, flow passage, outlet and the vaporization chamber may be configured so that, when the air flow rate inhaled by the user through the apparatus is 2.0 L $min^{-1}$, the average magnitude of velocity of air in the vaporization chamber is in the range 0-1.3 $ms^{-1}$. The average magnitude velocity of air may be calculated based on knowledge of the geometry of the vaporization chamber and the flow rate.

When the air flow rate inhaled by the user through the apparatus is 2.0 L $min^{-1}$, the average magnitude of velocity of air in the vaporization chamber may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 2.0 L $min^{-1}$, the average magnitude of velocity of air in the vaporization chamber may be at most 1.2 $ms^{-1}$, at most 1.1 $ms^{-1}$, at most 1.0 $ms^{-1}$, at most 0.9 $ms^{-1}$, at most 0.8 $ms^{-1}$, at most 0.7 $ms^{-1}$ or at most 0.6 $ms^{-1}$.

When the calculated average magnitude of velocity of air in the vaporization chamber is in the ranges specified, it is considered that the resultant aerosol particle size is advantageously controlled to be in a desirable range. It is further considered that the configuration of the apparatus can be selected so that the average magnitude of velocity of air in the vaporization chamber can be brought within the ranges specified, at the exemplary flow rate of 1.3 L $min^{-1}$ and/or the exemplary flow rate of 2.0 L $min^{-1}$.

The aerosol generator may comprise a vaporizer element loaded with aerosol precursor, the vaporizer element being heatable by a heater and presenting a vaporizer element surface to air in the vaporization chamber. A vaporizer element region may be defined as a volume extending outwardly from the vaporizer element surface to a distance of 1 mm from the vaporizer element surface.

The air inlet, flow passage, outlet and the vaporization chamber may be configured so that, when the air flow rate inhaled by the user through the apparatus is 1.3 L $min^{-1}$, the average magnitude of velocity of air in the vaporizer element region is in the range 0-1.2 $ms^{-1}$. The average magnitude of velocity of air in the vaporizer element region may be calculated using computational fluid dynamics.

When the air flow rate inhaled by the user through the apparatus is 1.3 L $min^{-1}$, the average magnitude of velocity of air in the vaporizer element region may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 1.3 L $min^{-1}$, the average magnitude of velocity of air in the vaporizer element region may be at most 1.1 $ms^{-1}$, at most 1.0 $ms^{-1}$, at most 0.9 $ms^{-1}$, at most 0.8 $ms^{-1}$, at most 0.7 $ms^{-1}$ or at most 0.6 $ms^{-1}$.

The air inlet, flow passage, outlet and the vaporization chamber may be configured so that, when the air flow rate inhaled by the user through the apparatus is 2.0 L $min^{-1}$, the average magnitude of velocity of air in the vaporizer element region is in the range 0-1.2 $ms^{-1}$. The average magnitude of velocity of air in the vaporizer element region may be calculated using computational fluid dynamics.

When the air flow rate inhaled by the user through the apparatus is 2.0 L $min^{-1}$, the average magnitude of velocity of air in the vaporizer element region may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 2.0 L $min^{-1}$, the average magnitude of velocity of air in the vaporizer element region may be at most 1.1 $ms^{-1}$, at most 1.0 $ms^{-1}$, at most 0.9 $ms^{-1}$, at most 0.8 $ms^{-1}$, at most 0.7 $ms^{-1}$ or at most 0.6 $ms^{-1}$.

When the average magnitude of velocity of air in the vaporizer element region is in the ranges specified, it is considered that the resultant aerosol particle size is advantageously controlled to be in a desirable range. It is further considered that the velocity of air in the vaporizer element region is more relevant to the resultant particle size characteristics than consideration of the velocity in the vaporization chamber as a whole. This is in view of the significant effect of the velocity of air in the vaporizer element region on the cooling of the vapor emitted from the vaporizer element surface.

Additionally, or alternatively, it is relevant to consider the maximum magnitude of velocity of air in the vaporizer element region.

Therefore, the air inlet, flow passage, outlet and the vaporization chamber may be configured so that, when the air flow rate inhaled by the user through the apparatus is 1.3 L $min^{-1}$, the maximum magnitude of velocity of air in the vaporizer element region is in the range 0-2.0 $ms^{-1}$.

When the air flow rate inhaled by the user through the apparatus is 1.3 L $min^{-1}$, the maximum magnitude of velocity of air in the vaporizer element region may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 1.3 L $min^{-1}$, the maximum magnitude of velocity of air in the vaporizer element region may be at most 1.9 $ms^{-1}$, at most 1.8 $ms^{-1}$, at most 1.7 $ms^{-1}$, at most 1.6 $ms^{-1}$, at most 1.5 $ms^{-1}$, at most 1.4 $ms^{-1}$, at most 1.3 $ms^{-1}$ or at most 1.2 $ms^{-1}$.

The air inlet, flow passage, outlet and the vaporization chamber may be configured so that, when the air flow rate inhaled by the user through the apparatus is 2.0 L $min^{-1}$, the maximum magnitude of velocity of air in the vaporizer element region is in the range 0-2.0 $ms^{-1}$.

When the air flow rate inhaled by the user through the apparatus is 2.0 L $min^{-1}$, the maximum magnitude of velocity of air in the vaporizer element region may be at least 0.001 $ms^{-1}$, or at least 0.005 $ms^{-1}$, or at least 0.01 $ms^{-1}$, or at least 0.05 $ms^{-1}$.

When the air flow rate inhaled by the user through the apparatus is 2.0 L $min^{-1}$, the maximum magnitude of velocity of air in the vaporizer element region may be at most 1.9 $ms^{-1}$, at most 1.8 $ms^{-1}$, at most 1.7 $ms^{-1}$, at most 1.6 $ms^{-1}$, at most 1.5 $ms^{-1}$, at most 1.4 $ms^{-1}$, at most 1.3 $ms^{-1}$ or at most 1.2 $ms^{-1}$.

It is considered that configuring the apparatus in a manner to permit such control of velocity of the airflow at the vaporizer permits the generation of aerosols with particularly advantageous particle size characteristics, including Dv50 values.

Additionally, or alternatively, it is relevant to consider the turbulence intensity in the vaporizer chamber in view of the effect of turbulence on the particle size of the generated aerosol. For example, the air inlet, flow passage, outlet and the vaporization chamber may be configured so that, when the air flow rate inhaled by the user through the apparatus is 1.3 L $min^{-1}$, the turbulence intensity in the vaporizer element region is not more than 1%.

When the air flow rate inhaled by the user through the apparatus is 1.3 L $min^{-1}$, the turbulence intensity in the vaporizer element region may be not more than 0.95%, not more than 0.9%, not more than 0.85%, not more than 0.8%, not more than 0.75%, not more than 0.7%, not more than 0.65% or not more than 0.6%.

It is considered that configuring the apparatus in a manner to permit such control of the turbulence intensity in the vaporizer element region permits the generation of aerosols with particularly advantageous particle size characteristics, including Dv50 values.

Following detailed investigations, the inventors consider, without wishing to be bound by theory, that the particle size characteristics of the generated aerosol may be determined by the cooling rate experienced by the vapor after emission from the vaporizer element (e.g., wick). In particular, it appears that imposing a relatively slow cooling rate on the vapor has the effect of generating aerosols with a relatively large particle size. The parameters discussed above (velocity and turbulence intensity) are considered to be mechanisms for implementing a particular cooling dynamic to the vapor.

More generally, it is considered that the air inlet, flow passage, outlet and the vaporization chamber may be configured so that a desired cooling rate is imposed on the vapor. The particular cooling rate to be used depends of course on the nature of the aerosol precursor and other conditions. However, for a particular aerosol precursor it is possible to define a set of testing conditions in order to define the cooling rate, and by extension this imposes limitations on the configuration of the apparatus to permit such cooling rates as are shown to result in advantageous aerosols. Accordingly, the air inlet, flow passage, outlet and the vaporization chamber may be configured so that the cooling rate of the vapor is such that the time taken to cool to 50° C. is not less than 16 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 1.3 L $min^{-1}$.

Additionally, or alternatively, the air inlet, flow passage, outlet and the vaporization chamber may be configured so that the cooling rate of the vapor is such that the time taken to cool to 50° C. is not less than 16 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 2.0 L $min^{-1}$.

Cooling of the vapor such that the time taken to cool to 50° C. is not less than 16 ms corresponds to an equivalent linear cooling rate of not more than 10° C./ms.

The equivalent linear cooling rate of the vapor to 50° C. may be not more than 9° C./ms, not more than 8° C./ms, not more than 7° C./ms, not more than 6° C./ms or not more than 5° C./ms.

Cooling of the vapor such that the time taken to cool to 50° C. is not less than 32 ms corresponds to an equivalent linear cooling rate of not more than 5° C./ms.

The testing protocol set out above considers the cooling of the vapor (and subsequent aerosol) to a temperature of 50° C. This is a temperature which can be considered to be suitable for an aerosol to exit the apparatus for inhalation by a user without causing significant discomfort. It is also possible to consider cooling of the vapor (and subsequent aerosol) to a temperature of 75° C. Although this temperature is possibly too high for comfortable inhalation, it is considered that the particle size characteristics of the aerosol are substantially settled by the time the aerosol cools to this temperature (and they may be settled at still higher temperature).

Accordingly, the air inlet, flow passage, outlet and the vaporization chamber may be configured so that the cooling rate of the vapor is such that the time taken to cool to 75° C. is not less than 4.5 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 1.3 L $min^{-1}$.

Additionally, or alternatively, the air inlet, flow passage, outlet and the vaporization chamber may be configured so that the cooling rate of the vapor is such that the time taken to cool to 75° C. is not less than 4.5 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 2.0 L $min^{-1}$.

Cooling of the vapor such that the time taken to cool to 75° C. is not less than 4.5 ms corresponds to an equivalent linear cooling rate of not more than 30° C./ms.

The equivalent linear cooling rate of the vapor to 75° C. may be not more than 29° C./ms, not more than 28° C./ms, not more than 27° C./ms, not more than 26° C./ms, not more than 25° C./ms, not more than 24° C./ms, not more than 23° C./ms, not more than 22° C./ms, not more than 21° C./ms, not more than 20° C./ms, not more than 19° C./ms, not more than 18° C./ms, not more than 17° C./ms, not more than 16° C./ms, not more than 15° C./ms, not more than 14° C./ms, not more than 13° C./ms, not more than 12° C./ms, not more than 11° C./ms or not more than 10° C./ms.

Cooling of the vapor such that the time taken to cool to 75° C. is not less than 13 ms corresponds to an equivalent linear cooling rate of not more than 10° C./ms.

It is considered that configuring the apparatus in a manner to permit such control of the cooling rate of the vapor permits the generation of aerosols with particularly advantageous particle size characteristics, including Dv50 values.

Development B

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Accordingly, there is a need for improvement in the delivery of nicotine to a user in the context of a smoking substitute system.

The present disclosure (Development B) has been devised in the light of the above considerations.

In a general aspect of Development B, the present disclosure relates to inducing a swirling annular flow path to at least a portion of the generated aerosol.

According to a first preferred aspect of Development B there is provided a smoking substitute apparatus comprising: a housing; an air inlet and an air outlet provided at the housing, the air inlet is arranged to be in fluid communication with the air outlet through an air flow channel; an aerosol generator for generating an aerosol, wherein the aerosol generator is arranged to be in fluid communication with a downstream portion of the air flow channel so as to allow the generated aerosol to flow towards the air outlet via said downstream portion; wherein the downstream portion of the air flow channel is configured to induce a swirling annular flow path to a portion of the air flow in the air flow channel.

In a second aspect of Development B, there is provided a method of operating a smoking substitute apparatus according to the first aspect of Development B, in which an air flow is drawn through the apparatus from the air inlet to the air outlet by user inhalation, and the heater operated to generate an aerosol from an aerosol precursor.

An advantage of the swirling annular flow is a decreased level of liquid reaching the mouth of the user. For example, this may be due to the spiral or helical air flow being relatively laminar in nature. This can reduce the number of droplets that impact the wall, and therefore reduce deposition on the wall.

Optionally, the downstream portion of the air flow channel is configured to induce a swirling annular flow path to a portion of the generated aerosol alongside a wall of the air flow channel. This allows a central part of the airflow channel to remain free of obstruction and allows a substantially straight central air flow path to be surrounded by the swirling annular flow.

Optionally, the downstream portion of the air flow channel comprises a helical guide which protrudes from a wall of the air flow channel.

Optionally, the helical guide protrudes radially inwardly from a wall of the air flow channel.

Optionally, the downstream portion of the air flow channel has a width, orthogonal to a longitudinal axis of the air flow channel, and the helical guide protrudes radially inwardly from a wall of the air flow channel by at least 5% of the width of the air flow channel.

Optionally, the downstream portion of the air flow channel has a width, orthogonal to a longitudinal axis of the air flow channel, and the helical guide protrudes radially inwardly from a wall of the air flow channel by up to 40% of the width of the air flow channel.

The helical guide may protrude radially inwardly from a wall of the air flow channel by 10%, or 15%, or 20%, or 25%, or 35% of the width of the air flow channel.

Optionally, a width of the helical guide, in a direction parallel to the longitudinal axis of the airflow channel, reduces from a first width closest to a wall of the air flow channel to a second width at a radially innermost extent of the helical guide.

Optionally, the helical guide has at least two rotations about the longitudinal axis of the air flow channel.

Optionally, the helical guide extends continuously along the downstream portion of the air flow channel.

In some embodiments, the downstream portion of the air flow channel is configured to induce the swirling annular flow path surrounding a substantially axial flow path. This substantially axial flow path corresponds to the central part of the flow channel mentioned above. In this case, the average magnitude of velocity of the flow in the substantially axial flow path may be greater than average magnitude of velocity of the flow in the swirling annular flow path.

Another aspect of Development B provides a smoking substitute system comprising: a main body; and a smoking substitute apparatus according to the first aspect.

Development C

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Furthermore, in such prior art smoking substitute systems the air inlet is often positioned at the base of the vaporizing chamber. In use, coalesced aerosol droplets that are too large to be suspended in the air flow, as well as excess aerosol former that is wicked from the sealed tank, may undesirably leak through the air inlet by gravity.

Accordingly, there is a need for improvement in the delivery of nicotine to a user, as well as reduction in liquid leakage, in the context of a smoking substitute system.

The present disclosure (Development C) has been devised in the light of the above considerations.

In a general aspect of Development C, the present disclosure relates to a smoking substitute apparatus having an air inlet positioned at a first end of a housing separated from a base of the aerosol generation chamber. The air inlet is configured to allow substantially all of the air flow that subsequently entrains aerosol from the aerosol generation chamber. By removing the air inlet from the base of the aerosol generation chamber, the smoking substitute apparatus of the present disclosure may advantageously reduce excess aerosol precursor collected in the aerosol generation chamber from leaking through the first end of the housing.

According to a first preferred aspect of Development C there is provided a smoking substitute apparatus for generating an aerosol, comprising:

a housing having a first end and a second end opposite to the first end;

at least one air inlet formed at a base of the housing at the first end;

an outlet opened at the second end;

a passage extending between the air inlet and the outlet, air flowing in use along the passage for inhalation by a user drawing on the apparatus; and an aerosol generation chamber at the first end of the housing, the aerosol generation chamber containing an aerosol generator being operable to generate an aerosol from an aerosol precursor, the aerosol generation chamber comprises at least one chamber outlet in fluid communication with the passage, the at least one chamber outlet permitting, in use, aerosol generated by the aerosol generator to be entrained into an air flow along the passage;

wherein said at least one air inlet is separated from a base of the aerosol generation chamber at the first end of the housing, said at least one air inlet and the base of the aerosol generation chamber being configured so that substantially all of the airflow that subsequently entrains the aerosol flows through said at least one air inlet.

The first end of the housing may form a base of the smoking substitute apparatus, or consumable, engageable with a main body of a smoking substitute system. The second end of the housing may comprise a mouthpiece which the user may puff onto in order to draw an air flow, through the passage. Therefore, the passage may extend axially along the longitudinal axis of the housing, from its base towards the mouthpiece. Advantageously, this may reduce the degree of flow turning as the air flow passing along the passage.

For the avoidance of doubt, we note here that a user may draw on the apparatus with or without making physical contact with the apparatus. For example, a mouthpiece or other intervening structure may be provided, separate from and/or separable from the housing of the smoking substitute apparatus, and the user's lips may make contact with this mouthpiece or other intervening structure when drawing on the apparatus.

In contrast to prior art smoking substitute systems, which typically comprise an air inlet at the base of an aerosol generation chamber that allows an air flow to pass over the heater, the air inlet according to the present disclosure may be provided externally to or separate to the aerosol generation chamber. For example, the aerosol generation chamber may comprise one or more sealed apertures at its base for allowing electrical connections to extend therethrough. Said sealed apertures preferably do not allow fluid passage and therefore advantageously, excess aerosol precursor accumulated at the base of the aerosol generation chamber may be retained in the aerosol generation chamber. Advantageously, because the air inlet does not open directly to the aerosol generation chamber, such arrangement may eliminate leakage of aerosol precursor through the air inlet.

For example, the air inlet may be radially adjacent to the base of the aerosol generation chamber. That is, the air inlet may be located, at the first end of the housing, alongside the base of the aerosol generation chamber. The base of the aerosol generation chamber may be sealed against air flow, or it may permit only an insignificant amount of air flow to enter the aerosol generation chamber. For example, the passage that extends from the air inlet may be configured to allow substantially all of the air flow entering the housing to bypass the aerosol generation chamber. In other words, the passage may extend externally to the aerosol generation chamber and configured to be in fluid communication with the chamber outlet. The air flow may not directly pass over the aerosol generator but only may come into contact with the aerosol once the aerosol has been entrained into the air flow along the passage, e.g., once the aerosol has been discharged from the aerosol generation chamber.

The aerosol precursor may comprise a liquid aerosol precursor, and wherein the aerosol generator may comprise a heater configured to generate the aerosol by vaporizing the liquid aerosol precursor. The liquid aerosol precursor may be an e-liquid and may comprise nicotine and a base liquid such as propylene glycol and/or vegetable glycerin and may include a flavorant. The aerosol generator may be a heater such as a heater coil wound around a wick.

In use, the aerosol generator may vaporize an aerosol precursor to form a vapor. A portion of the vapor may cool and condense to from an aerosol in the aerosol generation chamber and subsequently be discharged to the passage through the chamber outlet. The remaining portion of vapor may emerge through the chamber outlet into the passage, and may form further aerosol upon contacting the air flow along the passage. The aerosol generation chamber is arranged to reduce ingress of air flow from the passage. Advantageously, because substantially all of the air flow bypasses the aerosol generation chamber, such arrangement may reduce the amount of turbulence in the vicinity of the aerosol generator. The aerosol generation chamber may therefore be considered to be a stagnant chamber. Accordingly, an aerosol with enlarged droplet sizes may be formed.

Optionally, the base of the aerosol generation chamber is sealed to prevent fluid leakage through the first end of the housing. The base of the aerosol generation chamber may be completely closed or it may comprise sealed apertures for allowing electrical contact to extending therethrough. Advantageously, such an arrangement may prevent excess aerosol precursor and coalesced aerosol droplets in the aerosol generation chamber to leak through the base of the apparatus.

Optionally, the aerosol generation chamber is sealed against air flow except for the at least one chamber outlet. More specifically, the at least one chamber outlet may form the only aperture, or apertures, in the case where there is a plurality of chamber outlets, of the aerosol generation chamber that provides a gas flow passage for a gas through the sealed aerosol generation chamber. In other words, the aerosol generator is located in a stagnant cavity of the aerosol generation chamber, wherein said stagnant cavity is substantially free of the air flow entering the housing through the air inlet. For example, because the air flow does not pass through the internal volume of the aerosol generation chamber, said internal volume may form the stagnant cavity during a user puff. "Stagnant" may not necessarily mean a complete lack of convection, e.g., a degree of convection may result from vapor and/or aerosol generated during aerosol formation.

Optionally, the passage, or at least a portion of the passage, may extend alongside the aerosol generation chamber. Optionally, the portion of passage and aerosol generation chamber may share a sidewall of the aerosol generation chamber. As a result, the air flow in the passage may flow externally and parallel to the aerosol generation chamber.

Optionally, one or more additional air inlets may open on the sidewall of the housing and fluidly communicable with the passage. In other embodiments, the one or more additional air inlets may be positioned between the chamber outlet and the outlet along the longitudinal axis of the housing.

Optionally, the aerosol generation chamber is configured to allow the aerosol to entrain into the air flow along the passage based on the pressure difference between the aerosol generation chamber and the passage. For example, during the generation of aerosol, a vapor may expand in the aerosol generation chamber and thereby increases its internal pressure. Such elevated internal pressure may advantageously force the aerosol through the chamber opening into the passage. Furthermore, suction created by the user during a puff may induce a reduced pressure in the passage, which advantageously draws the aerosol through the chamber outlet into the passage.

The aerosol generation chamber may resemble an open ended container or a cup. Optionally, the chamber outlet opens towards the second end of the housing, or the mouthpiece. More specifically, when the apparatus is held upright in use, the chamber outlet may be directed towards an upward direction during use. Advantageously, this may help to contain any excess aerosol precursor and/or coalesced aerosol droplets in the aerosol generation chamber, any thereby preventing liquid leakage out of the chamber outlet. Alternatively, or in addition, the chamber outlet may open on a sidewall of the aerosol generation chamber, e.g., the aerosol generated in the aerosol generation chamber may be entrained into the passage from a direction orthogonal to the air flow.

Optionally, the chamber outlet is positioned adjacent to the passage and opens in the direction of air flow. Advantageously, by reducing the distance of travel, such an arrangement may allow the aerosol to be entrained into the air flow more effectively. Further, by aligning the chamber outlet in the direction of air flow, it may reduce the likelihood of air flow ingress into the chamber. Optionally, the chamber outlet may be closed by a one way valve, such as a check valve or a duck bill value, which may advantageously prevent the air flow from entering the aerosol generation chamber.

Optionally, the chamber outlet comprises one or more apertures formed in the aerosol generation chamber downstream to the aerosol generator in the direction of aerosol flow, and wherein the one or more apertures form the only apertures in the aerosol generation chamber that provide gas flow passage. More specifically, the one or more chamber outlets may be the only apertures at the aerosol generation chamber that allow vapor or an aerosol to exit the aerosol generation chamber. For example, the aerosol generation chamber may be free of any aperture that allows gas flow passage upstream of the aerosol generator. In the case of a heater, in use when the housing is put into an upright position, the chamber outlet is preferably located at a position above a wick of the heater. Advantageously, such an arrangement may prevent air flow from entering the stagnant chamber, as well as preventing excess aerosol precursor to drain through the chamber outlet and into the passage.

Optionally, the aerosol generator is located adjacent to the chamber outlet. For example, the aerosol generator may be located at a position immediately upstream of the chamber outlet in the path of vapor and/or aerosol. Advantageously, this may shorten the path of travel for the aerosol and thereby allow the aerosol to be entrained into the passage more effectively.

Optionally, the aerosol generator is spaced from the chamber outlet. For example, the aerosol generator may be positioned well into a cavity of the aerosol generation chamber, i.e., axially spaced from the chamber outlet. Advantageously, such arrangement may reduce the likelihood of air flow entering into the aerosol generation chamber, and thereby limiting the turbulence in the vicinity of the aerosol generator. Further, this may increase the residence time of the vapor in the aerosol generation chamber and thus it may allow some aerosol droplets to form and even coalesce before being entrained in the air flow. Optionally, the aerosol generator is separated from the chamber outlet by a distance of at least 10 mm. Optionally, the aerosol generator is separated from the chamber outlet by a distance ranging from 10 mm to 50 mm.

Optionally, the passage comprises a flow converging portion downstream from the aerosol generation chamber. The flow converging portion may be configured to converge the aerosol with the air flow in the passage. Optionally, the flow converging portion comprises a funnel or a tapered section for gradually merging the aerosol with the air flow. Advantageously, this may reduce the turbulence that may otherwise prohibit the formation of larger aerosol droplets. Alternatively, or in addition, the flow converging portion may comprise a length of passage having a constant cross sectional profile along its length. Advantageously, this reduces the change in flow direction of the aerosol and the air flow as they flow towards the outlet. Optionally, the flow converging portion has a length of at least 10 mm. Optionally, the flow converging portion has a length between 10 mm and 50 mm.

Optionally, the aerosol generation chamber is configured to have a substantially uniform cross sectional profile along its length. Optionally, the chamber outlet is configured to have the same cross sectional profile as the aerosol generation chamber. For example, the aerosol flow path along the length of the aerosol generation chamber may have the same cross-sectional area. Advantageously, this may reduce turbulence, as well as fluctuation in pressure in the aerosol flow path and thereby such arrangement may lead to an increase in the size of aerosol droplets.

Optionally, the aerosol generation chamber is at least partially surrounded by the passage. Optionally, the passage forms an annulus around the aerosol generation chamber. More specifically, the aerosol generation chamber may be fully surrounded by the passage. Advantageously, the passage may form an effective insulation for reducing heat transfer to the external surface of the housing.

Alternatively, the passage comprises one or more passages each extending along the aerosol generation chamber. The passage may comprise a pair of passages extending along opposing sides of the aerosol generation chamber. For example, the sidewall of the aerosol generation chamber may be formed from partition walls separating the aerosol generation chamber from the flow path.

Optionally, the smoking substitute apparatus is configured to generate an aerosol having a droplet size, $d_{50}$, of at least 1 μm. Optionally, the smoking substitute apparatus is configured to generate an aerosol having a droplet size, $d_{50}$, ranged between 1 μm to 4 μm. Optionally, the smoking substitute apparatus is configured to generate an aerosol having a droplet size, $d_{50}$, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

According to a second aspect of Development C there is provided a smoking substitute system for generating an aerosol, comprising:

i) the smoking substitute apparatus of the first aspect of Development C; and ii) a main body configured to engage with the smoking substitute apparatus; wherein the main body comprises a controller and a power source configured to energize the aerosol generator.

According to a third aspect of Development C there is provided method of using the smoking substitute apparatus of the first aspect of Development C, comprising:

i) generating the aerosol with the aerosol generator;

ii) drawing on the apparatus to entrain the generated aerosol, through the at least one chamber outlet, into the air flow along the passage.

The disclosure includes the combination of the developments, aspects and preferred features described except where such a combination is clearly impermissible or expressly avoided.

BRIEF DESCRIPTION OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION

Further background to the present disclosure and further aspects and embodiments of the present disclosure will now be discussed with reference to the accompanying figures. Further aspects and embodiments will be apparent to those skilled in the art. The contents of all documents mentioned in this text are incorporated herein by reference in their entirety.

Figure 17:
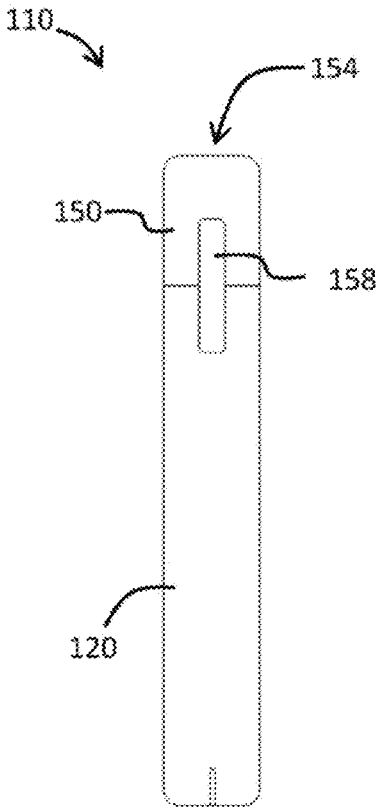
FIG. 17 is a schematic front view of a smoking substitute system, according to a first reference arrangement, in an engaged position.
Figure 18:
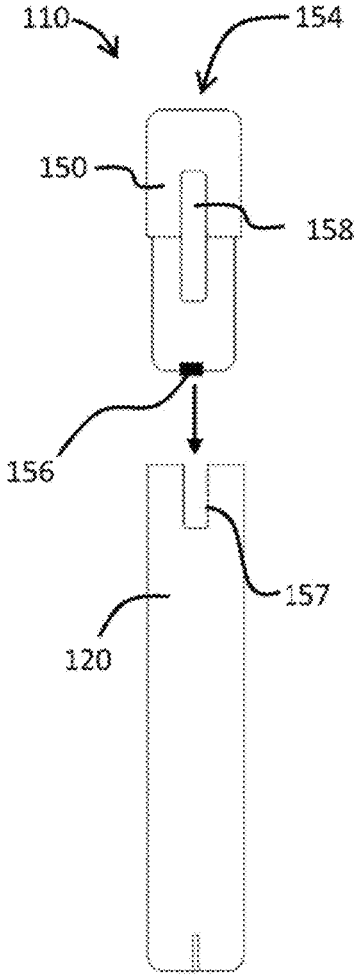
FIG. 18 is a schematic front view of the smoking substitute system of the first reference arrangement in a disengaged position.

FIGS. 17 and 18 illustrate a smoking substitute system in the form of an e-cigarette system 110. The system 110 comprises a main body 120 of the system 110, and a smoking substitute apparatus in the form of an e-cigarette consumable (or "pod") 150. In the illustrated embodiment the consumable 150 (sometimes referred to herein as a smoking substitute apparatus) is removable from the main body 120, so as to be a replaceable component of the system 110. The e-cigarette system 110 is a closed system in the sense that it is not intended that the consumable should be refillable with e-liquid by a user.

As is apparent from FIGS. 17 and 18, the consumable 150 is configured to engage the main body 120. FIG. 17 shows the main body 120 and the consumable 150 in an engaged state, whilst FIG. 18 shows the main body 120 and the consumable 150 in a disengaged state. When engaged, a portion of the consumable 150 is received in a cavity of corresponding shape in the main body 120 and is retained in the engaged position by way of a snap-engagement mechanism. In other embodiments, the main body 120 and consumable 150 may be engaged by screwing one into (or onto) the other, or through a bayonet fitting, or by way of an interference fit.

The system 110 is configured to vaporize an aerosol precursor, which in the illustrated embodiment is in the form of a nicotine-based e-liquid 160. The e-liquid 160 comprises nicotine and a base liquid including propylene glycol and/or vegetable glycerin. In the present embodiment, the e-liquid 160 is flavored by a flavorant. In other embodiments, the e-liquid 160 may be flavorless and thus may not include any added flavorant.

Figure 19:
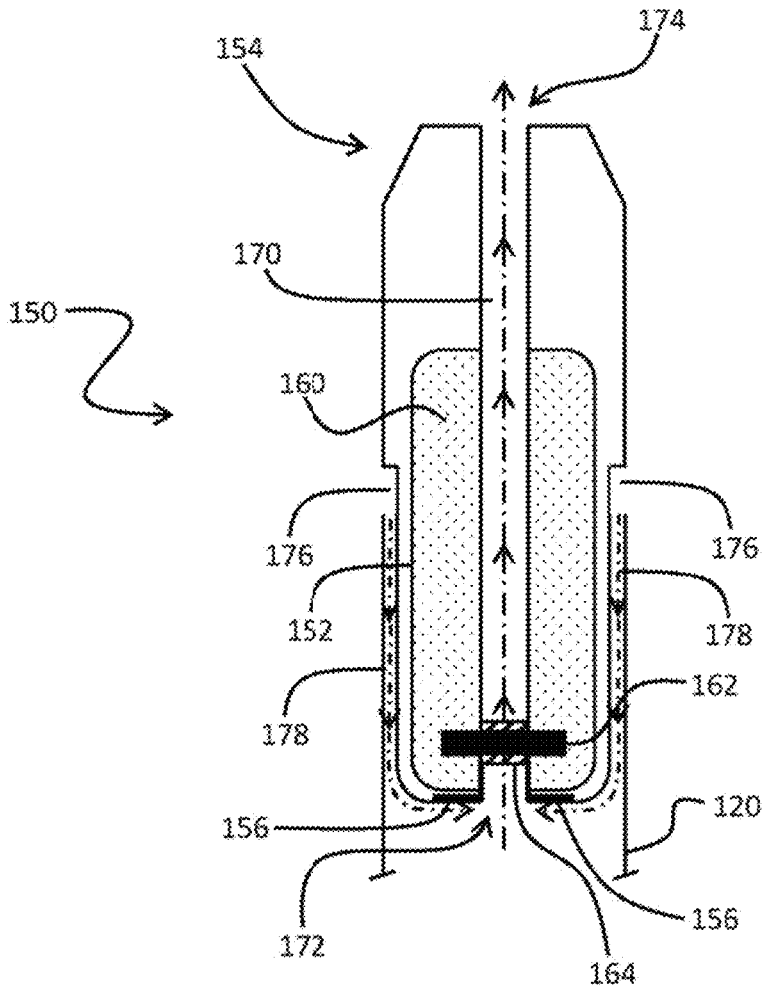
FIG. 19 is a schematic longitudinal cross sectional view of a smoking substitute apparatus of the first reference arrangement.

FIG. 19 shows a schematic longitudinal cross sectional view of a smoking substitute apparatus according to a reference arrangement that is configured to form part of the smoking substitute system shown in FIGS. 17 and 18. The smoking substitute apparatus, or consumable 150 as shown in FIG. 19 is provided as a reference arrangement to illustrate the features of a consumable 150 and its interaction with the main body 120. In FIG. 19, the e-liquid 160 is stored within a reservoir in the form of a tank 152 that forms part of the consumable 150. In the illustrated embodiment, the consumable 150 is a "single-use" consumable 150. That is, upon exhausting the e-liquid 160 in the tank 152, the intention is that the user disposes of the entire consumable 150. The term "single-use" does not necessarily mean the consumable is designed to be disposed of after a single smoking session. Rather, it defines the consumable 150 is not arranged to be refilled after the e-liquid contained in the tank 152 is depleted. The tank may include a vent (not shown) to allow ingress of air to replace e-liquid that has been used from the tank. The consumable 150 preferably includes a window 158 (see FIGS. 1 and 2), so that the amount of e-liquid in the tank 152 can be visually assessed. The main body 120 includes a slot 157 so that the window 158 of the consumable 150 can be seen whilst the rest of the tank 152 is obscured from view when the consumable 150 is received in the cavity of the main body 120. The consumable 150 may be referred to as a "clearomizer" when it includes a window 158, or a "cartomizer" when it does not.

In other embodiments, the e-liquid (i.e., aerosol precursor) may be the only part of the system that is truly "single-use". That is, the tank may be refillable with e-liquid or the e-liquid may be stored in a non-consumable component of the system. For example, in such other embodiments, the e-liquid may be stored in a tank located in the main body or stored in another component that is itself not single-use (e.g., a refillable cartomizer).

The external wall of tank 152 is provided by a casing of the consumable 150. The tank 152 annularly surrounds, and thus defines a portion of, a passage 170 that extends between a vaporizer inlet 172 and an outlet 174 at opposing ends of the consumable 150. In this respect, the passage 170 comprises an upstream end at the end of the consumable 150 that engages with the main body 120, and a downstream end at an opposing end of the consumable 150 that comprises a mouthpiece 154 of the system 110.

When the consumable 150 is received in the cavity of the main body 120 as shown in FIG. 19, a plurality of device air inlets 176 are formed at the boundary between the casing of the consumable and the casing of the main body. The device air inlets 176 are in fluid communication with the vaporizer inlet 172 through an inlet flow channel 178 formed in the cavity of the main body which is of corresponding shape to receive a part of the consumable 150. Air from outside of the system 110 can therefore be drawn into the passage 170 through the device air inlets 176 and the inlet flow channels 178.

When the consumable 150 is engaged with the main body 120, a user can inhale (i.e., take a puff) via the mouthpiece 154 so as to draw air through the passage 170, and so as to form an airflow (indicated by the dashed arrows in FIG. 19) in a direction from the vaporizer inlet 172 to the outlet 174. Although not illustrated, the passage 170 may be partially defined by a tube (e.g., a metal tube) extending through the consumable 150. In FIG. 19, for simplicity, the passage 170 is shown with a substantially circular cross-sectional profile with a constant diameter along its length. In other arrangements and in some embodiments, the passage may have other cross-sectional profiles, such as oval shaped or polygonal shaped profiles. Further, in other arrangements and some embodiments, the cross sectional profile and the diameter (or hydraulic diameter) of the passage may vary along its longitudinal axis.

The smoking substitute system 110 is configured to vaporize the e-liquid 160 for inhalation by a user. To provide this operability, the consumable 150 comprises an aerosol generator such as a heater, said heater having a porous wick 162 and a resistive heating element in the form of a heating filament 164 that is helically wound (in the form of a coil) around a portion of the porous wick 162. The porous wick 162 extends across the passage 170 (i.e., transverse to a longitudinal axis of the passage 170 and thus also transverse to the air flow along the passage 170 during use) and opposing ends of the wick 162 extend into the tank 152 (so as to be immersed in the e-liquid 160). In this way, e-liquid 160 contained in the tank 152 is conveyed from the opposing ends of the porous wick 162 to a central portion of the porous wick 162 so as to be exposed to the airflow in the passage 170.

The helical filament 164 is wound about the exposed central portion of the porous wick 162 and is electrically connected to an electrical interface in the form of electrical contacts 156 mounted at the end of the consumable that is proximate the main body 120 (when the consumable and the main body are engaged). When the consumable 150 is engaged with the main body 120, electrical contacts 156 make contact with corresponding electrical contacts (not shown) of the main body 120. The main body electrical contacts are electrically connectable to a power source (not shown) of the main body 120, such that (in the engaged position) the filament 164 is electrically connectable to the power source. In this way, power can be supplied by the main body 120 to the filament 164 in order to heat the filament 164. This heats the porous wick 162 which causes e-liquid 160 conveyed by the porous wick 162 to vaporize and thus to be released from the porous wick 162. The vaporized e-liquid becomes entrained in the airflow and, as it cools in the airflow (between the heated wick and the outlet 174 of the passage 170), condenses to form an aerosol. This aerosol is then inhaled, via the mouthpiece 154, by a user of the system 110. As e-liquid is lost from the heated portion of the wick, further e-liquid is drawn along the wick from the tank to replace the e-liquid lost from the heated portion of the wick.

The filament 164 and the exposed central portion of the porous wick 162 are positioned across the passage 170. More specifically, the part of passage that contains the filament 164 and the exposed portion of the porous wick 162 forms a vaporization chamber, or aerosol generation chamber. In the illustrated example, the aerosol generation chamber has the same cross-sectional diameter as the passage 170. However, in other embodiments the aerosol generation chamber may have a different cross sectional profile as the passage 170. For example, the aerosol generation chamber may have a larger cross sectional diameter than at least some of the downstream part of the passage 170 so as to enable a longer residence time for the air inside the aerosol generation chamber.

Figure 20:
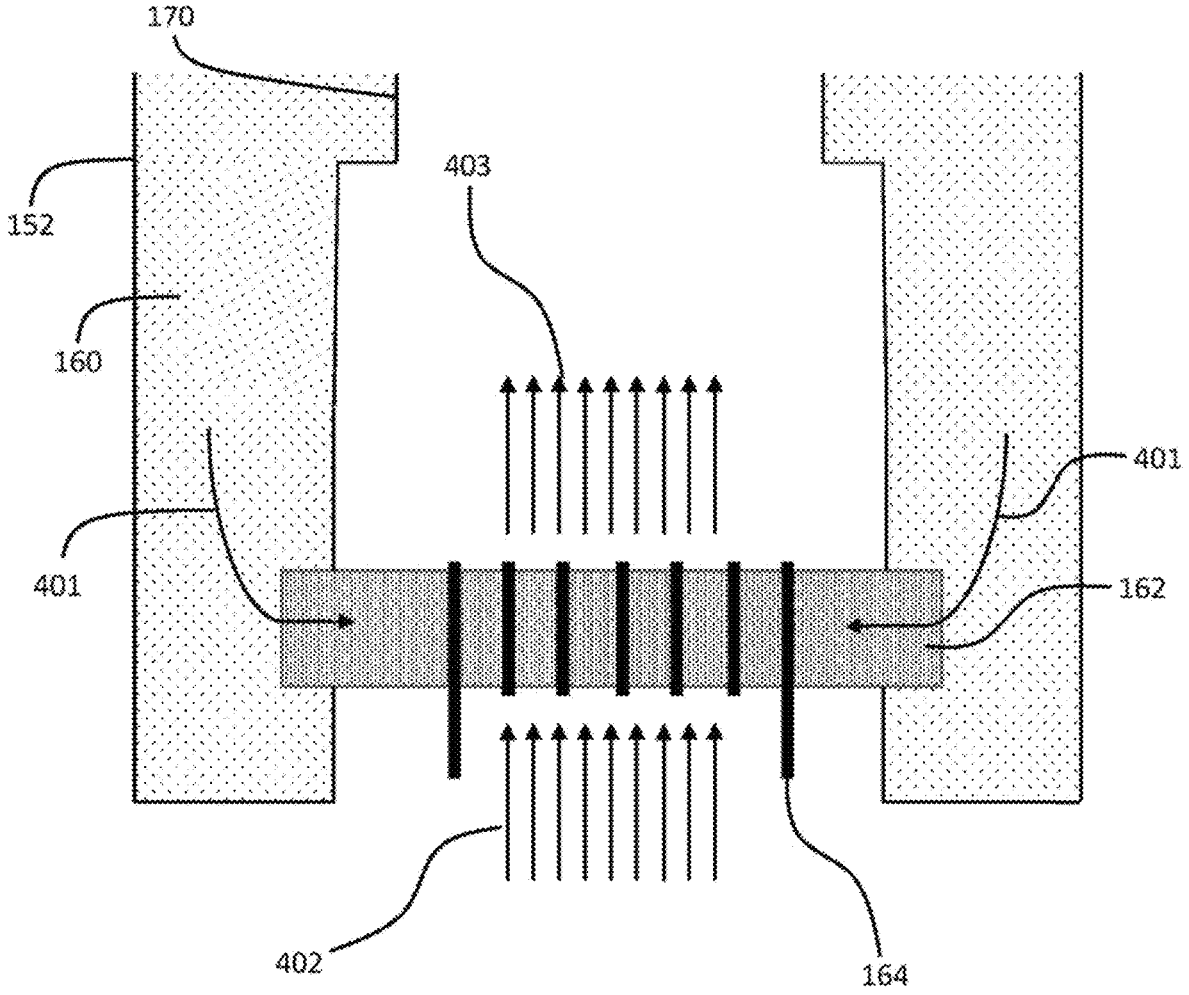
FIG. 20 is an enlarged schematic cross sectional view of part of the air passage and aerosol generation chamber of the first reference arrangement.

FIG. 20 illustrates in more detail the aerosol generation chamber of the reference arrangement as shown in FIG. 19 and therefore the region of the consumable 150 around the wick 162 and filament 164. The helical filament 164 is wound around a central portion of the porous wick 162. The porous wick extends across passage 170. E-liquid 160 contained within the tank 152 is conveyed as illustrated schematically by arrows 401, i.e., from the tank and towards the central portion of the porous wick 162.

When the user inhales, air is drawn from through the air inlets 176 shown in FIG. 19, along inlet flow channel 178 to aerosol generation chamber inlet 172 and into the aerosol generation chamber containing porous wick 162. The porous wick 162 extends substantially transverse to the airflow direction. The airflow passes around the porous wick, at least a portion of the airflow substantially following the surface of the porous wick 162. In examples where the porous wick has a cylindrical cross-sectional profile, the airflow may follow a curved path around an outer periphery of the porous wick 162.

At substantially the same time as the airflow passes around the porous wick 162, the filament 164 is heated so as to vaporize the e-liquid which has been wicked into the porous wick. The airflow passing around the porous wick 162 picks up this vaporized e-liquid, and the vapor-containing airflow is drawn in direction 403 further down passage 170.

The power source of the main body 120 may be in the form of a battery (e.g., a rechargeable battery such as a lithium-ion battery). The main body 120 may comprise a connector in the form of, e.g., a USB port for recharging this battery. The main body 120 may also comprise a controller that controls the supply of power from the power source to the main body electrical contacts (and thus to the filament 164). That is, the controller may be configured to control a voltage applied across the main body electrical contacts, and thus the voltage applied across the filament 164. In this way, the filament 164 may only be heated under certain conditions (e.g., during a puff and/or only when the system is in an active state). In this respect, the main body 120 may include a puff sensor (not shown) that is configured to detect a puff (i.e., inhalation). The puff sensor may be operatively connected to the controller so as to be able to provide a signal, to the controller, which is indicative of a puff state (i.e., puffing or not puffing). The puff sensor may, for example, be in the form of a pressure sensor or an acoustic sensor.

Although not shown, the main body 120 and consumable 150 may comprise a further interface which may, for example, be in the form of an RFID reader, a barcode or QR code reader. This interface may be able to identify a characteristic (e.g., a type) of a consumable 150 engaged with the main body 120. In this respect, the consumable 150 may include any one or more of an RFID chip, a barcode or QR code, or memory within which is an identifier and which can be interrogated via the interface.

Development A

Figure 21:
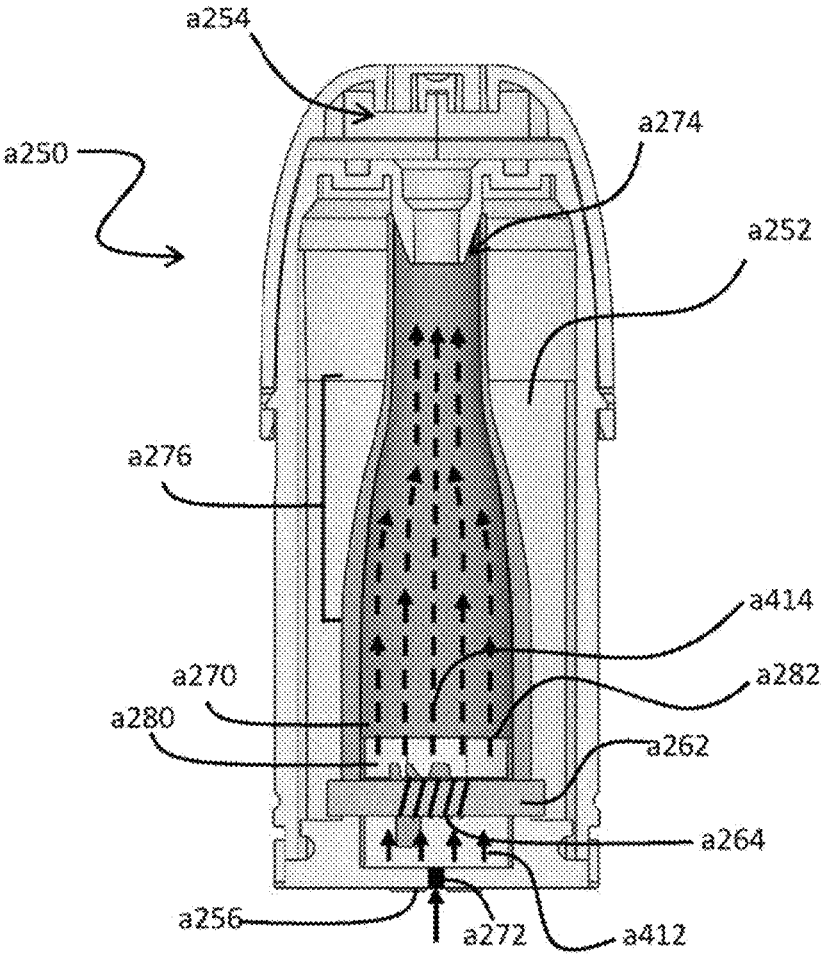
FIG. 21 is a schematic cross sectional view of a smoking substitute apparatus of a first embodiment of Development A.

FIG. 21 illustrates a longitudinal cross sectional view of a smoking substitute apparatus according to the first embodiment of the present disclosure. More specifically, the consumable a250 is configured to engage and disengage with the main body 120 and is interchangeable with the reference arrangement 150 as shown in FIGS. 19 and 20. Furthermore, the consumable a250 is configured to interact with the main body 120 in the same manner as the reference arrangement 150 and the user may operate the consumable a250 in the same manner as the reference arrangement 150.

The consumable a250 comprises a housing which defines an aerosol generation chamber a280 at a first end of the consumable a250. Said first end of the consumable a250 is configured to be received in a cavity of the main body 120. The aerosol generation chamber a280 comprises a heater extending across the aerosol generation chamber a280. The heater comprises a porous wick a262 and a heating filament a264 helically wound around a portion of the porous wick a262. The end portions of the porous wick a262 is configured to be in fluid communication with a tank a252 surrounding the aerosol generation chamber a280 and thereby allow aerosol precursor stored in the tank to be wicked towards the porous wick a262. In use, the heating element is energized and thereby vaporizes aerosol precursor in the porous wick a262 to form a vapor. The vapor may promptly cool in the vicinity of the heater and thereby condenses to form an aerosol. The flow path of the aerosol and/or aerosol a414 is shown as dashed arrows in FIG. 21.

As shown in FIG. 21, the aerosol generation chamber a280 comprises a chamber inlet a272 opened through a base of the aerosol generation chamber a280. The chamber inlet a272 is opened in between a pair of electrical contacts a256. The base of the aerosol generation chamber a280 also forms part of the housing, therefore the chamber inlet a272 also form the air inlet a272 of the housing. The air inlet a272 is opened at the center of the base and directs towards the heater. In use, an airflow, substantially at an ambient temperature, enters the aerosol generation chamber a280 and spreads across the aerosol generation chamber a280. The airflow then passes over the surface of the wick a262 to cool and condense the vapor generated thereat. In some embodiments, a plurality of air inlets may be provided and may be distributed throughout the base of the aerosol generation chamber a280 in order to aid the distribution of airflow. The air inlet a272 is in fluid communication with an outlet a274 through a passage extending between the two.

The aerosol generation chamber a280 further comprises a chamber outlet a282. Said chamber outlet a282 opens towards the outlet a274 at the second end of the housing opposite the first end. The second end of the consumable a250 comprises a mouthpiece a254 on which a user may puff in order to draw the airflow through the chamber inlet a272 and into aerosol generation chamber a280. The airflow then entrains the aerosol formed in the aerosol generation chamber a280 before being drawn through a downstream portion of the passage a270 towards the outlet a274. The flow path a412 of the airflow is shown as solid arrows in FIG. 21. The downstream portion of the passage a270 extends without discontinuity (e.g., seamlessly) from the aerosol generation chamber a280 towards the outlet a274. For example, the connection or intersection between the aerosol generation chamber a280 and the downstream portion of the passage a270 may be substantially free of protrusion and/or indentation that may induce turbulence and/or a sharp change in direction in the aerosol flow.

In the illustrated embodiment, the chamber outlet a282 is configured to be wider than the outlet a274, e.g., the chamber outlet a282 has a larger hydraulic diameter than the outlet a274. The downstream portion of the passage a270*b* comprises a flow converging section a276 for converging the aerosol flow from the wider chamber outlet a282 towards the narrower outlet a274. The flow converging section a276 comprises a curved sidewalls tapered towards the outlet. That is, the cross sectional area of the flow converging section a276 reduces in a non-linear manner along the along its longitudinal axis. As shown in FIG. 21, the curved sidewalls are curved along the longitudinal axis of the passage and may resemble a champagne flute. More specifically, the curved sidewalls comprise a sigmoidal profile, or an S-shaped profile, along the longitudinal axis of the passage.

The flow converging section a276 comprises an upstream end and a downstream end in the direction of the airflow. More specifically, the upstream end refers to an end of the flow converging section a276 directed towards the heater and the downstream end refers to an end of the flow converging section a276 directed towards the outlet a274. As shown in FIG. 21, the upstream end of the flow converging section a276 substantially conforms to the cross sectional profile of the aerosol generation chamber a280. In other words, the widest point along the flow converging section a276 has the same shape and hydraulic diameter, and therefore the same cross sectional area, as the chamber outlet a282 downstream of the heater. This advantageously results in a smooth flow path along the direction of aerosol flow.

In the illustrated embodiment, the flow converging portion a276 is spaced from the chamber outlet a282 along the downstream portion of the passage a270. Such arrangement provides a buffering region for the formation of aerosol droplets, as well as allowing the aerosol flow to stabilize prior to entering the flow converging section a276. For example, the flow of aerosol entering the flow converging section a276 and/or in the flow converging section a276 may be laminar or transitional. In some other embodiments, the upstream end of the flow converging portion is immediately adjacent to the chamber outlet. That is, the downstream portion of the passage comprises curved sidewall extending from the chamber outlet.

Figure 22:
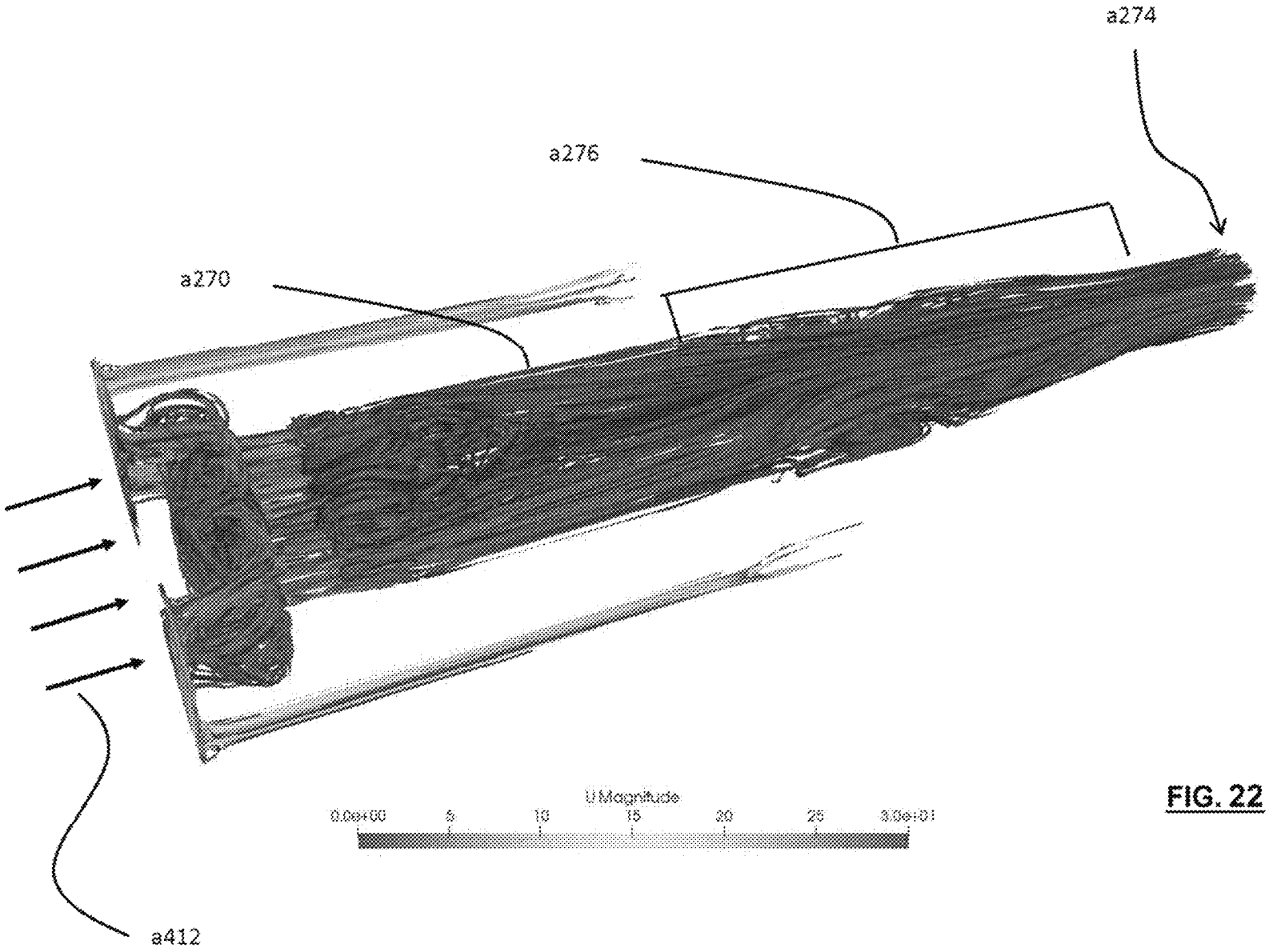
FIG. 22 is a computational fluid dynamics (CFD) plot of flow simulation in the smoking substitute apparatus of FIG. 21.

The flow path or airflow and entrained aerosol is best illustrated in a Computational Fluid Dynamic (CFD) plot as shown in FIG. 22. The CFD plot as shown in FIG. 22 is generated by simulating a user puff taken in the smoking substitute apparatus a250, at a volumetric flowrate of 1.3 L/min. The CFD plot illustrates the airflow and the flow of aerosol in streamline, where the structural details of the apparatus a250 are omitted.

In FIG. 22, an airflow a412 enters the first end of the consumable and entrains generated aerosol as it passes through the aerosol generation chamber a280. The aerosol then stabilizes along the downstream portion of passage a270. For example, the streamline plot indicates the amount of turbulence, or chaotic flow, gradually reduces along the downstream portion of the passage a270. As the aerosol enters the upstream end of the flow converging portion a276, a laminar flow pattern, e.g., a lack of movement or mixing in a direction orthogonal to the flow, is established. Such laminar flow pattern in the aerosol flow continues along the flow converging portion a276 where the aerosol flow gradually converges towards the outlet a274. As a result, aerosol with larger droplet size may be discharged from the outlet due to a substantial reduction in turbulence along the aerosol flow path.

The mouthpiece a254 as illustrated in FIG. 21 covers the first end of the housing. That is, the mouthpiece comprises an aperture fluidly connected to the outlet a274. The aperture may have the same cross sectional profile as the outlet a274, or it may have a different profile to the outlet a274, e.g., the aperture at the mouthpiece may have a smaller or a larger cross sectional area to the outlet a274. In some embodiments, the mouthpiece may be omitted altogether and therefore the user may puff directly on the outlet of the housing.

Figure 23:
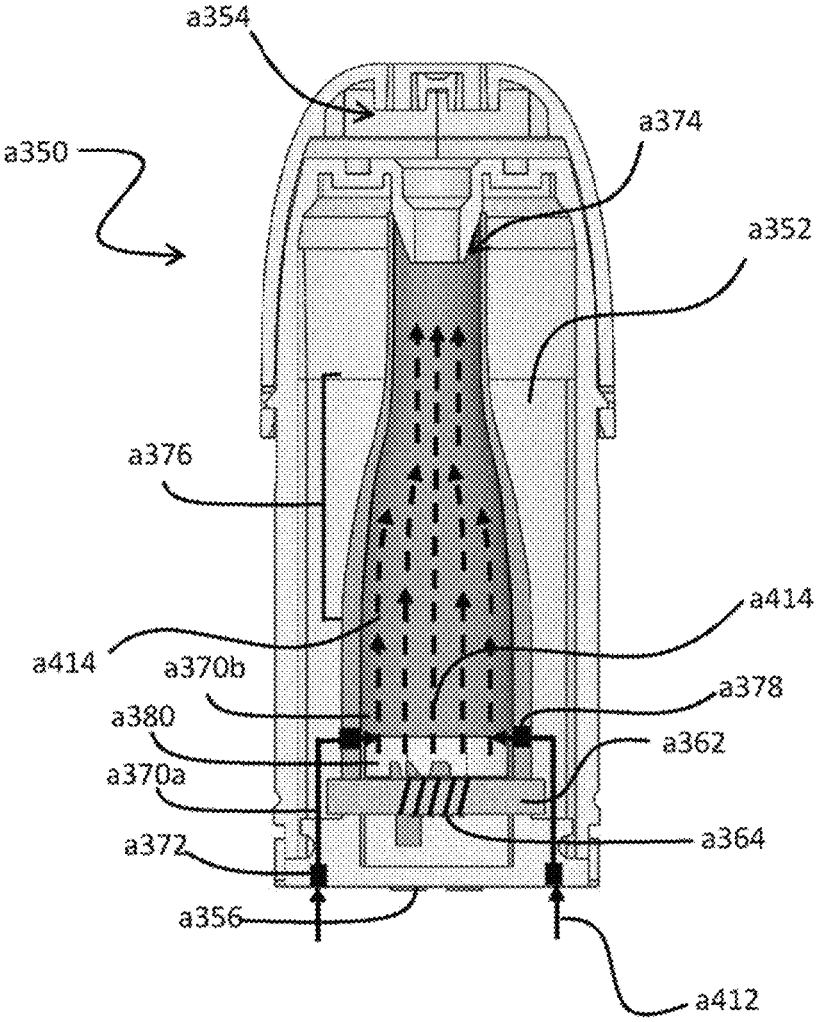
FIG. 23 is a schematic cross sectional view of a smoking substitute system of a second embodiment of Development A.

FIG. 23 illustrates a longitudinal cross sectional view of a smoking substitute apparatus a350 according to the second embodiment of the present disclosure. More specifically, the consumable a350 is configured to engage and disengage with the main body 120 and is interchangeable with the reference arrangement 150 as shown in FIGS. 19 and 20. Furthermore, the consumable a350 is configured to interact with the main body 120 in the same manner as the reference arrangement 150 and the user may operate the consumable a250 in the same manner as the reference arrangement 150.

The consumable a350 of the second embodiment is structurally similar to the consumable 250 as shown in FIG. 21. For example, the consumable a350 comprises a downstream portion of a passage a370*b* having a flow converging section 376 with curved sidewalls tapered towards the outlet a374. The consumable a350 differs to the consumable a250 in that the passage further comprises a pair of upstream portions a370*a* that bypasses the heater in the aerosol generation chamber a380. That is, in this embodiment, the heater is located in a stagnant cavity of the aerosol generation chamber a380 that is substantially free of airflow.

As shown in FIG. 23, the consumable a350 comprises a pair of air inlets a372 opened at the first end of the housing. Through the upstream portions of the passage a370*a*, the air inlets a372 are in fluid communication with respective chamber inlets a378 opened on either sides of the aerosol generation chamber a380 adjacent to the chamber outlet a382. For example, the chamber inlets a378 are configured to allow an airflow a412 to orthogonally emerge into the aerosol flow a414. As such the aerosol at the chamber outlet a382 may entrain with the airflow towards the downstream portion of the passage a370*b*. In other words, a junction is provided along the passage to fluidly connect the upper portion a370*a* and the downstream portion a370*b* of the passage with the chamber outlet a382 of the aerosol generation chamber a380, the junction is configured to allow the aerosol in the aerosol generation chamber a380 to entrain with the airflow passing across the junction.

In contrast with the consumable a250 as shown in FIG. 21 where the airflow passes over the heater, the flow path a412 of the airflow through the consumable a350 of the present disclosure is spaced from the heater. Since the airflow enters through the chamber inlets a378 at a sidewall, it enters the aerosol generation chamber a380 in a direction orthogonal to the longitudinal axis of the housing, e.g., in a radial direction and parallel to the heater, the resulting airflow path does not directly impinge upon the heater. Such arrangement reduces the turbulence in the vicinity of the heater and thereby allows aerosol precursor to be vaporized in absence of a direct airflow. Therefore, the vicinity of the heater may be considered to be a "stagnant" volume. For example, volumetric flowrate of vapor and/or aerosol in the vicinity of the heater may be less than 0.1 liter per minute. The vaporized aerosol precursor, or vapor, may cool and therefore condenses in the vicinity of the heater to form an aerosol, which is subsequently merged or entrained with the airflow. In addition, a portion of the vaporized aerosol precursor may not immediately condense in the vicinity of the heater but may cool to form an aerosol as it entrains into the airflow passing through the junction. With the absence of, or much reduced, airflow in the vicinity of the heater, the aerosol as generated by the illustrated embodiment has an averaged droplet size $d_{50}$ of at least 1 μm. More preferably, the aerosol as generated by the illustrated embodiment has an averaged droplet size $d_{50}$ of ranged between 2 μm to 3 μm.

In the illustrated embodiment, the heater is spaced from the chamber inlets a372. Such arrangement may reduce the amount of airflow that may interact with the heater, and therefore it may minimize the amount of turbulence in the vicinity of the heater. Furthermore, such arrangement may increase the residence time of vapor in the stagnant aerosol generation chamber a380 for the vapor to cool and condense, and thereby it may result in the formation of larger aerosol droplets.

In some other embodiments, the heater may be positioned adjacent to, or immediately upstream of, the chamber inlets along the longitudinal axis of the housing, and therefore that the flow path of aerosol from the heater to merge with the airflow may be shortened. This may allow aerosol to entrain with the airflow in a more efficient manner.

Referring back to FIG. 23, the base of aerosol generation chamber a380 is sealed. This differs to the consumable a250 which comprises a chamber inlet a272 formed at the base of the aerosol generation chamber a280. The heating filament a364 in the illustrated embodiment is electrically connected to electrical contacts a356 through sealed apertures at the base of the aerosol generation chamber a380. Such arrangement prevents air ingress, as well as fluid leakage, through the base of the aerosol generation chamber a380.

In each of the embodiments shown in FIGS. 21 and 23, when the first end of the consumable a250, a350 is received into the main body 120, the electrical contacts a256, a356 contact corresponding electrical contacts in the cavity of the main body 120. As such, the heater is put in electrical connection with the power source in the main body 120.

The electrical contacts a256, a356 have an electrically conductive surface provided at the external surface of base of consumable a250, a350 and extends orthogonally to the longitudinal axis of the housing. Similarly, the corresponding electrical contacts at the main body have an electrically conductive surface provided at the internal surface of cavity of the main body and extends orthogonally to the longitudinal axis of the main body. One, or both, of the electrical contacts a256, a356 and the corresponding electrical contacts of the main body 120 may be resiliently movable in the axial direction. For example, the electrical contacts a256, a356 and corresponding electrical contacts a259 of the main body 120 may comprise a cantilever spring or coil spring. The resilient movement may help to ensure a secure electrical connection. The electrical contacts a256, a356 may have the same configuration as corresponding electrical contacts a259.

In a further embodiment, not illustrated, features of the embodiments of FIGS. 21 and 23 may be combined. For example, there may be an airflow provided over through the aerosol generation chamber (as in FIG. 21) and in addition there may be provided a bypass airflow, bypassing the aerosol generation chamber (as in FIG. 23). This can provide a satisfactory compromise between the technical benefits of particle size control and aerosol entrainment in the airflow to the outlet seen in the embodiments of FIGS. 21 and 23.

The experimental work reported below supports the observation that control over the flow conditions at the heated wick can have a significant effect on the particle size of the generated aerosol, and therefore provides insight into the implementation and advantages associated with the embodiments illustrated in FIGS. 21 and 23.

Development B

Further background to the present disclosure and further aspects and embodiments of the present disclosure will now be discussed with reference to the accompanying figures. Further aspects and embodiments will be apparent to those skilled in the art. The contents of all documents mentioned in this text are incorporated herein by reference in their entirety.

Figure 24:
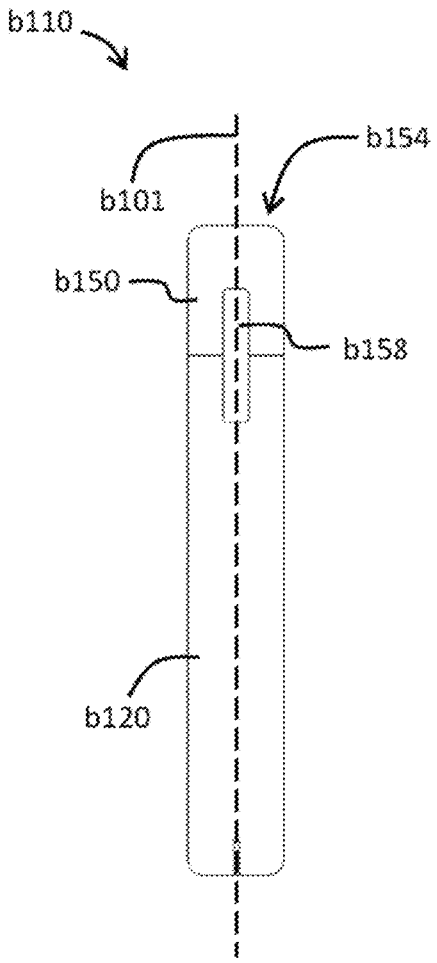
FIG. 24 is a schematic front view of a smoking substitute system, according to a first embodiment of Development B, in an engaged position.
Figure 25:
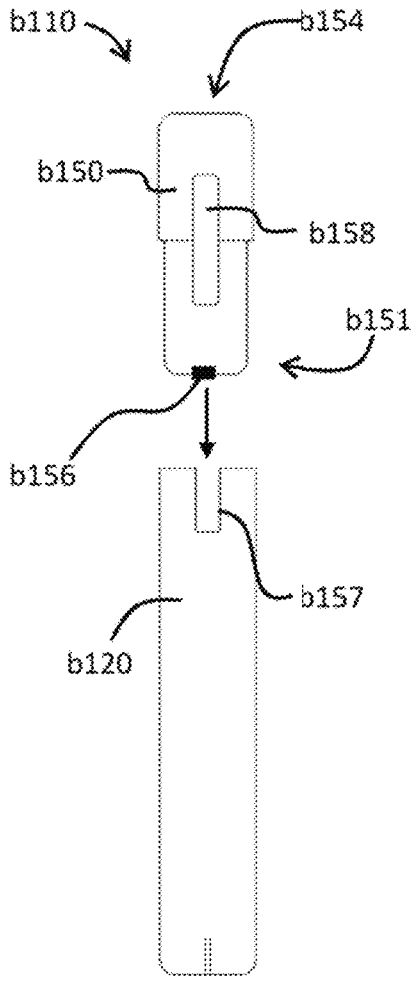
FIG. 25 is a schematic front view of the smoking substitute system of the first embodiment of Development B in a disengaged position.

FIGS. 24 and 25 illustrate a smoking substitute system in the form of an e-cigarette system b110. The system b110 comprises a main body b120 of the system b110, and a smoking substitute apparatus in the form of an e-cigarette consumable (or "pod") b150. In the illustrated embodiment the consumable b150 (sometimes referred to herein as a smoking substitute apparatus) is removable from the main body b120, so as to be a replaceable component of the system b110. The e-cigarette system b110 is a closed system in the sense that it is not intended that the consumable should be refillable with e-liquid by a user.

As is apparent from FIGS. 24 and 25, the consumable b150 is configured to engage the main body b120. FIG. 24 shows the main body b120 and the consumable b150 in an engaged state, whilst FIG. 25 shows the main body b120 and the consumable b150 in a disengaged state. When engaged, a portion of the consumable b150 is received in a cavity of corresponding shape in the main body b120 and is retained in the engaged position by way of a snap-engagement mechanism. In other embodiments, the main body b120 and consumable b150 may be engaged by screwing one into (or onto) the other, or through a bayonet fitting, or by way of an interference fit.

The system b110 is configured to vaporize an aerosol precursor, which in the illustrated embodiment is in the form of a nicotine-based e-liquid b160. The e-liquid b160 comprises nicotine and a base liquid including propylene glycol and/or vegetable glycerin. In the present embodiment, the e-liquid b160 is flavored by a flavorant. In other embodiments, the e-liquid b160 may be flavorless and thus may not include any added flavorant.

Figure 26:
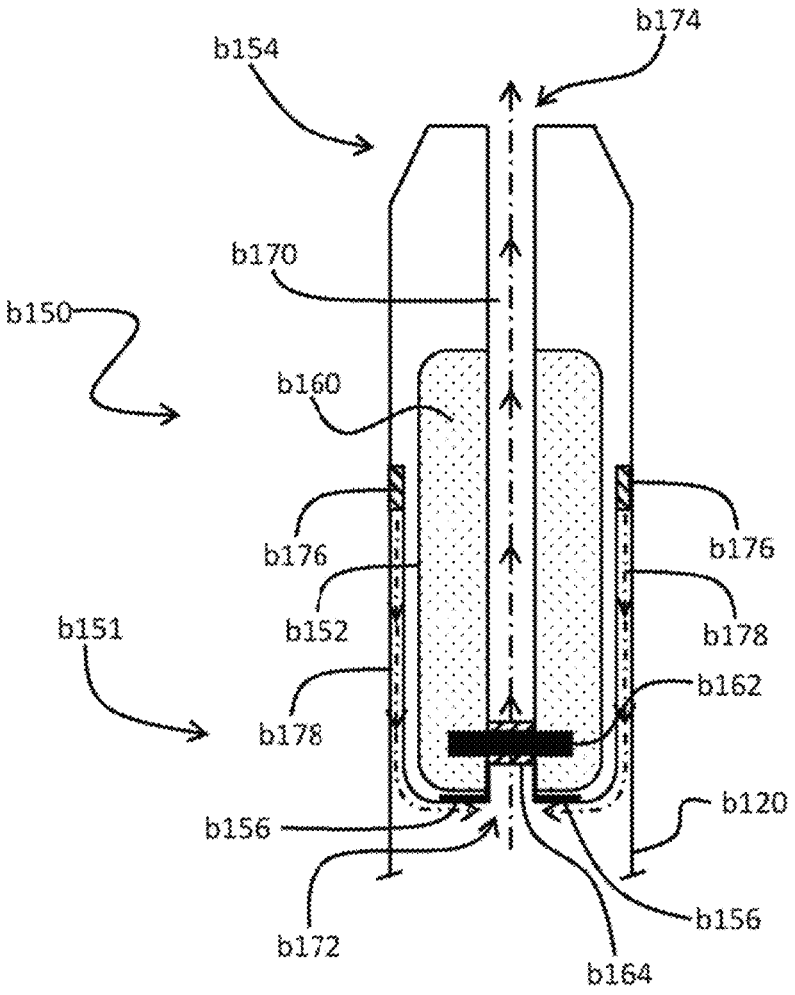
FIG. 26 is a schematic longitudinal cross sectional view of a smoking substitute apparatus of the first embodiment of Development B.

FIG. 26 shows a schematic longitudinal cross sectional view of the smoking substitute apparatus forming part of the smoking substitute system shown in FIGS. 24 and 25. In FIG. 26, the e-liquid b160 is stored within a reservoir in the form of a tank b152 that forms part of the consumable b150. In the illustrated embodiment, the consumable b150 is a "single-use" consumable b150. That is, upon exhausting the e-liquid b160 in the tank b152, the intention is that the user disposes of the entire consumable b150. The term "single-use" does not necessarily mean the consumable is designed to be disposed of after a single smoking session. Rather, it defines the consumable b150 is not arranged to be refilled after the e-liquid contained in the tank b152 is depleted. The tank may include a vent (not shown) to allow ingress of air to replace e-liquid that has been used from the tank. The consumable b150 preferably includes a window b158 (see FIGS. 24 and 25), so that the amount of e-liquid in the tank b152 can be visually assessed. The main body b120 includes a slot b157 so that the window b158 of the consumable b150 can be seen whilst the rest of the tank b152 is obscured from view when the consumable b150 is received in the cavity of the main body b120. The consumable b150 may be referred to as a "clearomizer" when it includes a window b158, or a "cartomizer" when it does not.

In other embodiments, the e-liquid (i.e., aerosol precursor) may be the only part of the system that is truly "single-use". That is, the tank may be refillable with e-liquid or the e-liquid may be stored in a non-consumable component of the system. For example, in such other embodiments, the e-liquid may be stored in a tank located in the main body or stored in another component that is itself not single-use (e.g., a refillable cartomizer).

The external wall of tank b152 is provided by a casing of the consumable b150. The tank b152 annularly surrounds, and thus defines a portion of, a passage b170 that extends between a vaporizer inlet b172 and an outlet b174 at opposing ends of the consumable b150. In this respect, the passage b170 comprises an upstream end at the end b151 of the consumable b150 that engages with the main body b120, and a downstream end at an opposing end of the consumable b150 that comprises a mouthpiece b154 of the system b110. Note that further features relevant to the structure and operation of the air flow passage b170 are set out further below.

When the consumable b150 is received in the cavity of the main body b120 as shown in FIG. 26, a plurality of device air inlets b176 are formed at the boundary between the casing of the consumable and the casing of the main body. The device air inlets b176 are in fluid communication with the vaporizer inlet b172 through an inlet flow channel b178 formed in the cavity of the main body which is of corresponding shape to receive a part of the consumable b150. Air from outside of the system b110 can therefore be drawn into the passage b170 through the device air inlets b176 and the inlet flow channels b178.

When the consumable b150 is engaged with the main body b120, a user can inhale (i.e., take a puff) via the mouthpiece b154 so as to draw air through the passage b170, and so as to form an air flow (indicated by the dashed arrows in FIG. 26) in a direction from the vaporizer inlet b172 to the outlet b174. Although not illustrated, the passage b170 may be partially defined by a tube (e.g., a metal tube) extending through the consumable b150. In FIG. 26, for illustrative simplicity, the passage b170 is shown with a substantially circular cross-sectional profile with a constant diameter along its length. However, as will be understood from this disclosure, embodiments of the disclosure may require that the passage may have other cross-sectional profiles, to promote certain flow characteristics. Further, the cross sectional profile and/or the diameter (or hydraulic diameter) of the passage may vary along its longitudinal axis.

The smoking substitute system b110 is configured to vaporize the e-liquid b160 for inhalation by a user. To provide this operability, the consumable b150 comprises a heater having a porous wick b162 and a resistive heating element in the form of a heating filament b164 that is helically wound (in the form of a coil) around a portion of the porous wick b162. The porous wick b162 extends across the passage b170 (i.e., transverse to a longitudinal axis of the passage b170 and thus also transverse to the air flow along the passage b170 during use) and opposing ends of the wick b162 extend into the tank b152 (so as to be immersed in the e-liquid b160). In this way, e-liquid b160 contained in the tank b152 is conveyed from the opposing ends of the porous wick b162 to a central portion of the porous wick b162 so as to be exposed to the air flow in the passage b170.

The helical filament b164 is wound about the exposed central portion of the porous wick b162 and is electrically connected to an electrical interface in the form of electrical contacts b156 mounted at the end of the consumable that is proximate the main body b120 (when the consumable and the main body are engaged). When the consumable b150 is engaged with the main body b120, electrical contacts b156 make contact with corresponding electrical contacts (not shown) of the main body b120. The main body electrical contacts are electrically connectable to a power source (not shown) of the main body b120, such that (in the engaged position) the filament b164 is electrically connectable to the power source. In this way, power can be supplied by the main body b120 to the filament b164 in order to heat the filament b164. This heats the porous wick b162 which causes e-liquid b160 conveyed by the porous wick b162 to vaporize and thus to be released from the porous wick b162. The vaporized e-liquid becomes entrained in the air flow and, as it cools in the air flow (between the heated wick and the outlet b174 of the passage b170), condenses to form an aerosol. This aerosol is then inhaled, via the mouthpiece b154, by a user of the system b110. As e-liquid is lost from the heated portion of the wick, further e-liquid is drawn along the wick from the tank to replace the e-liquid lost from the heated portion of the wick.

The filament b164 and the exposed central portion of the porous wick b162 are positioned across the passage b170. More specifically, the part of passage that contains the filament b164 and the exposed portion of the porous wick b162 forms a vaporization chamber. In the illustrated example, the vaporization chamber has the same cross-sectional diameter as the passage b170. However, in other embodiments the vaporization chamber may have a different cross sectional profile as the passage b170. For example, the vaporization chamber may have a larger cross sectional diameter than at least some of the downstream part of the passage b170 so as to enable a longer residence time for the air inside the vaporization chamber.

Figure 27:
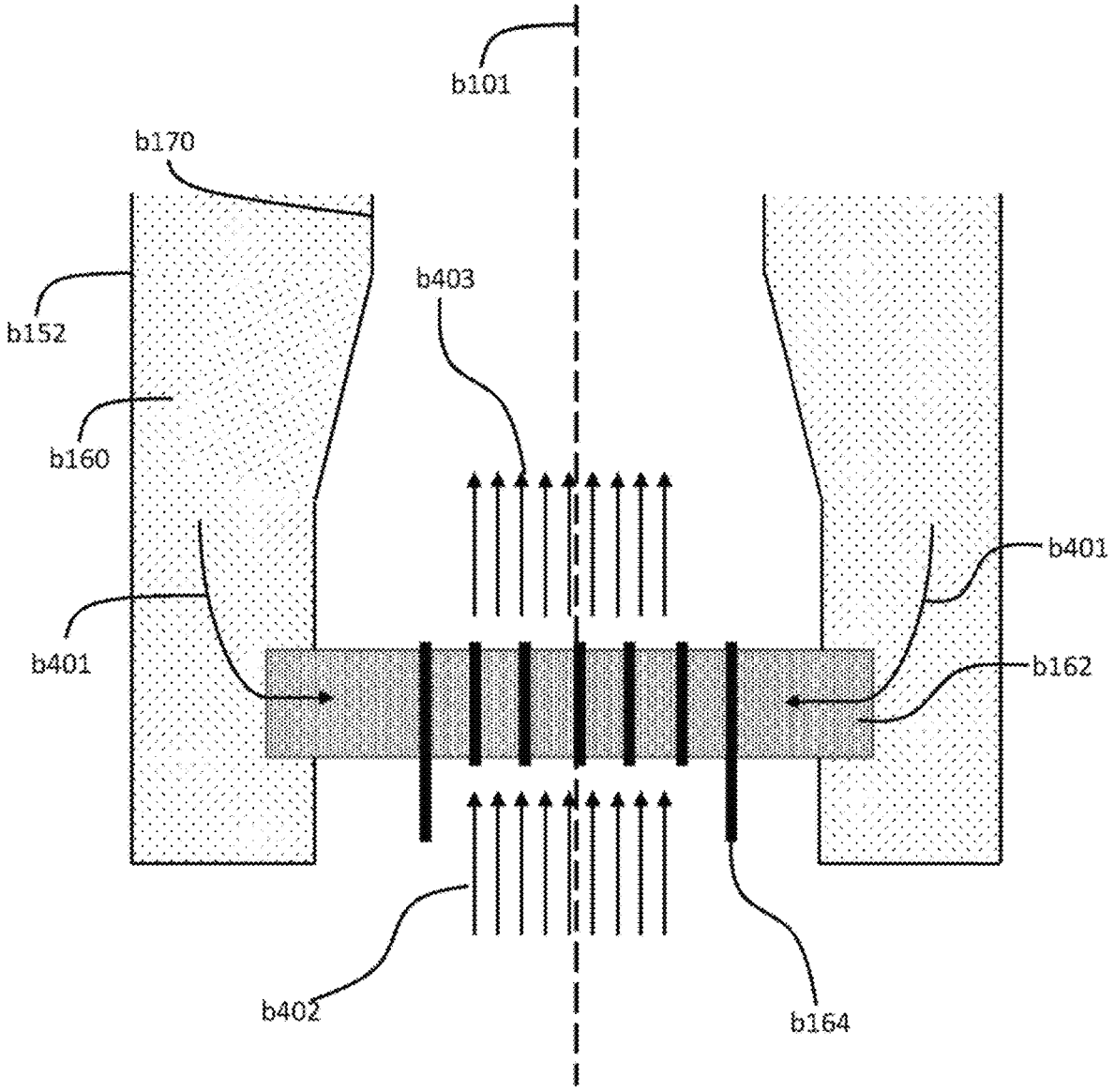
FIG. 27 is an enlarged schematic cross sectional view of part of the air passage and vaporization chamber of the first embodiment of Development B.

FIG. 27 illustrates in more detail the vaporization chamber and therefore the region of the consumable b150 around the wick b162 and filament b164. The helical filament b164 is wound around a central portion of the porous wick b162. The porous wick extends across passage b170. E-liquid b160 contained within the tank b152 is conveyed as illustrated schematically by arrows b401, i.e., from the tank and towards the central portion of the porous wick b162.

When the user inhales, air is drawn from through the inlets b176 shown in FIG. 26, along inlet flow channel b178 to vaporization chamber inlet b172 and into the vaporization chamber containing porous wick b162. The porous wick b162 extends substantially transverse to the air flow direction. The air flow passes around the porous wick, at least a portion of the air flow substantially following the surface of the porous wick b162. In examples where the porous wick has a cylindrical cross-sectional profile, the air flow may follow a curved path around an outer periphery of the porous wick b162.

At substantially the same time as the air flow passes around the porous wick b162, the filament b164 is heated so as to vaporize the e-liquid which has been wicked into the porous wick. The air flow passing around the porous wick b162 picks up this vaporized e-liquid, and the vapor-containing air flow is drawn in direction b403 further down passage b170.

The power source of the main body b120 may be in the form of a battery (e.g., a rechargeable battery such as a lithium-ion battery). The main body b120 may comprise a connector in the form of, e.g., a USB port for recharging this battery. The main body b120 may also comprise a controller that controls the supply of power from the power source to the main body electrical contacts (and thus to the filament b164). That is, the controller may be configured to control a voltage applied across the main body electrical contacts, and thus the voltage applied across the filament b164. In this way, the filament b164 may only be heated under certain conditions (e.g., during a puff and/or only when the system is in an active state). In this respect, the main body b120 may include a puff sensor (not shown) that is configured to detect a puff (i.e., inhalation). The puff sensor may be operatively connected to the controller so as to be able to provide a signal, to the controller, which is indicative of a puff state (i.e., puffing or not puffing). The puff sensor may, for example, be in the form of a pressure sensor or an acoustic sensor.

Although not shown, the main body b120 and consumable b150 may comprise a further interface which may, for example, be in the form of an RFID reader, a barcode or QR code reader. This interface may be able to identify a characteristic (e.g., a type) of a consumable b150 engaged with the main body b120. In this respect, the consumable b150 may include any one or more of an RFID chip, a barcode or QR code, or memory within which is an identifier and which can be interrogated via the interface.

Figure 28:
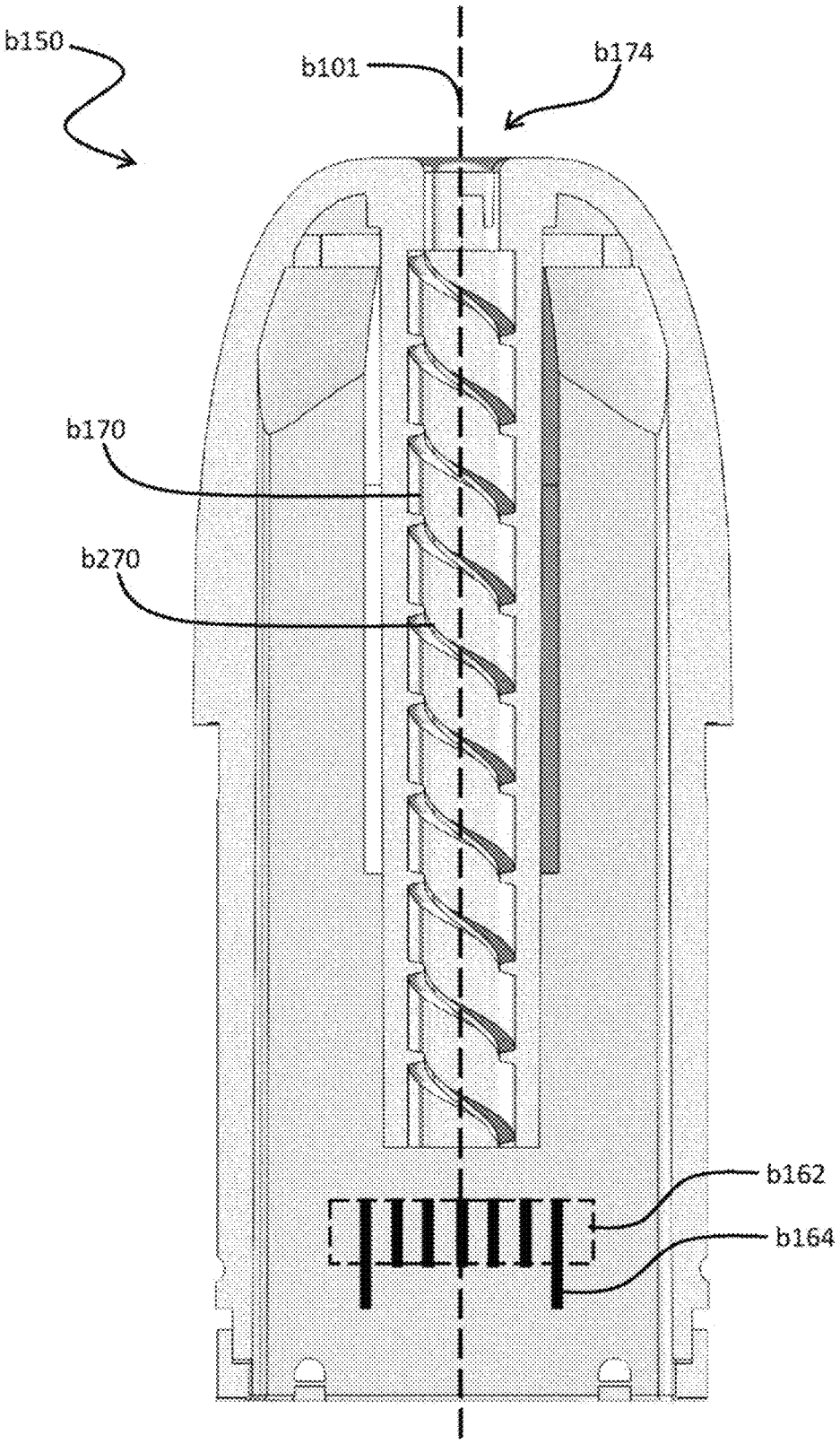
FIG. 28 is a view of an air flow passage of a smoking substitute apparatus illustrating features of the air flow passage for implementation in an embodiment of the disclosure of Development B.

FIG. 28 shows the passage, or air flow channel, b170 of the consumable b150 in more detail. Some other features of the consumable b150 are shown to give context. The air flow channel b170 extends downstream of the heater b164 and the wick b162. The location of the heater b164 and the wick b162 is shown for context, although features of the e-liquid reservoir and of the vaporization chamber are not shown. The air flow channel b170 leads to an outlet b174. The air flow channel b170 has a longitudinal axis b101. The heater b164 is configured to generate an aerosol. The generated aerosol flows towards the outlet b174 along the air flow channel b170. The air flow channel b170 is configured to induce a helical or spiral flow path. The air flow channel b170 is configured to induce a helical or spiral flow path to at least an annular shaped portion of the generated aerosol alongside a wall of the air flow channel b170. In FIG. 28 the air flow channel b170 has a helical guide b270 to induce a helical or spiral flow path. Note that the overall cross sectional shape of the air flow channel may be a shape other than circular. In particular the overall cross sectional shape of the air flow channel may be elliptical, oval or racetrack shape, and the expressions "helical" and "spiral" may be interpreted in conformity with this, and not necessarily implying a strictly circular overall cross sectional envelope for the helical or spiral flow path.

Figure 29:
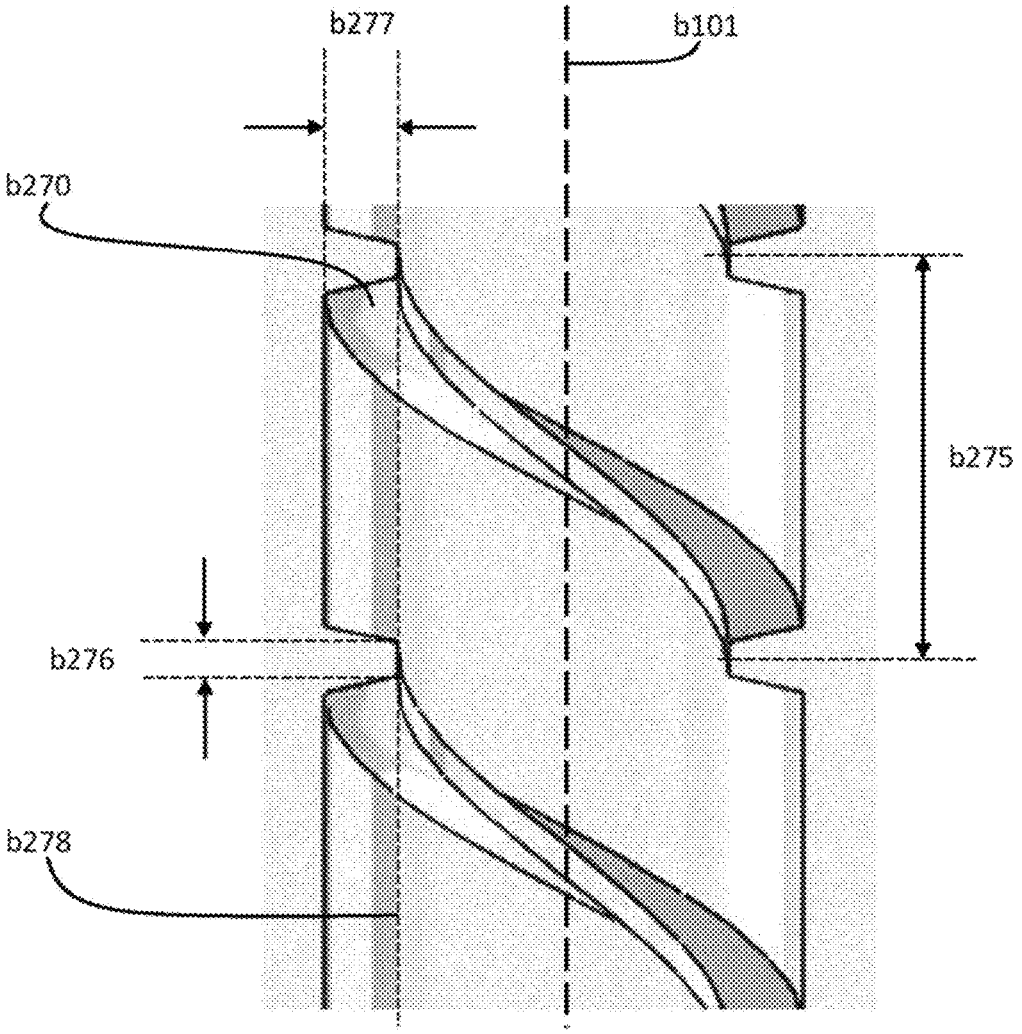
FIG. 29 is a detailed view of part of the air flow passage of FIG. 28.
Figure 30:
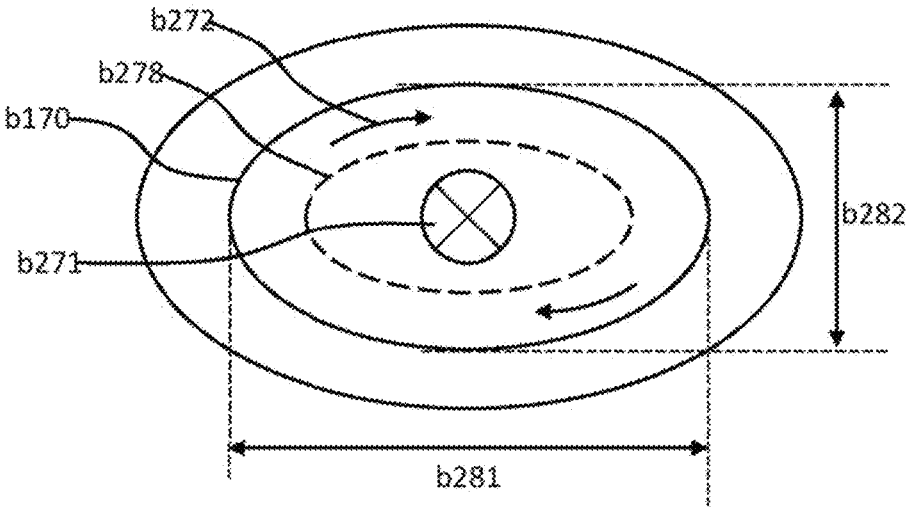
FIG. 30 is a cross-sectional view through the air flow passage of FIG. 29.

FIGS. 29 and 30 show the air flow channel b170 and the helical guide b270 in more detail. The helical guide b270 protrudes radially inwardly from a wall of the air flow channel b170. The helical guide b270 has a radially innermost edge b278. Edge b278 may be aligned parallel to the longitudinal axis b101. The helical guide b270 has a pitch b275. The pitch b275 is a distance, in the axial direction, between adjacent portions of the guide b270. The helical guide b270 has a width b276. The width b276 is a dimension of the guide along the axial direction, i.e., the width of the protrusion from the wall of the air flow channel. The width may be measured at the wall, at the inward extremity of the guide, or at some other position. In the example shown in FIG. 29, the width b276 of the helical guide reduces from a first width closest to a wall of the air flow channel to a second width at the radially innermost edge b278 of the helical guide. The helical guide b270 has a depth b277. The depth b277 is a dimension of the guide in a radial direction, i.e., the amount by which the guide protrudes inwardly from the wall of the air flow channel b170. The value of the pitch b275, and/or of the width b276 and/or of the depth b277 may be constant along the air flow channel. Alternatively, one or more of them may vary along the air flow channel in order to promote suitable air flow characteristics along the air flow channel.

Figure 31:
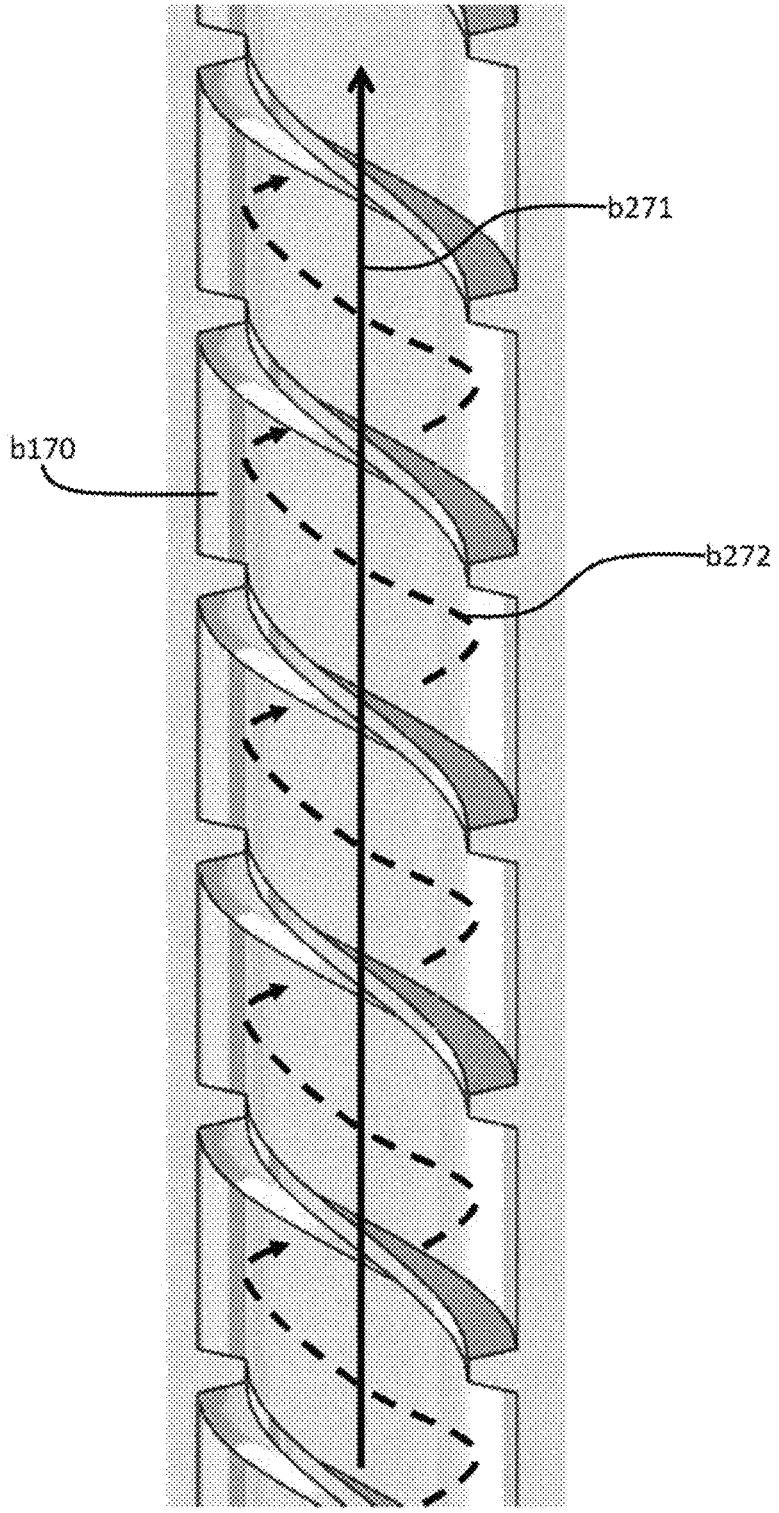
FIG. 31 is a view showing air flow paths along the air flow passage of FIGS. 28 and 29.

FIGS. 30 and 31 show air flow along the air flow channel b170. A first portion of the total air flow follows a substantially straight flow path b271 in an axial direction, i.e., along, or parallel to, the longitudinal axis of the air flow channel. In the cross-section of FIG. 30, the first portion of the air flow is directed into the page. A second portion of the total air flow follows a substantially helical flow path b272. By selection of the pitch b275 of the helical guide b270 it is possible to control the rate of swirling air. By selection of the depth b277 of the helical guide b270 it is possible to control the amount of swirling air, i.e., the portion which follows the helical flow path b272 compared to the portion which follows the straight flow path b271.

The depth b277 shown in FIG. 29 is around 15% of the width of the channel b170. More generally, the depth may have a lower limit of around 5%. The depth may have an upper limit of around 40%. The depth may be 10%, or 15%, or 20%, or 25%, or 35% of the width of the channel. For air flow channels b170 which are circular when viewed in in cross-section, the width may conveniently be expressed as a diameter of the air flow channel b170. For air flow channels b170 which are non-circular when viewed in cross-section (e.g., oval, elliptical or racetrack) the dimension of the air flow channel may be more conveniently expressed as a width, or as a maximum/minimum dimension of the air flow channel b170. FIG. 30 shows a maximum dimension b281 of the air flow channel b170 in a direction which is orthogonal to the longitudinal axis b101 of the air flow channel b170. FIG. 30 also shows a minimum dimension b282 of the air flow channel b170 in a direction which is orthogonal to the longitudinal axis b101 of the air flow channel b170.

The pitch b275 may be defined in terms of a number of complete turns about the longitudinal axis b101 along the length of the air flow channel b170 where the guide b270 is present. A minimum number of turns is about 2.

Figure 32:
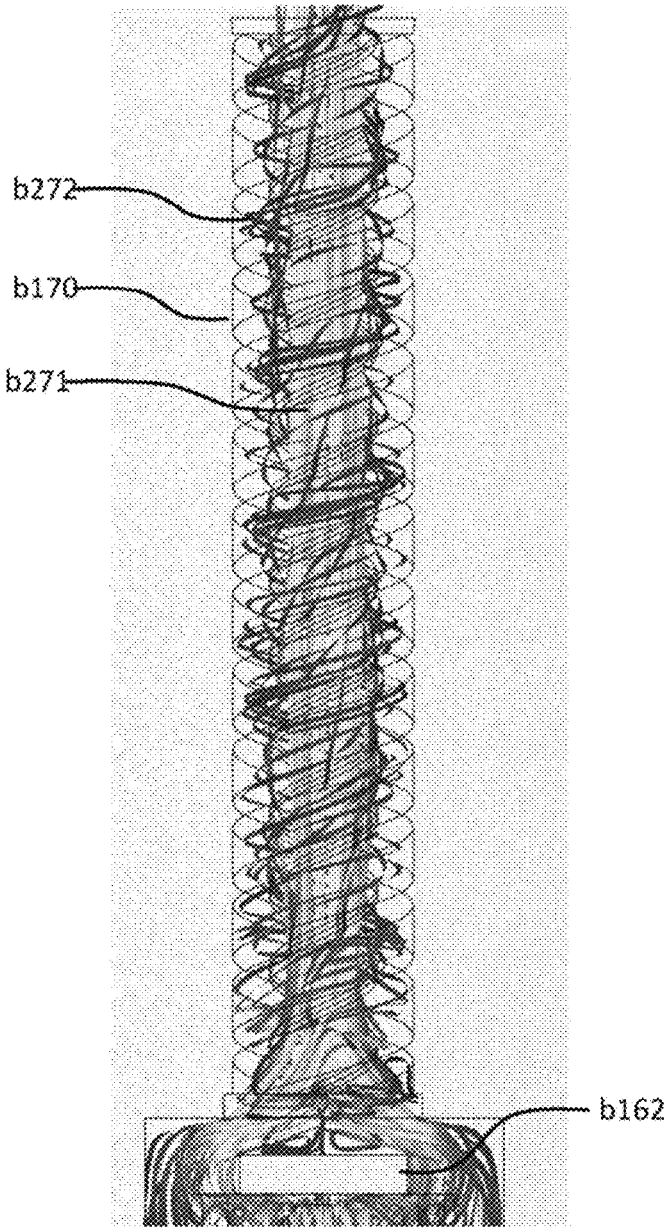
FIG. 32 is a view showing results of modelling of air flow paths along the air flow passage of FIGS. 28 to 31.

FIG. 32 shows results of air flow modelling of an embodiment of the air flow passage b170 with a helical guide b270. FIG. 32 shows the first portion of air flow following the straight flow path b271 and the second portion of the air flow following the helical flow path b272. The helical flow path b272 is similar to a tornado. The tornado effect has been shown to be laminar in nature with little turbulence.

As shown in FIG. 32, the swirling annular flow path surrounds a substantially axial flow path. The average magnitude of velocity of the flow in the substantially axial flow path is greater than average magnitude of velocity of the flow in the swirling annular flow path.

An advantage of the swirling annular flow is a decreased level of liquid reaching the mouth of the user. At the time of writing, without wishing to be bound by theory, the inventors speculate that this may be due to the swirling air flow being relatively laminar in nature. This can reduce the number of droplets that impact the wall, and therefore reduce deposition on the wall. It is considered that leakage of liquid from the apparatus is reduced in view of a combination of the slow swirling annular flow and the faster axial flow. This is possibly because the slow swirling outer flow provides an "air curtain", which may act to reduce condensed liquid on the interior surface of the flow passage from being picked up by the flow and carried to the user's mouth. It is considered that the use of a swirling annular flow is an effective way to reduce flow velocity close to the wall. This is because it can result in little or no turbulence being generated, in contrast, for example, to a "bumpy" wall. It is considered that lower turbulence is advantageous in order to provide a suitable particle size distribution.

Development C

Figure 33A:
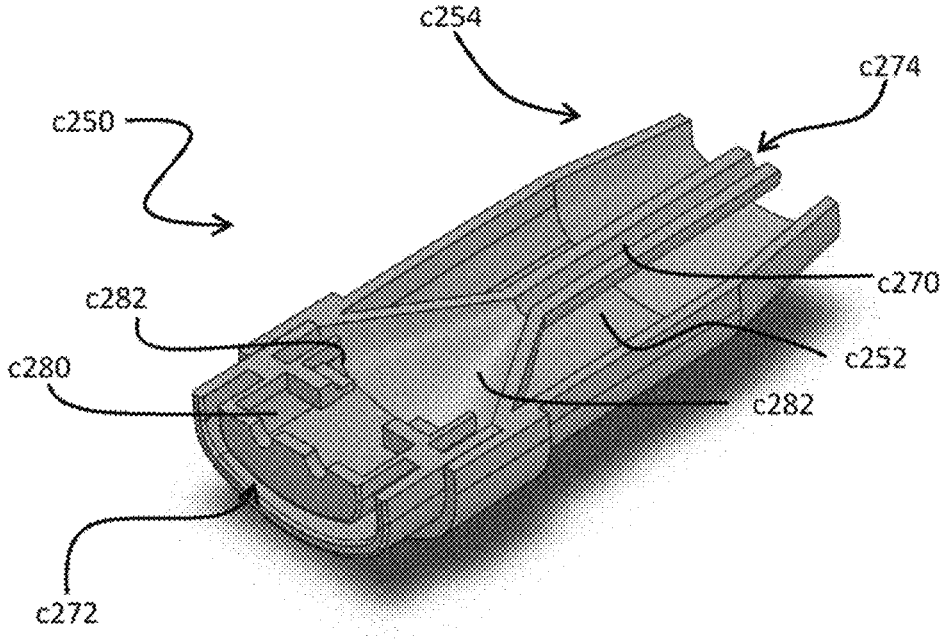
FIG. 33A is a schematic perspective cross sectional view of a smoking substitute apparatus of the first embodiment of Development C.
Figure 33B:
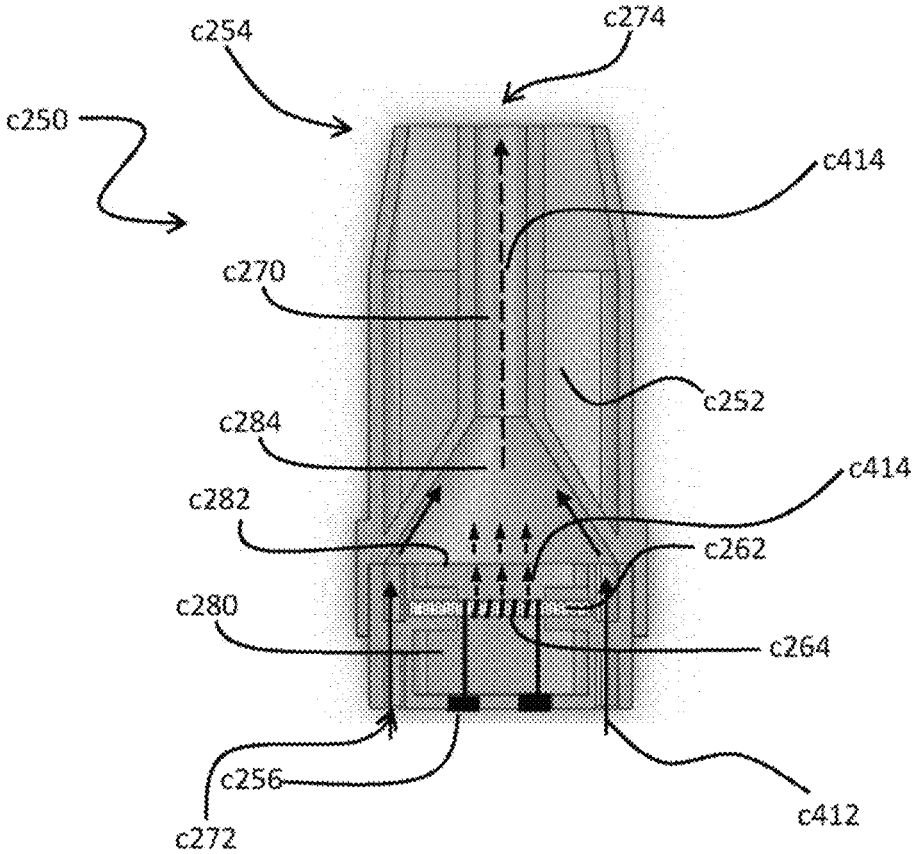
FIG. 33B is a schematic longitudinal cross sectional view of the smoking substitute apparatus of the first embodiment of Development C.

FIGS. 33A and 33B respectively illustrates a perspective view and sectional view of a consumable c250 according to the first embodiment of the present disclosure. In FIG. 33A, the heater and its electrical connections are omitted form the drawing to better illustrate the internal construction of the consumable c250, but they are nevertheless present. The consumable c250 is configured to engage and disengage with the main body 120 as shown in FIGS. 17 and 18, e.g., the consumable 250 is interchangeable with the prior art consumable 150 as shown in FIGS. 19 and 20. Furthermore, the consumable c250 is configured to interact with the main body 120 in the same manner as the consumable 150 and the user may operate the consumable c250 in the same manner as the consumable 150.

The consumable c250 comprises a housing. The housing has an air inlet c272 defined at a base of the housing at a first end of the consumable. Said first end of the consumable c250 is engageable with the main body 120, and an outlet c274 is defined at a second end of the consumable c250 that comprises a mouthpiece c254. A passage c270 extends between the air inlet c272 and the outlet c274 to provide flow passage for an air flow c412 as a user puffs on the mouthpiece c254. That is, when the consumable c250 is engaged with the main body 120, a user can inhale or puff via a mouthpiece c254 so as to draw air through passage c270, and so as to form an air flow in a direction from an air inlet c272 to the outlet c274. The path of the air flow c412 is illustrated as solid arrows in FIG. 33B.

In contrast with the consumable 150 as shown in FIGS. 19 and 20, the air flow passage c270 of the consumable c250 bypasses the aerosol generation chamber c280. For example, the aerosol generation chamber c280 comprises a chamber outlet c282 that is positioned downstream of a heater therein, and wherein the chamber outlet c282 forms the only aperture at the aerosol generation chamber c280 that provides gas flow passage. Because the chamber outlet c282 is positioned downstream of the heater, such arrangement allows the aerosol precursor to be vaporized in substantially absence of the air flow. Therefore, the aerosol generation chamber c280 may be considered to be a "stagnant" chamber and substantially free of the air flow drawn in by a puff. The vaporized aerosol precursor may cool and therefore condense to form an aerosol in the aerosol generation chamber c280, which is subsequently entrained into the air flow in passage c270 through the chamber outlet c282. In addition, a portion of the vaporized aerosol precursor may remain as a vapor before leaving the aerosol generation chamber c280, and subsequently forms an aerosol as it is cooled by the cooler air flow in the passage c270. A degree of flow in the aerosol generation chamber c280 may nevertheless result from localized pressure increase during the vaporization of aerosol precursor. However, the turbulence in the aerosol generation chamber c280 during vaporization of aerosol precursor and formation of aerosol droplets, in particular in the vicinity of the heater, is substantially less than that in the aerosol generation chamber 180 of the reference arrangement as shown in FIGS. 19 and 20. The flow path of the aerosol and/or vapor c414 is illustrated as dotted arrows in FIG. 33B.

As shown in FIGS. 33A and 33B, the aerosol generation chamber c280 takes the form of an open ended container, or a cup, with the chamber outlet c282 opened towards the outlet c274 of the consumable c250. The chamber outlet c282 is positioned downstream to the heater in the direction of the vapor and/or aerosol flow c414 and serves as the only gas flow passage to the internal volume of the aerosol generation chamber c280. In other words, the aerosol generation chamber c280 is sealed against air flow except for having the chamber outlet c282 in communication with the passages c270, the chamber outlet c282 permitting, in use, aerosol generated by the heater to be entrained into an air flow along the passage c270. The passage c270 extends, in the form of an annulus, from the air inlet c272 and alongside the external sidewalls of the aerosol generation chamber c280. That is, the passage c270 surrounds the length of aerosol generation chamber c280. More specifically, the aerosol generation chamber c280 can be described as being completely enclosed in a widened part of passage c270 towards the first end of the consumable c250. In other embodiments, additional air inlets may open on a sidewall of the housing and fluidly connect to the passage. For example, the additional air inlets may be fluidly communicate with the passage between the air inlet c272 and the chamber outlet c282. Additional air inlets may alternatively, or in addition, fluidly connect with the passage at a position between the chamber outlet c282 and the outlet c274. Such an arrangement may limit the amount of air flow sweeping across the chamber outlet c282 and thereby reduces the chances of air flow ingress through said chamber outlet c282 and into the aerosol generation chamber c280. The aerosol generation chamber c280 comprises a heater extending across its width. The heater comprises a porous wick c262 and a heating filament c264 helically wound around a portion of the porous wick c262. A tank c252 is provided towards the second end of the consumable c250 for storing a reservoir of aerosol precursor. The tank c252 annularly surrounds a narrowed portion of passage c270 towards the outlet c274. The end portions of the porous wick c262 extend through respective wick apertures at the sidewalls of the aerosol generation chamber c280 and into the tank c252 for wicking aerosol precursor stored therein. When the porous wick c262 is primed with aerosol precursor, e.g., during use, it blocks and thereby prevents gas flow passage through said wick apertures.

The air inlet c272 is arranged to be separated from the base of the aerosol generation chamber c280. In the illustrated embodiment, the air inlet c272 is arranged to be radially adjacent to the base of the aerosol generation chamber c280. That is, the air inlet c272 does not open at the base of aerosol generation chamber and instead it leads to the passage c270 that bypasses the aerosol generation chamber. Furthermore, the heating filament is electrically connected to electrical contacts c256 at the base of the aerosol generation chamber c280 through sealed apertures, which prevents air ingress or fluid leakage therethrough. Therefore, such arrangement may reduce or eliminate leakage of excess aerosol precursor through the air inlet c272 at the first end of the housing.

In some other embodiments, the base of aerosol generation chamber may permit only an insignificant amount of air to ingress into the aerosol generation chamber, e.g., through a gap or an aperture formed at said base. In the illustrated embodiment, as shown in FIG. 33B, the air inlet c272 is positioned level with the base of the aerosol generation chamber c280, e.g., the base of the aerosol generation chamber c280 also forms the base of the housing. In other embodiments, the base of the aerosol generation chamber may not be positioned level with the air inlet. For example, the base of aerosol generation chamber may recede into, or protrude out of, the first end of the housing.

At the downstream end of the aerosol generation chamber c280 there is provided the chamber outlet c282 that serves as the only opening to the interior of the aerosol generation chamber c280 that allows gas flow passage. More specifically, the chamber outlet c282 opens downstream of the heater in the direction of aerosol flow, and forms the only aperture in the aerosol generation chamber c280 that provides gas flow passage to the internal volume of the chamber. The chamber outlet c282 is opened substantially in the direction of air flow passing through the channel c270, e.g., the aerosol and the air flow flows in a concurrent direction. Such arrangement reduces the amount of air flow that may enter the aerosol generation chamber c280. In some embodiments, a plurality of chamber outlets c282 are opened at the aerosol generation chamber c280 each positioned downstream of the heater in the direction of aerosol flow.

The vaporized aerosol precursor, or aerosol in the condensed form, may discharge from the aerosol generation chamber c280 based on pressure difference between the aerosol generation chamber c280 and the passage c270. Such pressure difference may arise form i) an increased pressure in the aerosol generation chamber c280 during vaporization of aerosol form, and/or ii) a reduced pressure in the passage during a puff.

In the illustrated embodiment, the heater is positioned adjacent to the chamber outlet and therefore that the path of aerosol c414 from the heater to the chamber outlet c282 is shortened. This may allow aerosol to be entrained into the air flow more efficiently. In some other embodiments, the heater may be positioned further into the aerosol generation chamber c280, e.g., it is spaced from the chamber outlet c282, in order to reduce the amount of turbulence in the vicinity of the heater.

Referring to FIGS. 33A and 33B, the passage c270 further comprises a flow converging portion c284 downstream of the chamber outlet c282. In the illustrated embodiment, the flow converging portion c284 comprises a funnel or a tapered section for gradually merging the aerosol and the air flow. For example, the flow converging portion c284 may resemble an extractor hood where suction of a user puff may draw in aerosol from the aerosol generation chamber c280 and an air flow through the passage c270. Such arrangement may help minimizing the turbulence when the two streams are merged and thereby it may allow aerosol to be formed with larger droplet sizes. During the user puff, the aerosol is discharged with the air flow along the passage c270 and through the outlet c274.

With the absence of, or much reduced, air flow in the aerosol generation chamber, the aerosol as generated by the illustrated embodiment has a droplet size $d_{50}$ of at least 1 μm. Preferably, the aerosol as generated by the illustrated embodiment has a droplet size $d_{50}$ ranging from 2 μm to 3 μm.

Figure 34A:
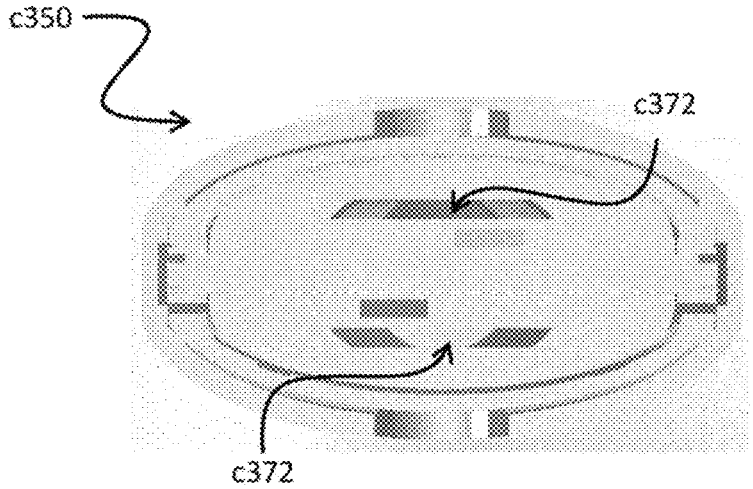
FIG. 34A is a plan view of a base of a smoking substitute apparatus of a second embodiment of Development C.
Figure 34B:
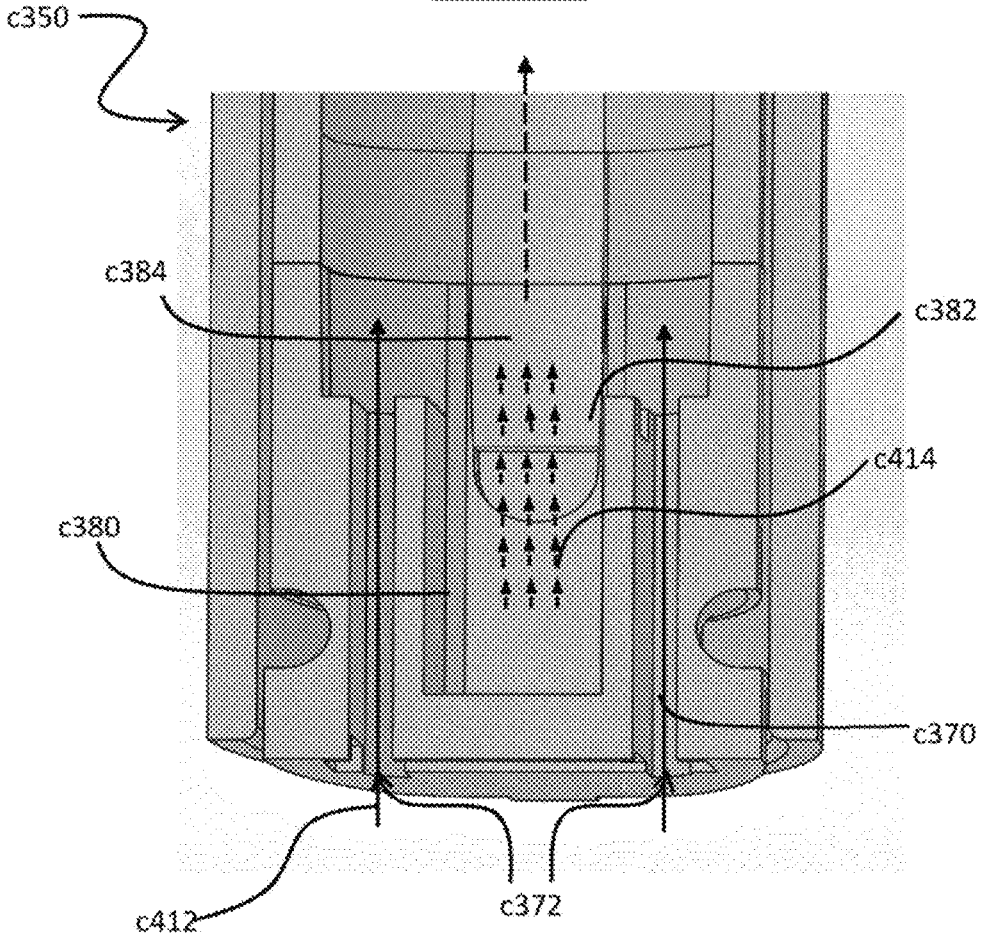
FIG. 34B is an enlarged schematic perspective cross sectional view of the smoking substitute apparatus of the second embodiment of Development C.

FIGS. 34A and 34B respectively illustrates a plan view and a perspective cross sectional view of a consumable c350 according to a second embodiment of the present disclosure. In order to illustrate the internal structure of the consumable c350 more clearly, the heater and its electrical connections are not shown but are nevertheless present. The consumable c350 comprises a pair of air flow inlets c372 that open across the base of consumable c350. The air flow inlets c372 each leads to a respective passage c370 that extend along the external sidewalls of the aerosol generation chamber c380. In this embodiment, the passages c370 do not form an annulus but instead the passages c370 are two discrete passages c370 provided on either side of the aerosol generation chamber. In other words, the aerosol generation chamber c380 is separated from the passages c370 by a pair of partition walls, or side walls of aerosol generation chamber c380. Such arrangement may allow a more compact apparatus to be formed. The passages c370 merge into a single passage c370 once the passages c370 have extended beyond the chamber outlet c382. That is, a flow converging portion c384 is provided in the passage immediately downstream of the chamber outlet c382. The flow converging portion c384 in the illustrated embodiment does not comprise a tapering section. Instead, the flow converging portion c384 comprises an enlarged chamber. That is, as the air flow and aerosol progress along their respective flow paths c412, c414, the combined cross sectional area increases as they converge downstream of the chamber outlet c382.

The experiments reported below have relevance to the embodiments disclosed above in particular in view of the "stagnant chamber" configuration used for the vaporization chamber, the experiments showing that control over the flow conditions at the wick lead to control over the particle size of the aerosol.

EXAMPLES

There now follows a disclosure of certain examples of experimental work undertaken to determine the effects of certain conditions in the smoking substitute apparatus on the particle size of the generated aerosol. However, the present disclosure is to be understood to not be limited in its application to the specific experimentation, results, and laboratory procedures disclosed herein after. Rather, the Examples are simply provided as one of various embodiments and are meant to be exemplary, not exhaustive.

Introduction

Aerosol droplet size is a considered to be an important characteristic for smoking substitution devices. Droplets in the range of 2-5 μm are preferred in order to achieve improved nicotine delivery efficiency and to minimize the hazard of second-hand smoking. However, at the time of writing (September 2019), commercial EVP devices typically deliver aerosols with droplet size averaged around 0.5 μm, and to the knowledge of the inventors not a single commercially available device can deliver an aerosol with an average particle size exceeding 1 μm.

The present inventors speculate, without themselves wishing to be bound by theory, that there has to date been a lack of understanding in the mechanisms of e-liquid evaporation, nucleation and droplet growth in the context of aerosol generation in smoking substitute devices. The present inventors have therefore studied these issues in order to provide insight into mechanisms for the generation of aerosols with larger particles. The present inventors have carried out experimental and modelling work alongside theoretical investigations, leading to significant achievements as now reported.

This disclosure considers the roles of air velocity, air turbulence and vapor cooling rate in affecting aerosol particle size.

Experiments

In the following examples, a Malvern PANalytical Spraytec laser diffraction system was employed for the particle size measurement. In order to limit the number of variables, the same coil and wick (1.5 ohms Ni—Cr coil, 1.8 mm Y07 cotton wick), the same e-liquid (1.6% freebase nicotine, 65:35 propylene glycol (PG)/vegetable glycerin (VG) ratio, no added flavor) and the same input power (10 W) were used in all experiments. Y07 represents the grade of cotton wick, meaning that the cotton has a linear density of 0.7 grams per meter.

Particle sizes were measured in accordance with ISO 13320:2009(E), which is an international standard on laser diffraction methods for particle size analysis. This is particularly well suited to aerosols, because there is an assumption in this standard that the particles are spherical (which is a good assumption for liquid-based aerosols). The standard is stated to be suitable for particle sizes in the range 0.1 micron to 3 mm.

The results presented here concentrate on the volume-based median particle size Dv50. This is to be taken to be the same as the parameter $d_{50}$ used above.

First Example: Rectangular Tube Testing

Figure 1:
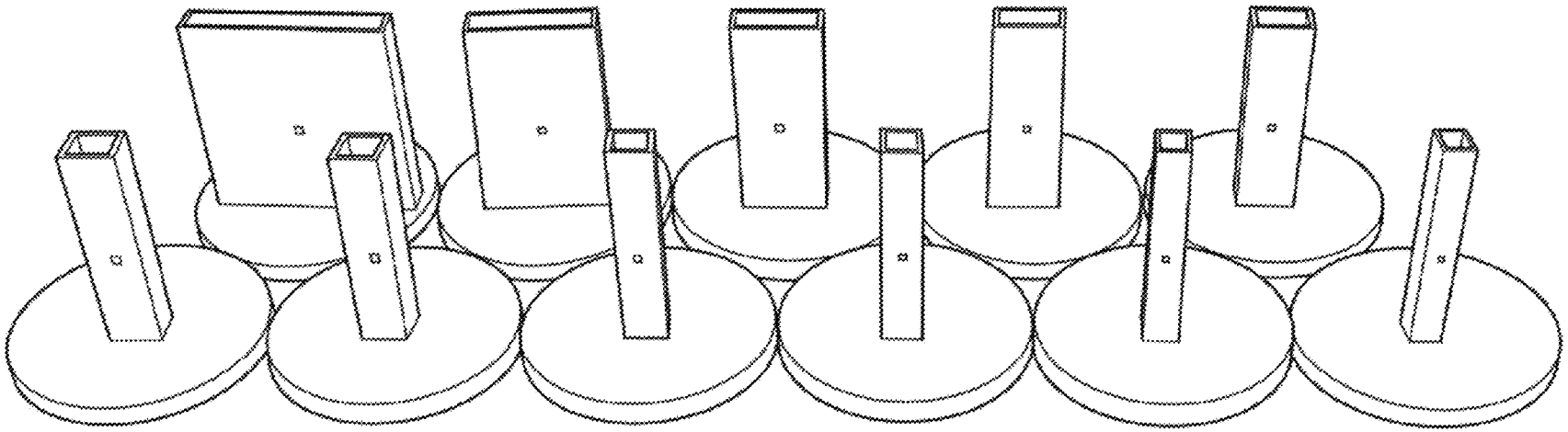
FIG. 1 illustrates a set of rectangular tubes for use in experiments to assess the effect of flow and cooling conditions at the wick on aerosol properties. Each tube has the same depth and length but different width.

The work of a first example reported here based on the inventors' insight that aerosol particle size might be related to: 1) air velocity; 2) flow rate; and 3) Reynolds number. In a given EVP device, these three parameters are inter-linked to each other, making it difficult to draw conclusions on the roles of each individual factor. In order to decouple these factors, experiments of a first example were carried out using a set of rectangular tubes having different dimensions. These were manufactured by 3D printing. The rectangular tubes were 3D printed in an MJP 2500 3D printer. FIG. 1 illustrates the set of rectangular tubes. Each tube has the same depth and length but different width. Each tube has an integral end plate in order to provide a seal against air flow outside the tube. Each tube also has holes formed in opposing side walls in order to accommodate a wick.

Figure 2:
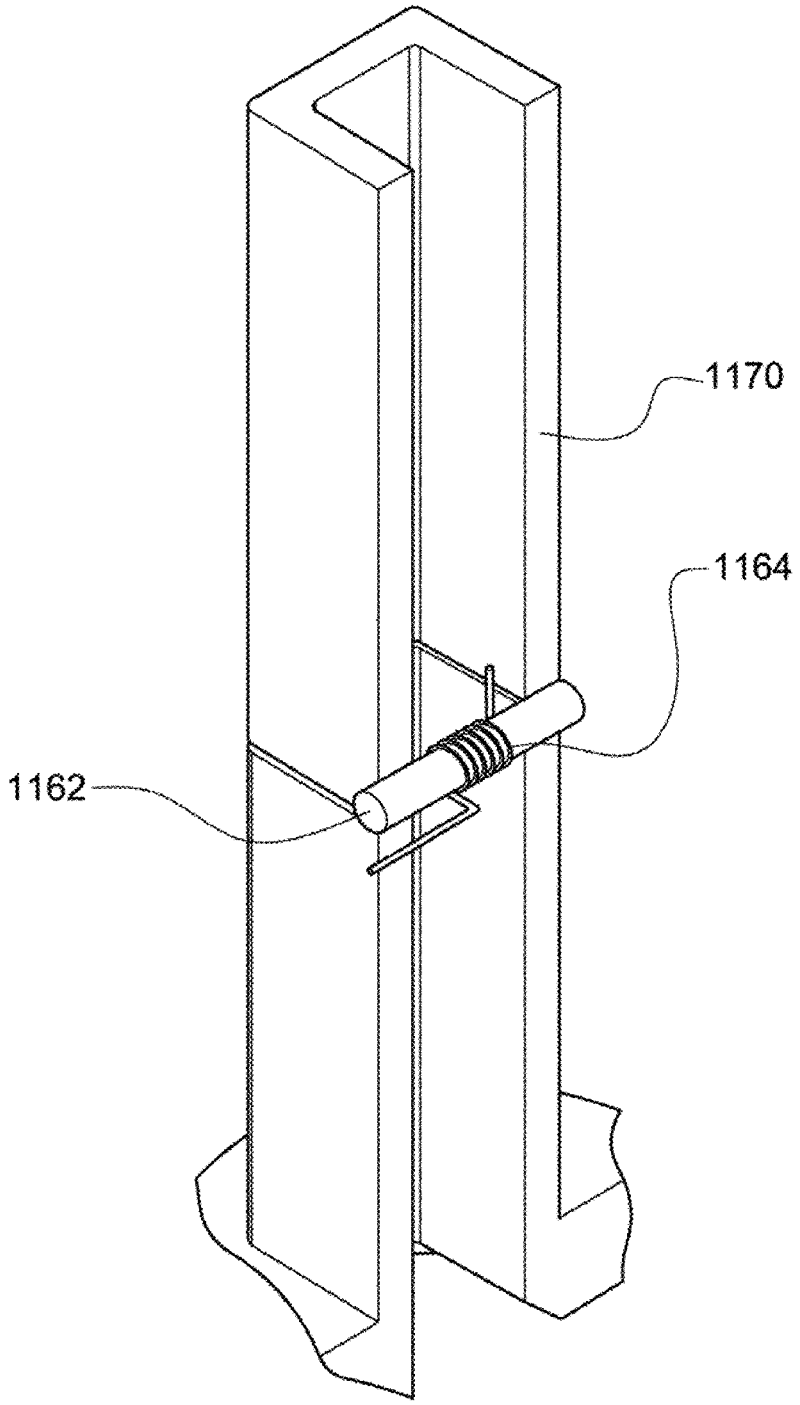
FIG. 2 shows a schematic perspective longitudinal cross sectional view of an example rectangular tube with a wick and heater coil installed.

FIG. 2 shows a schematic perspective longitudinal cross sectional view of an example rectangular tube 1170 with a wick 1162 and heater coil 1164 installed. The location of the wick is about half way along the length of the tube. This is intended to allow the flow of air along the tube to settle before reaching the wick.

Figure 3:
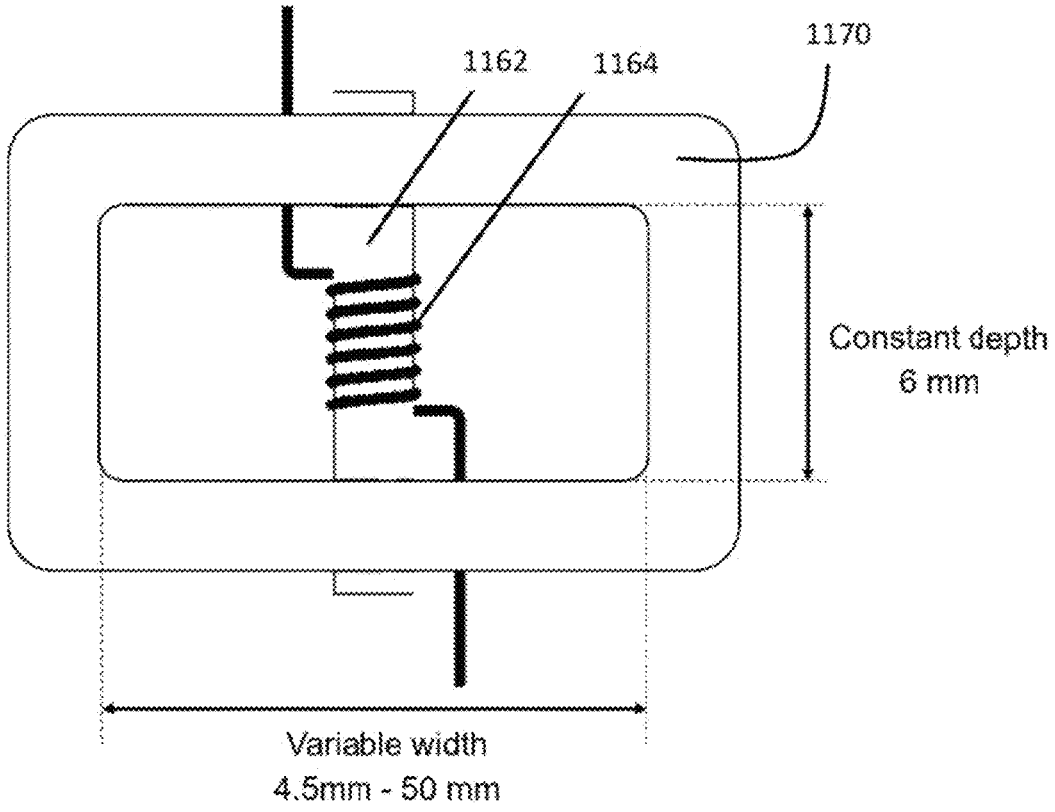
FIG. 3 shows a schematic transverse cross sectional view an example rectangular tube with a wick and heater coil installed. In this example, the internal width of the tube is 12 mm.

FIG. 3 shows a schematic transverse cross sectional view an example rectangular tube 1170 with a wick 1162 and heater coil 1164 installed. In this example, the internal width of the tube is 12 mm.

The rectangular tubes were manufactured to have same internal depth of 6 mm in order to accommodate the standardized coil and wick, however the tube internal width varied from 4.5 mm to 50 mm. In this disclosure, the "tube size" is referred to as the internal width of rectangular tubes.

The rectangular tubes with different dimensions were used to generate aerosols that were tested for particle size in a Malvern PANalytical Spraytec laser diffraction system. An external digital power supply was dialed to 2.6 A constant current to supply 10 W power to the heater coil in all experiments. Between two runs, the wick was saturated manually by applying one drop of e-liquid on each side of the wick.

Three groups of experiments were carried out in this study of a first example:

1. 1.3 lpm (liters per minute, L $min^{-1}$ or LPM) constant flow rate on different size tubes
2. 2.0 lpm constant flow rate on different size tubes
3. 1 m/s constant air velocity on 3 tubes: i) 5 mm tube at 1.4 lpm flow rate; ii) 8 mm tube at 2.8 lpm flow rate; and iii) 20 mm tube at 8.6 lpm flow rate.

Table 1 shows a list of experiments of a first example. The values in "calculated air velocity" column were obtained by simply dividing the flow rate by the intersection area at the center plane of wick. Reynolds numbers (Re) were calculated through the following equation:

$$Re = \frac{\rho v L}{\mu},$$

where: ρ is the density of air (1.225 kg/$m^3$); ν is the calculated air velocity in table 1; μ is the viscosity of air ($1.48\times10^{-5}$ $m^2$/s); L is the characteristic length calculated by:

$$L = \frac{4P}{A}$$

where: P is the perimeter of the flow path's intersection, and A is the area of the flow path's intersection.

TABLE 1

List of experiments in the rectangular tube study

| | Tube size [mm] | Flow rate [lpm] | Reynolds number | Calculated air velocity [m/s] |
|---|---|---|---|---|
| 1.3 lpm | 4.5 | 1.3 | 153 | 1.17 |
| | 6 | 1.3 | 142 | 0.71 |
| constant | 7 | 1.3 | 136 | 0.56 |
| flow rate | 8 | 1.3 | 130 | 0.47 |
| | 10 | 1.3 | 120 | 0.35 |
| | 12 | 1.3 | 111 | 0.28 |
| | 20 | 1.3 | 86 | 0.15 |
| | 50 | 1.3 | 47 | 0.06 |
| 2.0 lpm | 4.5 | 2.0 | 236 | 1.81 |
| constant | 5 | 2.0 | 230 | 1.48 |
| flow rate | 6 | 2.0 | 219 | 1.09 |
| | 8 | 2.0 | 200 | 0.72 |
| | 12 | 2.0 | 171 | 0.42 |
| | 20 | 2.0 | 132 | 0.23 |
| | 50 | 2.0 | 72 | 0.09 |
| 1.0 m/s | 5.0 | 1.4 | 155 | 1.00 |
| constant air | 8 | 2.8 | 279 | 1.00 |
| velocity | 20 | 8.6 | 566 | 1.00 |

Five repetition runs were carried out for each tube size and flow rate combination. Between adjacent runs there were at least 5 minutes wait time for the Spraytec system to be purged. In each run, real time particle size distributions were measured in the Spraytec laser diffraction system at a sampling rate of 2500 per second, the volume distribution median (Dv50) was averaged over a puff duration of 4 seconds. Measurement results were averaged and the standard deviations were calculated to indicate errors as shown in section 4 below.

Second Example: Turbulence Tube Testing

The Reynolds numbers in Table 1 are all well below 1000, therefore, it is considered fair to assume all the experiments of a first example would be under conditions of laminar flow. Further experiments (of a second example) were carried out and reported in this section to investigate the role of turbulence.

Turbulence intensity was introduced as a quantitative parameter to assess the level of turbulence. The definition and simulation of turbulence intensity is discussed below.

Different device designs were considered in order to introduce turbulence. In the experiments of the second example reported here, jetting panels were added in the existing 12 mm rectangular tubes upstream of the wick. This approach enables direct comparison between different devices as they all have highly similar geometry, with turbulence intensity being the only variable.

Figure 4A:
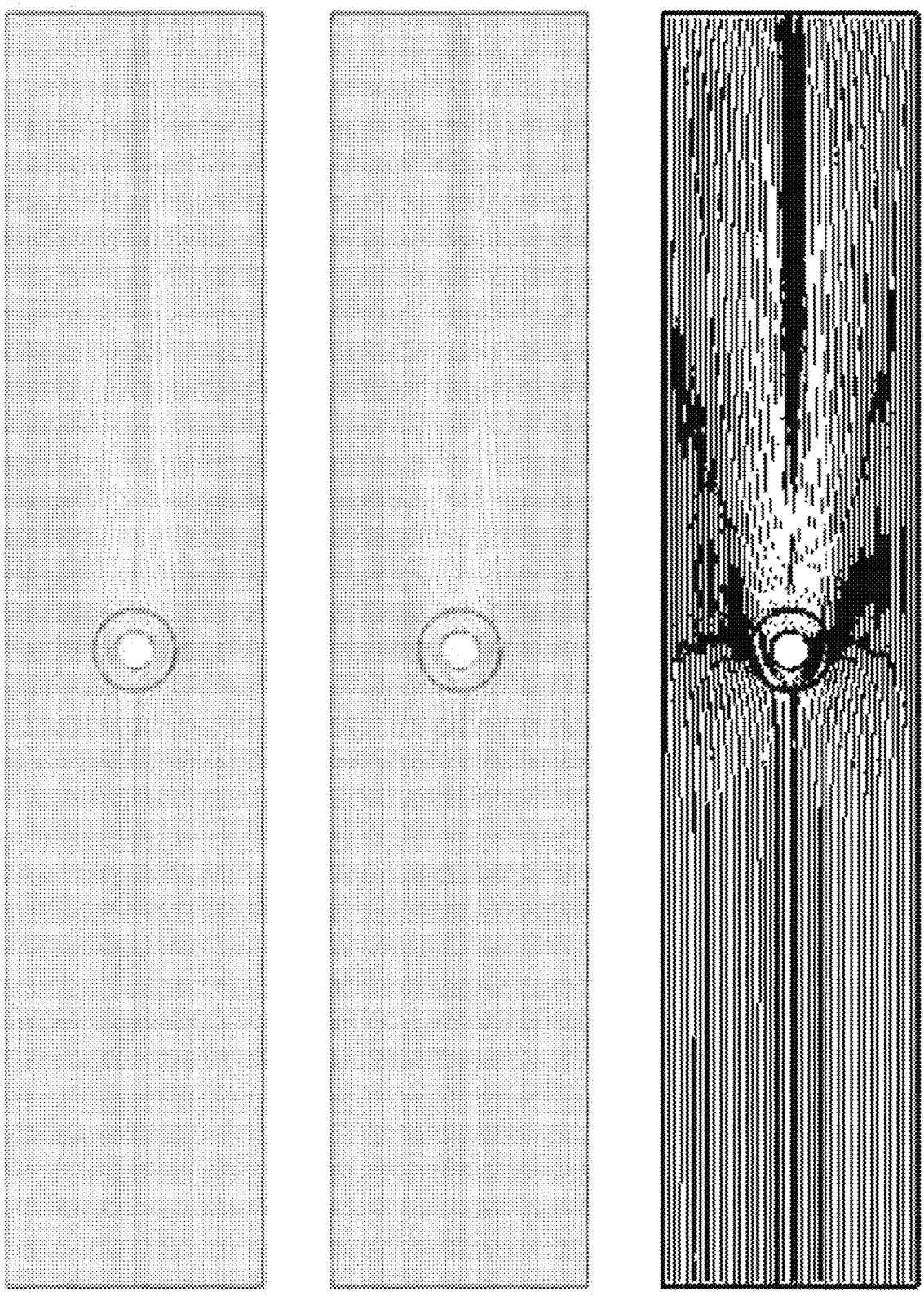
FIGS. 4A-4D show air flow streamlines in the four devices used in a turbulence study.
Figure 4B:
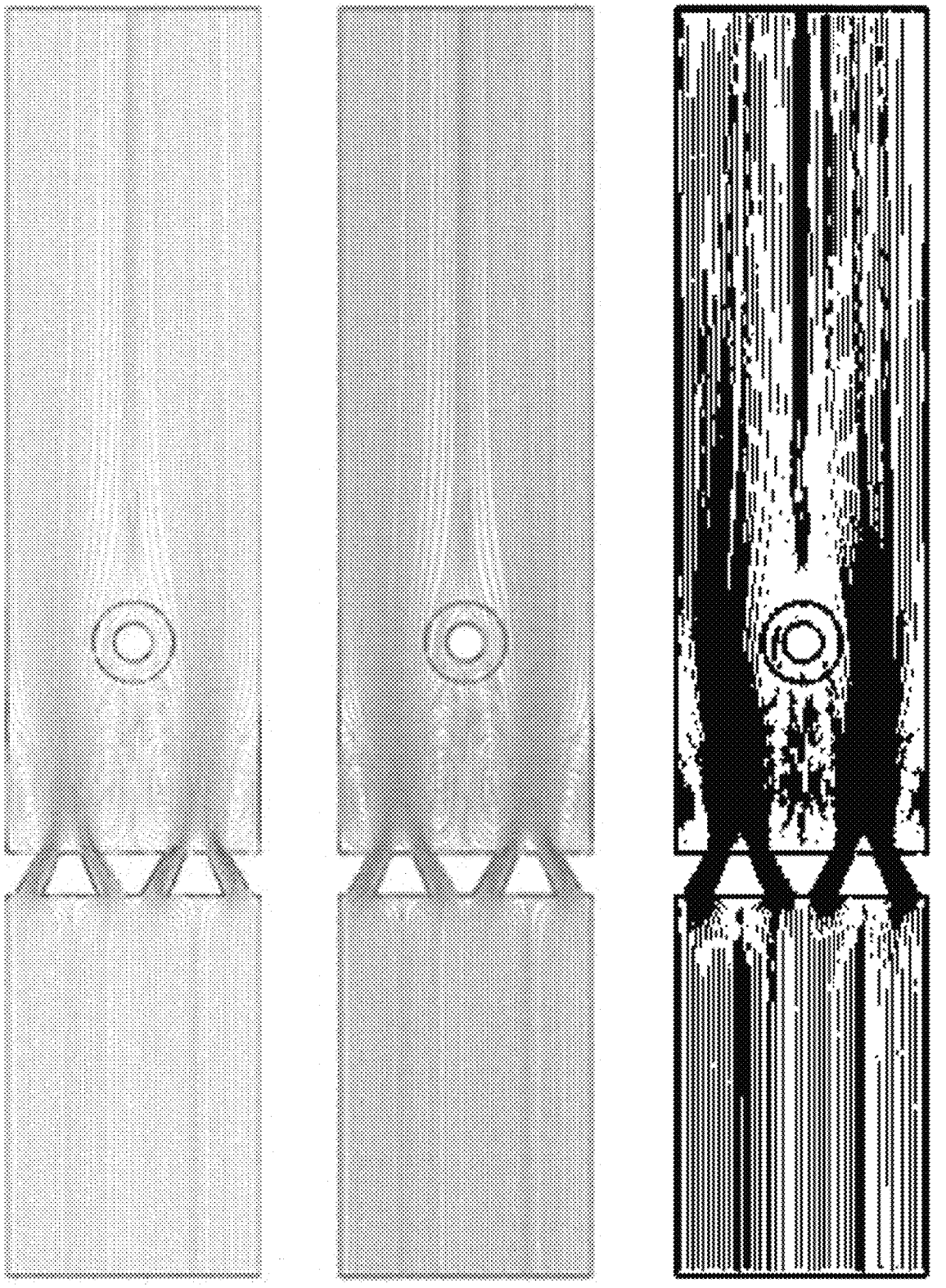
Figure 4C:
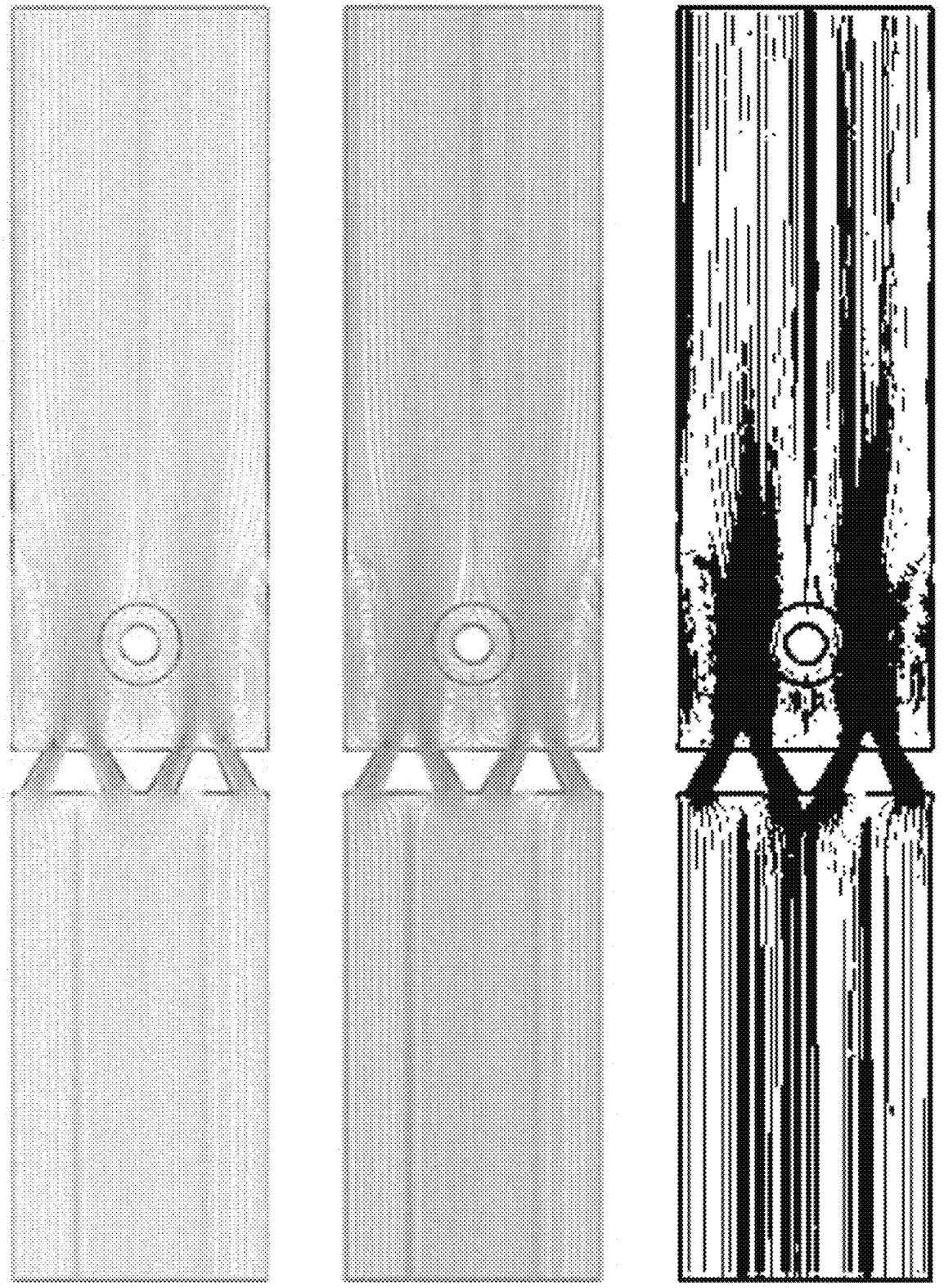
Figure 4D:
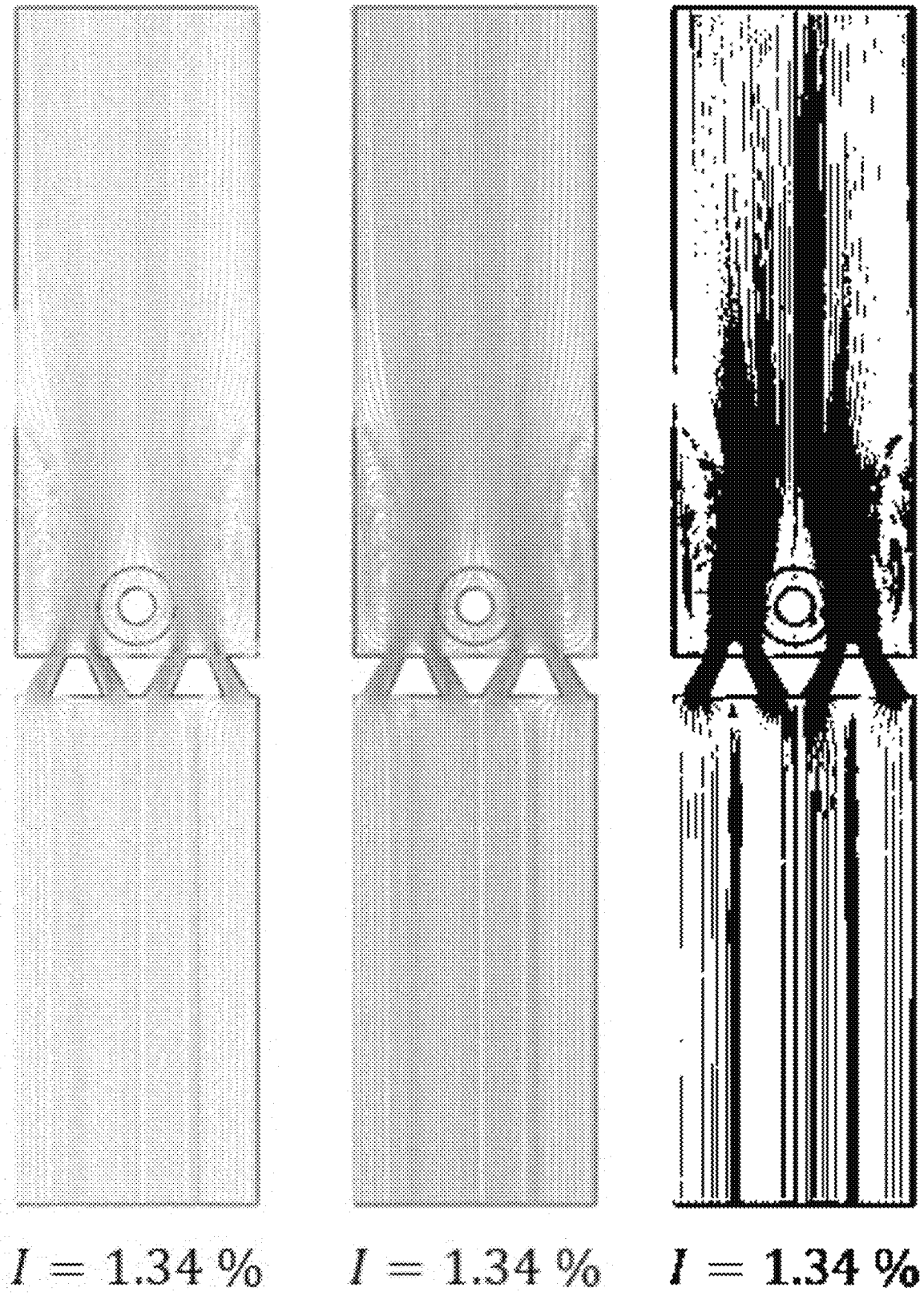

FIGS. 4A-4D show air flow streamlines in the four devices used in this turbulence study of the second example. FIG. 4A is a standard 12 mm rectangular tube with wick and coil installed as explained previously, with no jetting panel. FIG. 4B has a jetting panel located 10 mm below (upstream from) the wick. FIG. 4C has the same jetting panel 5 mm below the wick. FIG. 4D has the same jetting panel 2.5 mm below the wick. As can be seen from FIGS. 4B-4D, the jetting panel has an arrangement of apertures shaped and directed in order to promote jetting from the downstream face of the panel and therefore to promote turbulent flow. Accordingly, the jetting panel can introduce turbulence downstream, and the panel causes higher level of turbulence near the wick when it is positioned closer to the wick. As shown in FIGS. 4A-4D, the four geometries gave turbulence intensities of 0.55%, 0.77%, 1.06% and 1.34%, respectively, with FIG. 4A being the least turbulent, and FIG. 4D being the most turbulent.

For each of FIGS. 4A-4D, there are shown three modelling images. The image on the left shows the original image (color in the original), the central image shows a greyscale version of the image and the right hand image shows a black and white version of the image. As will be appreciated, each version of the image highlights slightly different features of the flow. Together, they give a reasonable picture of the flow conditions at the wick.

These four devices were operated to generate aerosols following the procedure explained above (the first example) using a flow rate of 1.3 lpm and the generated aerosols were tested for particle size in the Spraytec laser diffraction system.

Third Example: High Temperature Testing

This experiment of a third example aimed to investigate the influence of inflow air temperature on aerosol particle size, in order to investigate the effect of vapor cooling rate on aerosol generation.

Figure 5:
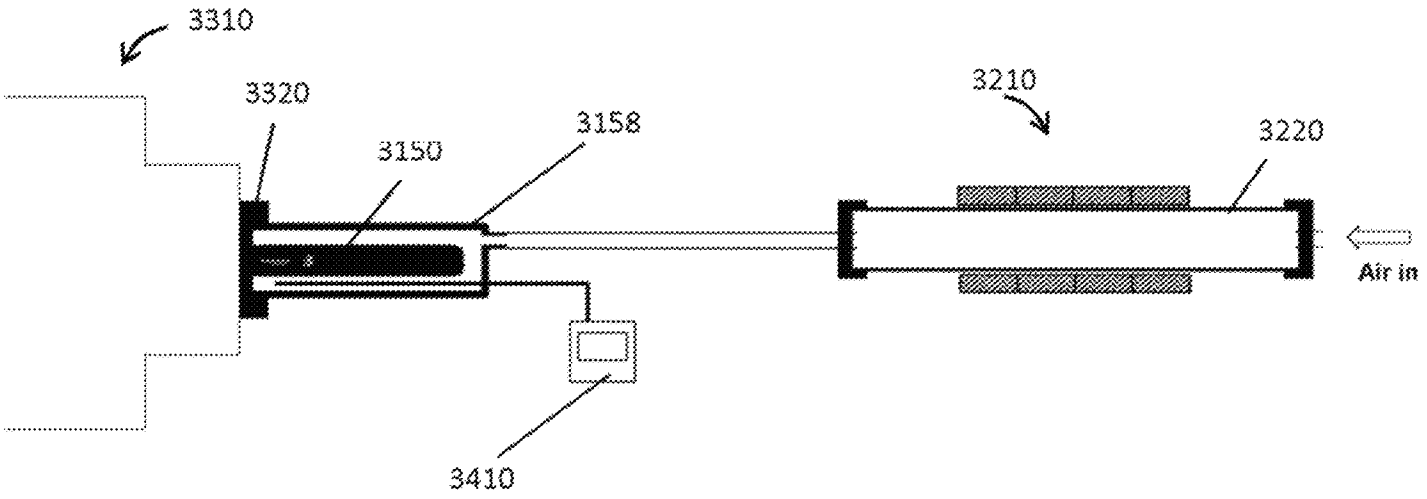
FIG. 5 shows the experimental set up to investigate the influence of inflow air temperature on aerosol particle size, in order to investigate the effect of vapor cooling rate on aerosol generation.

The experimental set up of the third example is shown in FIG. 5. The testing used a Carbolite Gero EHA 12300B tube furnace 3210 with a quartz tube 3220 to heat up the air. Hot air in the tube furnace was then led into a transparent housing 3158 that contains the EVP device 3150 to be tested. A thermocouple meter 3410 was used to assess the temperature of the air pulled into the EVP device. Once the EVP device was activated, the aerosol was pulled into the Spraytec laser diffraction system 3310 via a silicone connector 3320 for particle size measurement.

Figure 7:
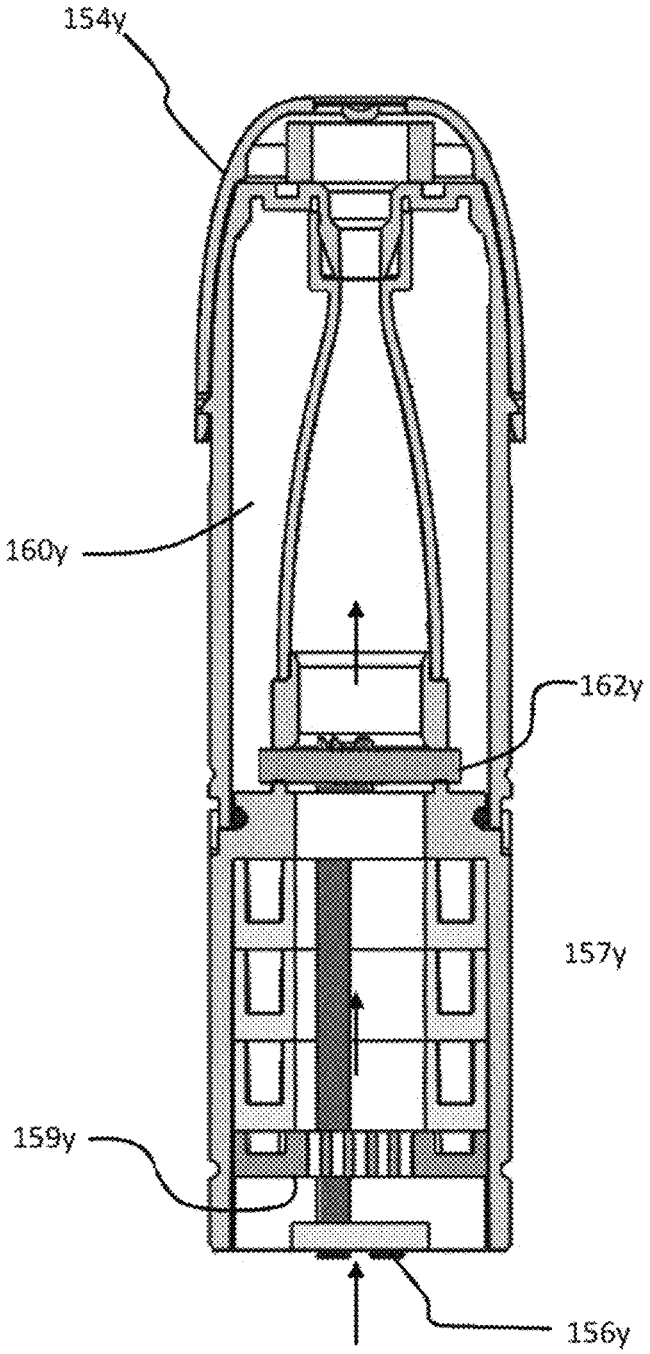
FIG. 7 shows a schematic longitudinal cross sectional view of a second smoking substitute apparatus (pod 2) used to assess influence of inflow air temperature on aerosol particle size.
Figure 8A:
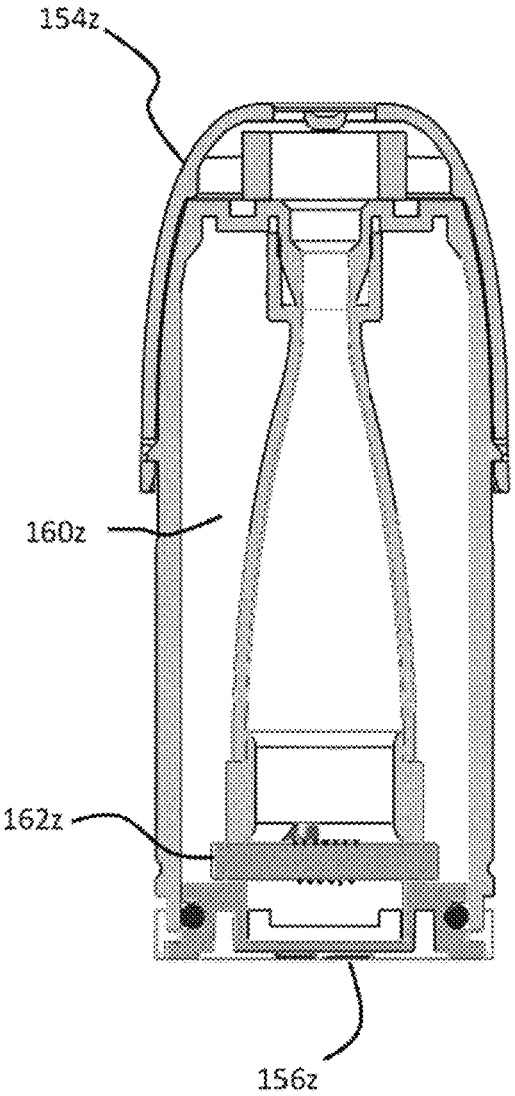
FIG. 8A shows a schematic longitudinal cross sectional view of a third smoking substitute apparatus (pod 3) used to assess influence of inflow air temperature on aerosol particle size.
Figure 8B:
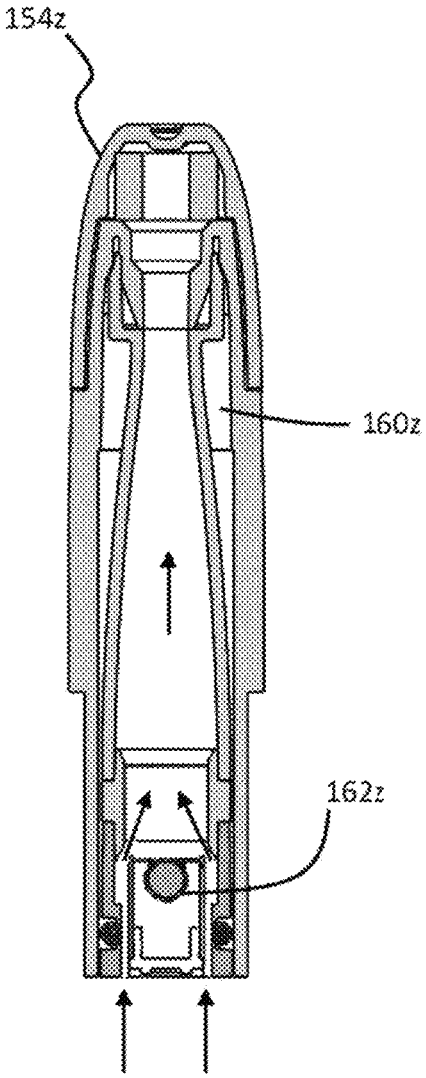
FIG. 8B shows a schematic longitudinal cross sectional view of the same third smoking substitute apparatus (pod 3) in a direction orthogonal to the view taken in FIG. 8A.

Three smoking substitute apparatuses (referred to as "pods") were tested in the study: pod 1 is the commercially available "myblu optimised" pod (FIG. 6); pod 2 is a pod featuring an extended inflow path upstream of the wick (FIG. 7); and pod 3 is pod with the wick located in a stagnant vaporization chamber and the inlet air bypassing the vaporization chamber but entraining the vapor from an outlet of the vaporization chamber (FIGS. 8A and 8B).

Figure 6:
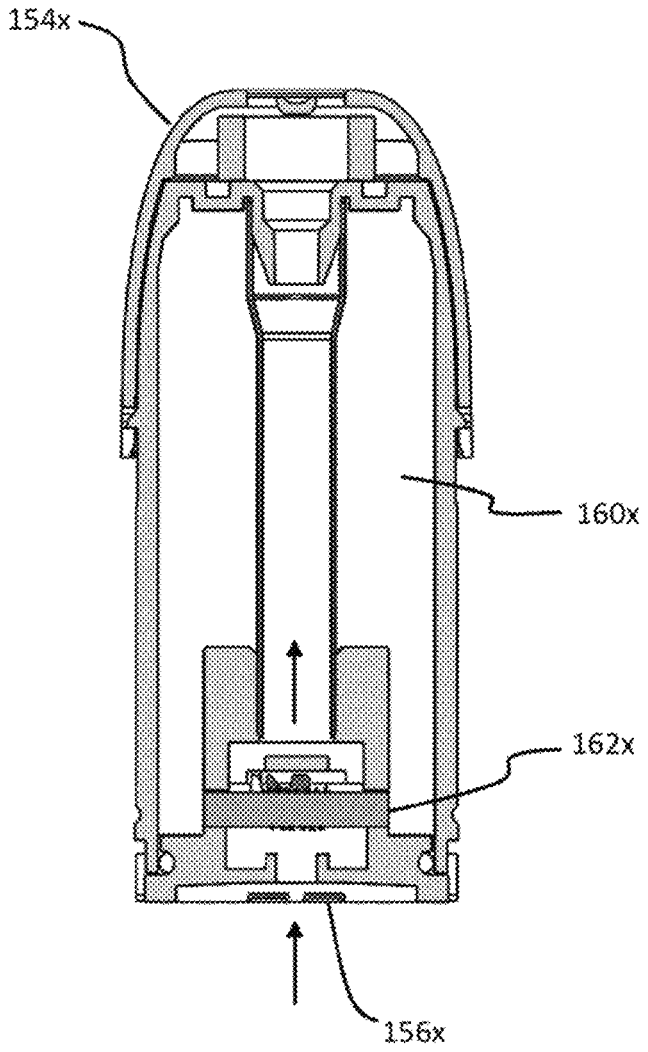
FIG. 6 shows a schematic longitudinal cross sectional view of a first smoking substitute apparatus (pod 1) used to assess influence of inflow air temperature on aerosol particle size.

Pod 1, shown in longitudinal cross sectional view (in the width plane) in FIG. 6, has a main housing that defines a tank 160*x* holding an e-liquid aerosol precursor. Mouthpiece 154*x* is formed at the upper part of the pod. Electrical contacts 156*x* are formed at the lower end of the pod. Wick 162*x* is held in a vaporization chamber. The air flow direction is shown using arrows.

Pod 2, shown in longitudinal cross sectional view (in the width plane) in FIG. 7, has a main housing that defines a tank 160*y* holding an e-liquid aerosol precursor. Mouthpiece 154*y* is formed at the upper part of the pod. Electrical contacts 156*y* are formed at the lower end of the pod. Wick 162*y* is held in a vaporization chamber. The air flow direction is shown using arrows. Pod 2 has an extended inflow path (plenum chamber 157*y*) with a flow conditioning element 159*y*, configured to promote reduced turbulence at the wick 162*y*.

FIG. 8A shows a schematic longitudinal cross sectional view of pod 3. FIG. 8B shows a schematic longitudinal cross sectional view of the same pod 3 in a direction orthogonal to the view taken in FIG. 8A. Pod 3 has a main housing that defines a tank 160*z* holding an e-liquid aerosol precursor. Mouthpiece 154*z* is formed at the upper part of the pod. Electrical contacts 156*z* are formed at the lower end of the pod. Wick 162*z* is held in a vaporization chamber. The air flow direction is shown using arrows. Pod 3 uses a stagnant vaporizer chamber, with the air inlets bypassing the wick and picking up the vapor/aerosol downstream of the wick.

All three pods were filled with the same e-liquid (1.6% freebase nicotine, 65:35 PG/VG ratio, no added flavor). Three experiments of the third example were carried out for each pod: 1) standard measurement in ambient temperature; 2) only the inlet air was heated to 50° C.; and 3) both the inlet air and the pods were heated to 50° C. Five repetition runs were carried out for each experiment and the Dv50 results were taken and averaged.

Modelling Work

In the following examples, modelling work was performed using COMSOL Multiphysics 5.4, engaged physics include: 1) laminar single-phase flow; 2) turbulent single-phase flow; 3) laminar two-phase flow; 4) heat transfer in fluids; and (5) particle tracing. Data analysis and data visualization were mostly completed in MATLAB R2019a.

Fourth Example: Velocity Modelling

Air velocity in the vicinity of the wick is believed to play an important role in affecting particle size. In the first example, the air velocity was calculated by dividing the flow rate by the intersection area, which is referred to as "calculated velocity" in a fourth example. This involves a very crude simplification that assumes velocity distribution to be homogeneous across the intersection area.

In order to increase reliability of the fourth example, computational fluid dynamics (CFD) modelling was performed to obtain more accurate velocity values:

1) The average velocity in the vicinity of the wick (defined as a volume from the wick surface to 1 mm away from the wick surface)
2) The maximum velocity in the vicinity of the wick (defined as a volume from the wick surface to 1 mm away from the wick surface)

TABLE 2

Average and maximum velocity in the vicinity of wick surface obtained from CFD modelling.

| | Tube size [mm] | Flow rate [lpm] | Calculated velocity* [m/s] | Average velocity** [m/s] | Maximum Velocity** [m/s] |
|---|---|---|---|---|---|
| 1.3 lpm constant flow rate | 4.5 | 1.3 | 1.17 | 0.99 | 1.80 |
| | 6 | 1.3 | 0.71 | 0.66 | 1.22 |
| | 7 | 1.3 | 0.56 | 0.54 | 1.01 |
| | 8 | 1.3 | 0.47 | 0.46 | 0.86 |
| | 10 | 1.3 | 0.35 | 0.35 | 0.66 |
| | 12 | 1.3 | 0.28 | 0.27 | 0.54 |
| | 20 | 1.3 | 0.15 | 0.15 | 0.32 |
| | 50 | 1.3 | 0.06 | 0.05 | 0.12 |
| 2.0 lpm constant flow rate | 4.5 | 2.0 | 1.81 | 1.52 | 2.73 |
| | 5 | 2.0 | 1.48 | 1.31 | 2.39 |
| | 6 | 2.0 | 1.09 | 1.02 | 1.87 |
| | 8 | 2.0 | 0.72 | 0.71 | 1.31 |
| | 12 | 2.0 | 0.42 | 0.44 | 0.83 |
| | 20 | 2.0 | 0.23 | 0.24 | 0.49 |
| | 50 | 2.0 | 0.09 | 0.08 | 0.19 |

*Calculated by dividing flow rate with intersection area
**Obtained from CFD modelling The CFD model uses a laminar single-phase flow setup. For each experiment, the outlet was configured to a corresponding flowrate, the inlet was configured to be pressure-controlled, the wall conditions were set as "no slip". A 1 mm wide ring-shaped domain (wick vicinity) was created around the wick surface, and domain probes were implemented to assess the average and maximum magnitudes of velocity in this ring-shaped wick vicinity domain.

The CFD model of the fourth example outputs the average velocity and maximum velocity in the vicinity of the wick for each set of experiments carried out in the first example. The outcomes are reported in Table 2.

Fifth Example: Turbulence Modelling

Turbulence intensity (I) is a quantitative value that represents the level of turbulence in a fluid flow system. It is defined as the ratio between the root-mean-square of velocity fluctuations, u', and the Reynolds-averaged mean flow velocity, U:

$$I = \frac{u'}{U} = \frac{\sqrt{\frac{1}{3}(u'^2_x + u'^2_y + u'^2_z)}}{\sqrt{\overline{u_x}^2 + \overline{u_y}^2 + \overline{u_z}^2}} = \frac{\sqrt{\frac{1}{3}[(u_x - \overline{u_x})^2 + (u_y - \overline{u_y})^2 + +(u_z - \overline{u_z})^2]}}{\sqrt{\overline{u_x}^2 + \overline{u_y}^2 + \overline{u_z}^2}},$$

where $u_x$, $u_y$ and $u_z$, are the x-, y- and z-components of the velocity vector, $\overline{u_x}$, $\overline{u_y}$, and $\overline{u_z}$ represent the average velocities along three directions.

Higher turbulence intensity values represent higher levels of turbulence. As a rule of thumb, turbulence intensity below 1% represents a low-turbulence case, turbulence intensity between 1% and 5% represents a medium-turbulence case, and turbulence intensity above 5% represents a high-turbulence case.

In a fifth example, turbulence intensity was obtained from CFD simulation using turbulent single-phase setup in COMSOL Multiphysics. For each of the four experiments explained in the second example, above, the outlet was set to 1.3 lpm, the inlet was set to be pressure-controlled, and all wall conditions were set to be "no slip".

Turbulence intensity of the fifth example was assessed within the volume up to 1 mm away from the wick surface (defined as the wick vicinity domain). For the four experiments explained in the second example, the turbulence intensities are 0.55%, 0.77%, 1.06% and 1.34%, respectively, as also shown in FIGS. 4A-4D.

Sixth Example: Cooling Rate Modelling

The cooling rate modelling of the sixth example involves three coupling models in COMSOL Multiphysics: 1) laminar two-phase flow; 2) heat transfer in fluids, and 3) particle tracing. The model is setup in three steps:

(1) Set Up Two Phase Flow Model

Laminar mixture flow physics was selected for the sixth example. The outlet was configured in the same way as in the fourth example. However, this model of the sixth example includes two fluid phases released from two separate inlets: the first one is the vapor released from wick surface, at an initial velocity of 2.84 cm/s (calculated based on 5 mg total particulate mass over 3 seconds puff duration) with initial velocity direction normal to the wick surface; the second inlet is air influx from the base of tube, the rate of which is pressure-controlled.

(2) Set Up Two-Way Coupling with Heat Transfer Physics

The inflow and outflow settings in heat transfer physics was configured in the same way as in the two-phase flow model. The air inflow was set to 25° C., and the vapor inflow was set to 209° C. (boiling temperature of the e-liquid formulation). In the end, the heat transfer physics is configured to be two-way coupled with the laminar mixture flow physics. The above model reaches steady state after approximately 0.2 second with a step size of 0.001 second.

(3) Set Up Particle Tracing

A wave of 2000 particles were release from wick surface at t=0.3 second after the two-phase flow and heat transfer model has stabilized. The particle tracing physics has one-way coupling with the previous model, which means the fluid flow exerts dragging force on the particles, whereas the particles do not exert counterforce on the fluid flow. Therefore, the particles function as moving probes to output vapor temperature at each timestep.

The model of the sixth example outputs average vapor temperature at each time steps. A MATLAB script was then created to find the time step when the vapor cools to a target temperature (50° C. or 75° C.), based on which the vapor cooling rates were obtained (Table 3).

TABLE 3

Average vapor cooling rate obtained from Multiphysics modelling.

| | Tube size [mm] | Flow rate [lpm] | Cooling rate to 50° C. [° C./ms] | Cooling rate to 75° C. [° C./ms] |
|---|---|---|---|---|
| 1.3 lpm constant flow rate | 4.5 | 1.3 | 11.4 | 44.7 |
| | 6 | 1.3 | 5.48 | 14.9 |
| | 7 | 1.3 | 3.46 | 7.88 |
| | 8 | 1.3 | 2.24 | 5.15 |
| | 10 | 1.3 | 1.31 | 2.85 |
| | 12 | 1.3 | 0.841 | 1.81 |
| | 20 | 1.3 | 0* | 0.536 |
| | 50 | 1.3 | 0 | 0 |
| 2.0 lpm constant flow rate | 4.5 | 2.0 | 19.9 | 670 |
| | 5 | 2.0 | 13.3 | 67 |
| | 6 | 2.0 | 8.83 | 26.8 |
| | 8 | 2.0 | 3.61 | 8.93 |
| | 12 | 2.0 | 1.45 | 3.19 |
| | 20 | 2.0 | 0.395 | 0.761 |
| | 50 | 2.0 | 0 | 0 |

*Zero cooling rate when the average vapor temperature is still above target temperature after 0.5 second

Results and Discussions

Particle size measurement results for the rectangular tube testing example above (the first example) are shown in Table 4. For every tube size and flow rate combination, five repetition runs were carried out in the Spraytec laser diffraction system. The Dv50 values from five repetition runs were averaged, and the standard deviations were calculated to indicate errors, as shown in Table 4.

In this section, the roles of different factors affecting aerosol particle size will be discussed based on experimental and modelling results.

TABLE 4

Particle size measurement results for the rectangular tube testing.

| | Tube size [mm] | Flow rate [lpm] | Dv50 average [μm] | Dv50 standard deviation [μm] |
|---|---|---|---|---|
| 1.3 lpm constant flow rate | 4.5 | 1.3 | 0.971 | 0.125 |
| | 6 | 1.3 | 1.697 | 0.341 |
| | 7 | 1.3 | 2.570 | 0.237 |
| | 8 | 1.3 | 2.705 | 0.207 |
| | 10 | 1.3 | 2.783 | 0.184 |
| | 12 | 1.3 | 3.051 | 0.325 |
| | 20 | 1.3 | 3.116 | 0.354 |
| | 50 | 1.3 | 3.161 | 0.157 |
| 2.0 lpm constant flow rate | 4.5 | 2.0 | 0.568 | 0.039 |
| | 5 | 2.0 | 0.967 | 0.315 |
| | 6 | 2.0 | 1.541 | 0.272 |
| | 8 | 2.0 | 1.646 | 0.363 |
| | 12 | 2.0 | 3.062 | 0.153 |
| | 20 | 2.0 | 3.566 | 0.260 |
| | 50 | 2.0 | 3.082 | 0.440 |
| 1.0 m/s constant air velocity | 5.0 | 1.4 | 1.302 | 0.187 |
| | 8 | 2.8 | 1.303 | 0.468 |
| | 20 | 8.6 | 1.463 | 0.413 |

Seventh Example: Decouple the Factors Affecting Particle Size

Figure 9:
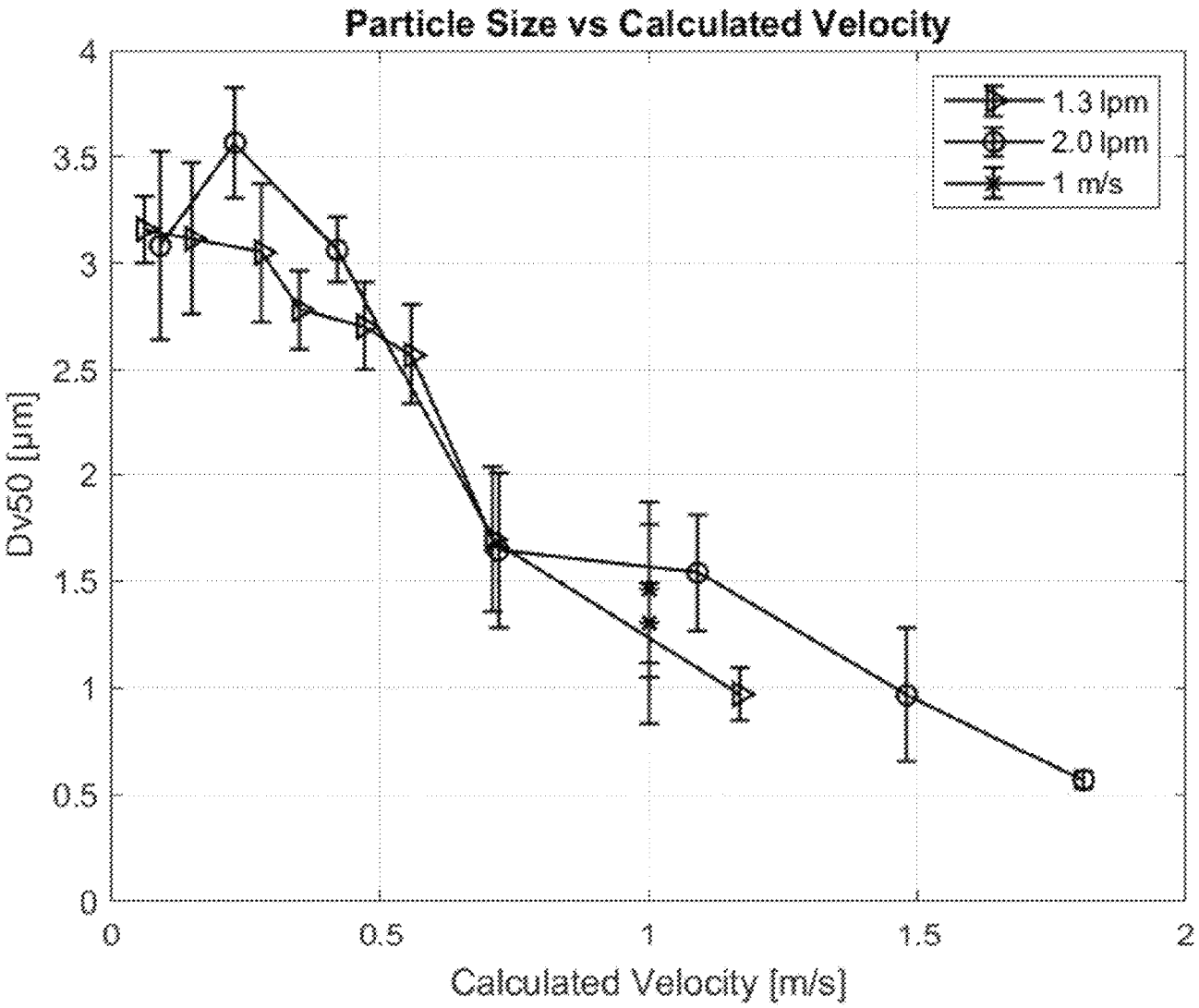
FIG. 9 shows a plot of aerosol particle size (Dv50) experimental results against calculated air velocity.

The particle size (Dv50) experimental results of a seventh example are plotted against calculated air velocity in FIG. 9. The graph shows a strong correlation between particle size and air velocity.

Different size tubes were tested at two flow rates: 1.3 lpm and 2.0 lpm. Both groups of data show the same trend that slower air velocity leads to larger particle size. The conclusion was made more convincing by the fact that these two groups of data overlap well in FIG. 9: for example, the 6 mm tube delivered an average Dv50 of 1.697 μm when tested at 1.3 lpm flow rate, and the 8 mm tube delivered a highly similar average Dv50 of 1.646 μm when tested at 2.0 lpm flow rate, as they have similar air velocity of 0.71 and 0.72 m/s, respectively.

Figure 10:
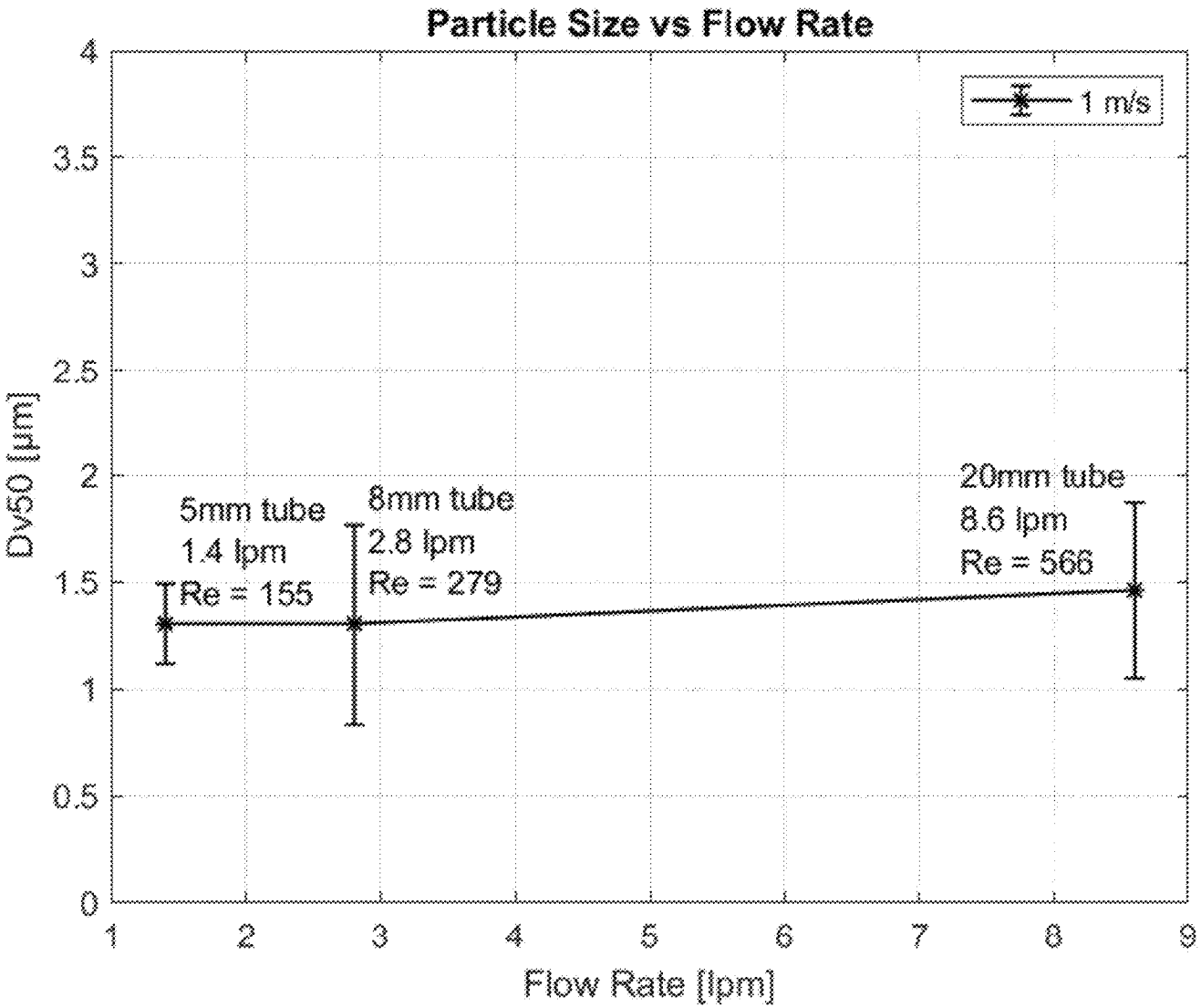
FIG. 10 shows a plot of aerosol particle size (Dv50) experimental results against the flow rate through the apparatus for a calculated air velocity of 1 m/s.

In addition, FIG. 10 shows the results of three experiments of the seventh example, with highly different setup arrangements: 1) 5 mm tube measured at 1.4 lpm flow rate with Reynolds number of 155; 2) 8 mm tube measured at 2.8 lpm flow rate with Reynolds number of 279; and 3) 20 mm tube measured at 8.6 lpm flow rate with Reynolds number of 566. It is relevant that these setup arrangements have one similarity: the air velocities are all calculated to be 1 m/s. FIG. 10 shows that, although these three sets of experiments have different tube sizes, flow rates and Reynolds numbers, they all delivered similar particle sizes, as the air velocity was kept constant. These three data points were also plotted out in FIG. 9 (1 m/s data with star marks) and they tie in nicely into particle size-air velocity trendline.

The above results of the seventh example lead to a strong conclusion that air velocity is an important factor affecting the particle size of EVP devices. Relatively large particles are generated when the air travels with slower velocity around the wick. It can also be concluded that flow rate, tube size and Reynolds number are not necessarily independently relevant to particle size, providing the air velocity is controlled in the vicinity of the wick.

Eighth Example: Further Consideration of Velocity

In FIG. 9 the "calculated velocity" was obtained by dividing the flow rate by the intersection area, which is a crude simplification that assumes a uniform velocity field. In order to increase reliability of the work, CFD modelling has been performed to assess the average and maximum velocities in the vicinity of the wick. In an eighth example, the "vicinity" was defined as a volume from the wick surface up to 1 mm away from the wick surface.

Figure 11:
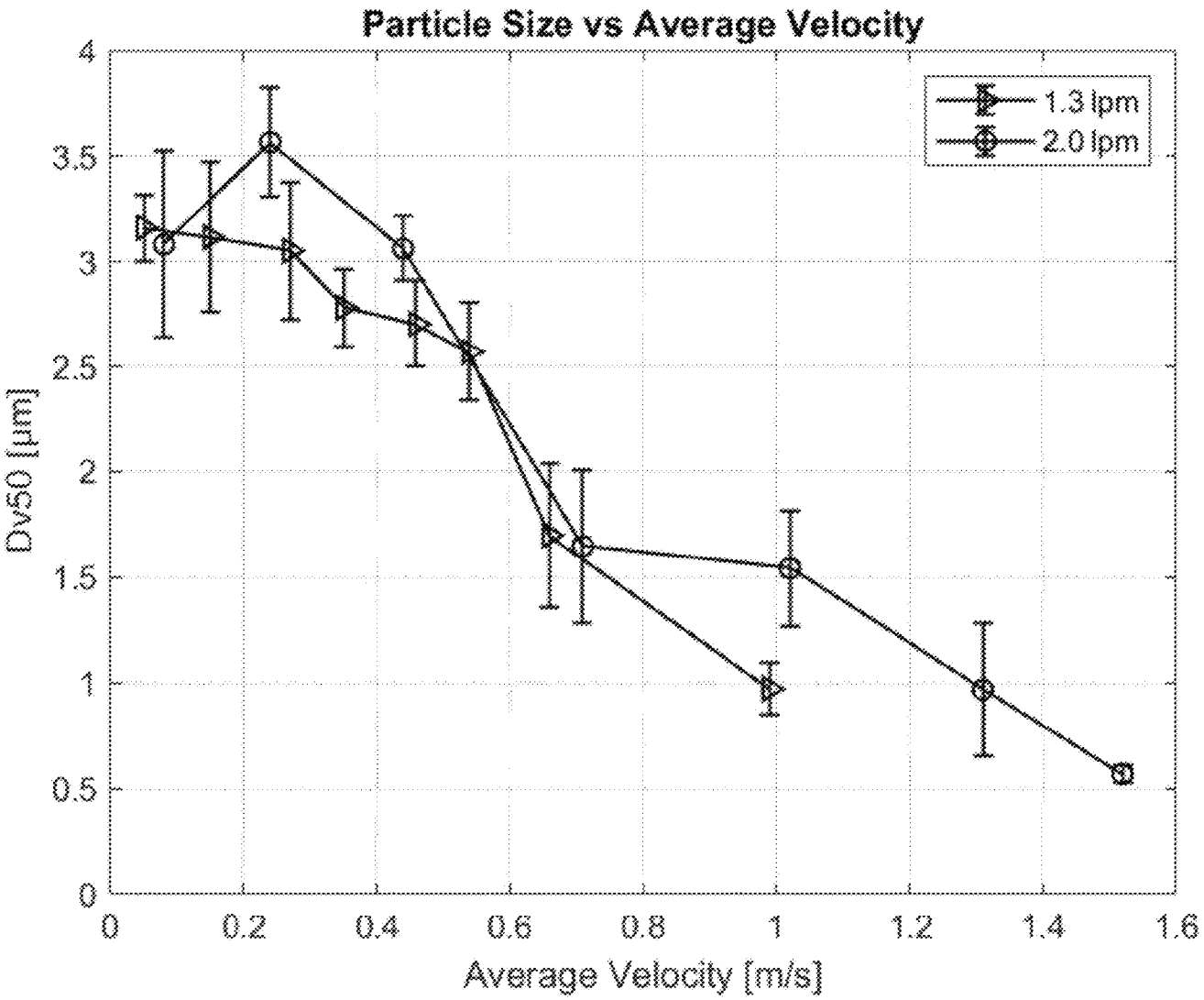
FIG. 11 shows a plot of aerosol particle size (Dv50) experimental results against the average magnitude of the velocity in the vaporizer surface region, as obtained from CFD modelling.
Figure 12:
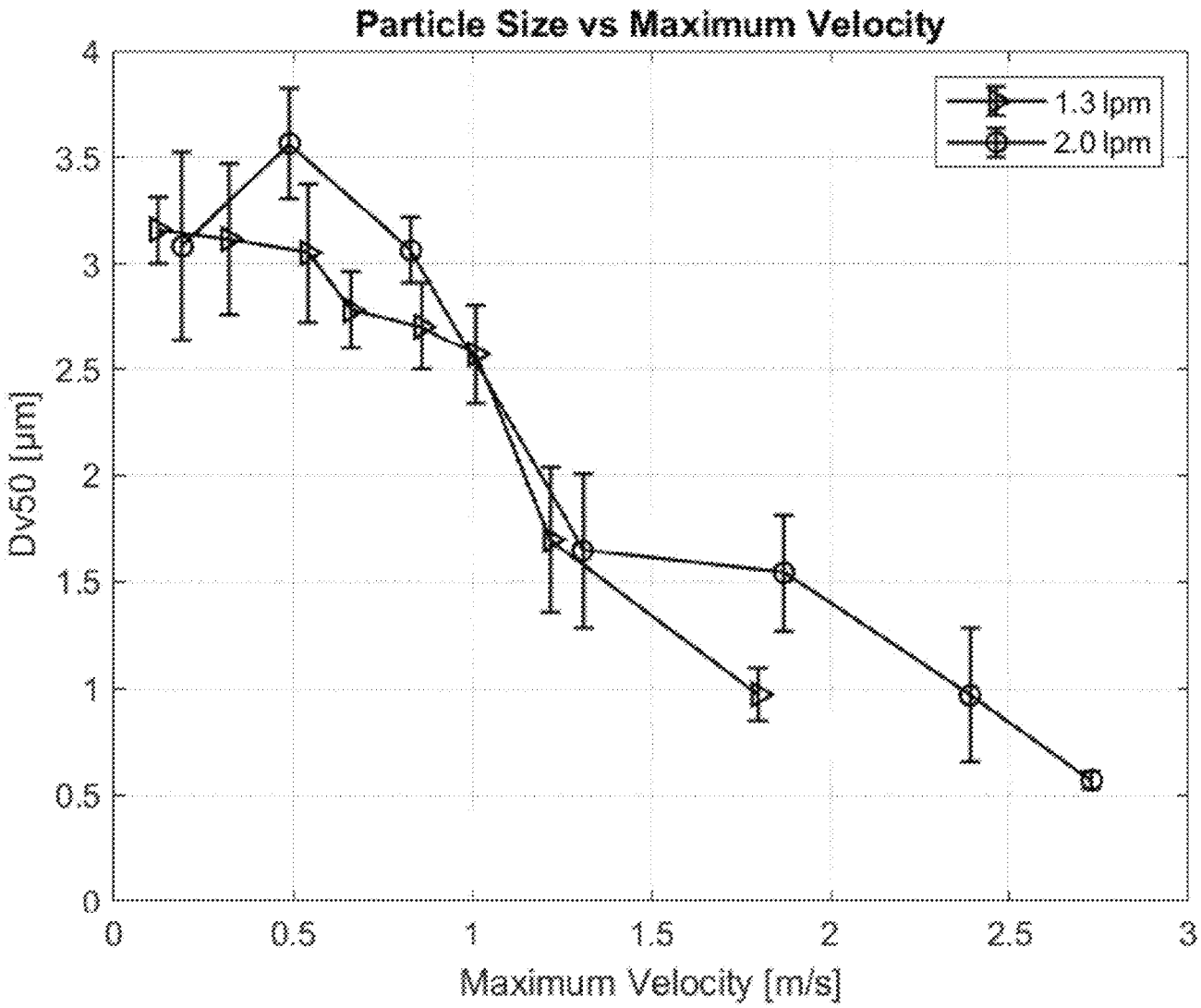
FIG. 12 shows a plot of aerosol particle size (Dv50) experimental results against the maximum magnitude of the velocity in the vaporizer surface region, as obtained from CFD modelling.

The particle size measurement data of the eighth example were plotted against the average velocity (FIG. 11) and maximum velocity (FIG. 12) in the vicinity of the wick, as obtained from CFD modelling.

The data in these two graphs indicates that in order to obtain an aerosol with Dv50 larger than 1 μm, the average velocity should be less than or equal to 1.2 m/s in the vicinity of the wick and the maximum velocity should be less than or equal to 2.0 m/s in the vicinity of the wick.

Furthermore, in order to obtain an aerosol with Dv50 of 2 μm or larger, the average velocity should be less than or equal to 0.6 m/s in the vicinity of the wick and the maximum velocity should be less than or equal to 1.2 m/s in the vicinity of the wick.

It is considered that typical commercial EVP devices deliver aerosols with Dv50 around 0.5 μm, and there is no commercially available device that can deliver aerosol with Dv50 exceeding 1 μm. It is considered that typical commercial EVP devices have average velocity of 1.5-2.0 m/s in the vicinity of the wick.

Ninth Example: The Role of Turbulence

The role of turbulence has been investigated in terms of turbulence intensity in a ninth example, which is a quantitative characteristic that indicates the level of turbulence. In the ninth example, four tubes of different turbulence intensities were used to general aerosols which were measured in the Spraytec laser diffraction system. The particle size (Dv50) experimental results of the ninth example are plotted against turbulence intensity in FIG. 13.

Figure 13:
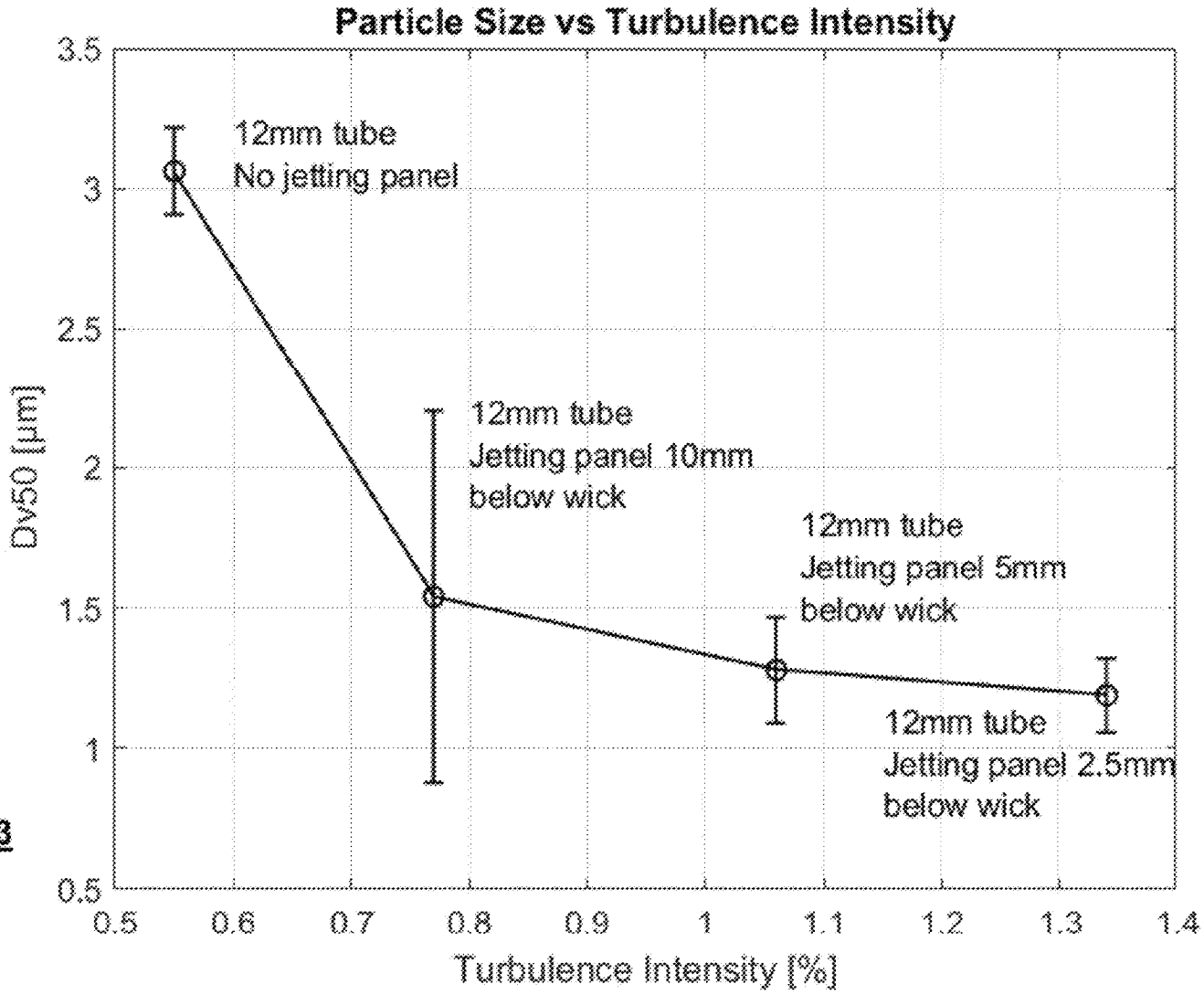
FIG. 13 shows a plot of aerosol particle size (Dv50) experimental results against the turbulence intensity.

The graph suggests a correlation between particle size and turbulence intensity, that lower turbulence intensity is beneficial for obtaining larger particle size. It is noted that when turbulence intensity is above 1% (medium-turbulence case), there are relatively large measurement fluctuations. In FIG. 13, the tube with a jetting panel 10 mm below the wick has the largest error bar, because air jets become unpredictable near the wick after traveling through a long distance.

The results of the ninth example clearly indicate that laminar air flow is favorable for the generation of aerosols with larger particles, and that the generation of large particle sizes is jeopardized by introducing turbulence. In FIG. 13, the 12 mm standard rectangular tube (without jetting panel) delivers above 3 μm particle size (Dv50). The particle size values reduced by at least a half when jetting panels were added to introduce turbulence.

Tenth Example: Vapor Cooling Rate

Figure 14:
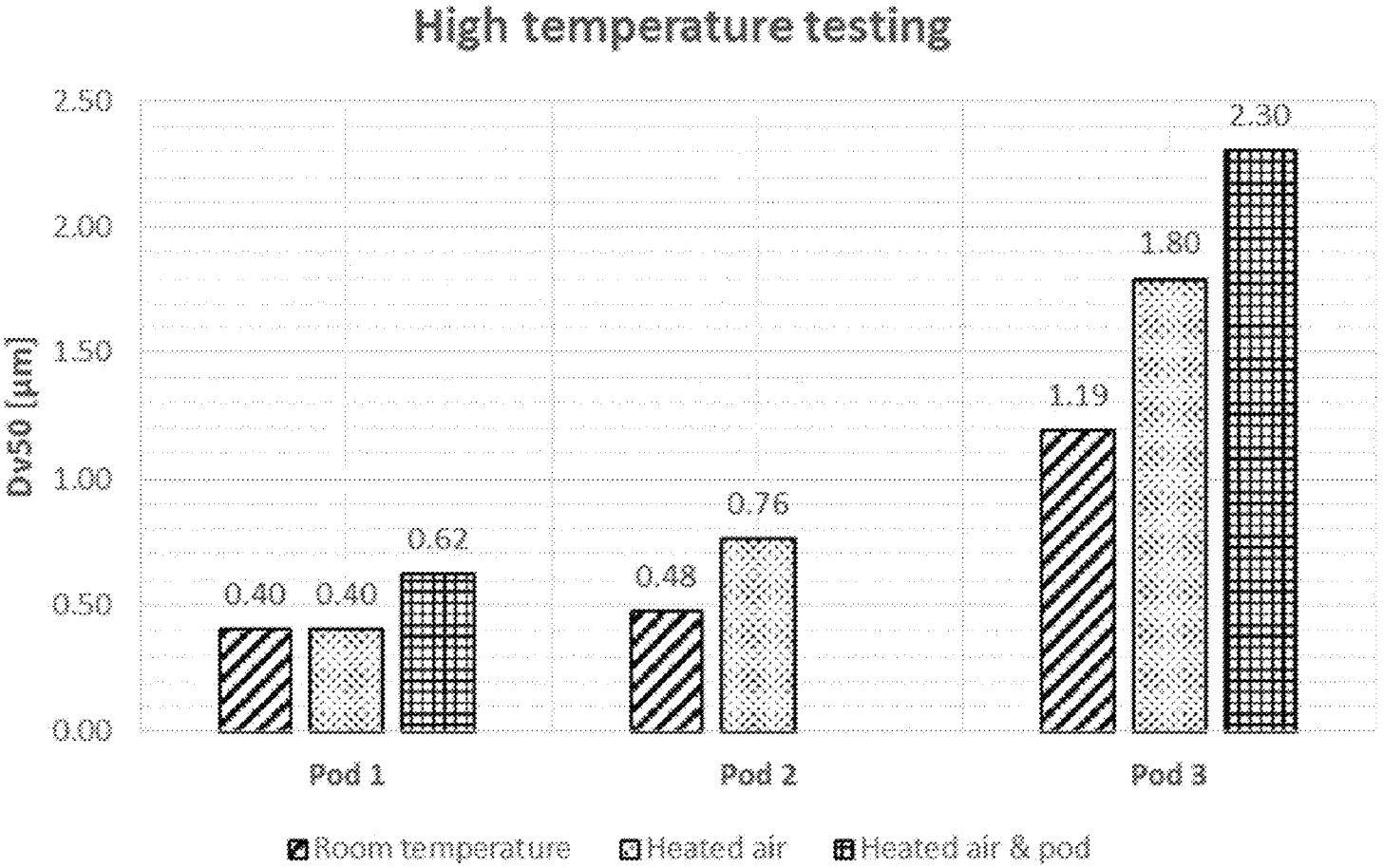
FIG. 14 shows a plot of aerosol particle size (Dv50) experimental results dependent on the temperature of the air and the heating state of the apparatus.

FIG. 14 shows the high temperature testing results of a tenth example. Larger particle sizes were observed from all 3 pods when the temperature of inlet air increased from room temperature (23° C.) to 50° C. When the pods were heated as well, two of the three pods saw even larger particle size measurement results, while pod 2 was unable to be measured due to significant amount of leakage.

Without wishing to be bound by theory, the results of the tenth example are in line with the inventors' insight that control over the vapor cooling rate provides an important degree of control over the particle size of the aerosol. As reported above, the use of a slow air velocity can have the result of the formation of an aerosol with large Dv50. It is considered that this is due to slower air velocity allowing a slower cooling rate of the vapor.

Another conclusion related to laminar flow can also be explained by a cooling rate theory of the tenth example: laminar flow allows slow and gradual mixing between cold air and hot vapor, which means the vapor can cool down in slower rate when the airflow is laminar, resulting in larger particle size.

The results in FIG. 14 further validate this cooling rate theory of the tenth example: when the inlet air has higher temperature, the temperature difference between hot vapor and cold air becomes smaller, which allows the vapor to cool down at a slower rate, resulting in larger particle size; when the pods were heated as well, this mechanism was exaggerated even more, leading to an even slower cooling rate and an even larger particle size.

Eleventh Example: Further Consideration of Vapor Cooling Rate

Figure 15:
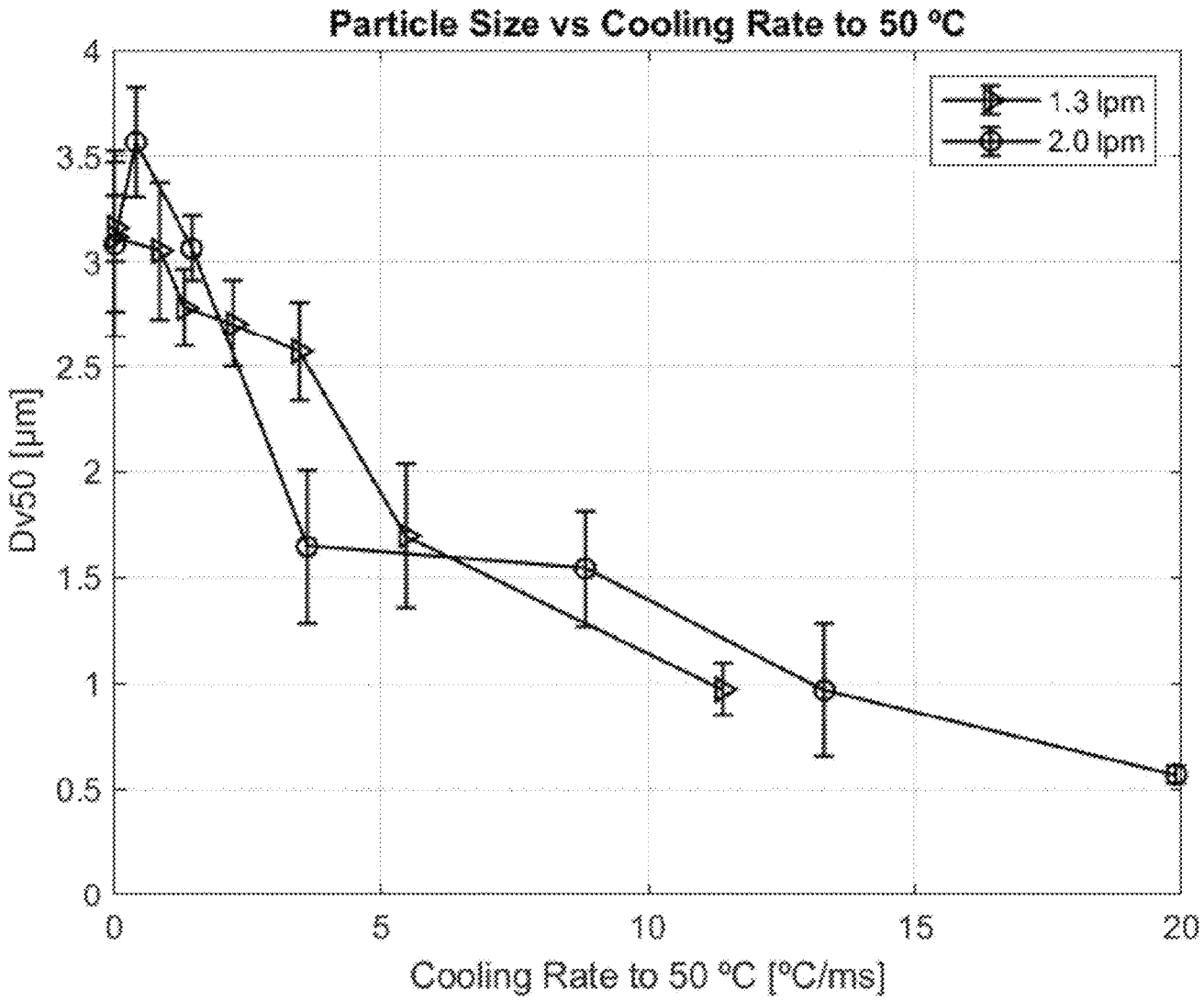
FIG. 15 shows a plot of aerosol particle size (Dv50) experimental results against vapor cooling rate to 50° C.
Figure 16:
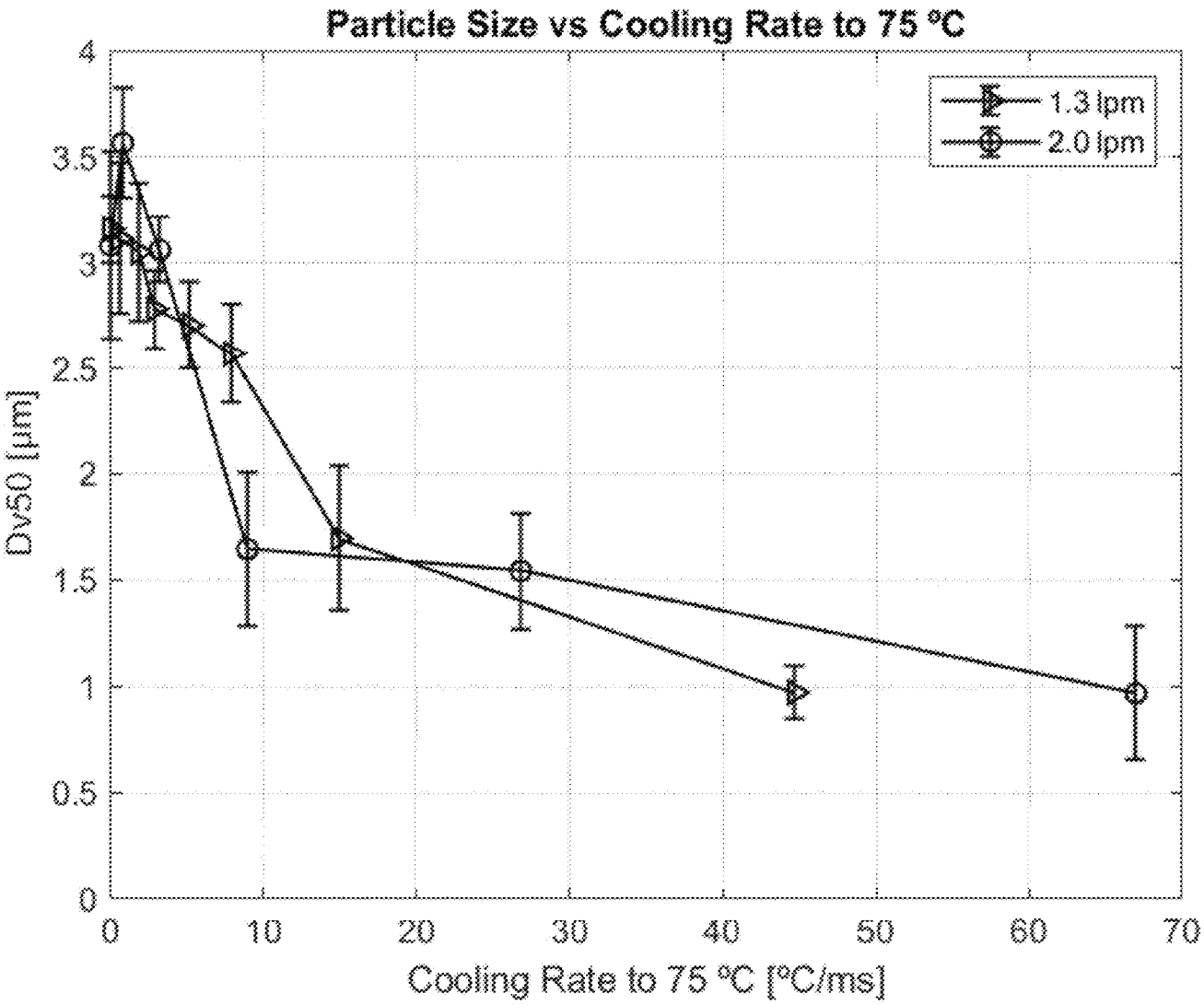
FIG. 16 shows a plot of aerosol particle size (Dv50) experimental results against vapor cooling rate to 75° C.

In the sixth example, the vapor cooling rates for each tube size and flow rate combination were obtained via multiphysics simulation. In FIG. 15 and FIG. 16, the particle size measurement results were plotted against vapor cooling rate to 50° C. and 75° C., respectively.

The data in these graphs indicates that in order to obtain an aerosol with Dv50 larger than 1 μm, the apparatus should be operable to require more than 16 ms for the vapor to cool to 50° C., or an equivalent (simplified to an assumed linear)

cooling rate being slower than 10° C./ms. From an alternative viewpoint, in order to obtain an aerosol with Dv50 larger than 1 μm, the apparatus should be operable to require more than 4.5 ms for the vapor to cool to 75° C., or an equivalent (simplified to an assumed linear) cooling rate slower than 30° C./ms.

Furthermore, in order to obtain an aerosol with Dv50 of 2 μm or larger, the apparatus should be operable to require more than 32 ms for the vapor to cool to 50° C., or an equivalent (simplified to an assumed linear) cooling rate being slower than 5° C./ms. From an alternative viewpoint, in order to obtain an aerosol with Dv50 of 2 μm or larger, the apparatus should be operable to require more than 13 ms for the vapor to cool to 75° C., or an equivalent (simplified to an assumed linear) cooling rate slower than 10° C./ms.

Conclusions of Particle Size Experimental Work

In the above example, particle size (Dv50) of aerosols generated in a set of rectangular tubes was studied in order to decouple different factors (flow rate, air velocity, Reynolds number, tube size) affecting aerosol particle size. It is considered that air velocity is an important factor affecting particle size—slower air velocity leads to larger particle size. When air velocity was kept constant, the other factors (flow rate, Reynolds number, tube size) has low influence on particle size.

The role of turbulence was also investigated in the above examples. It is considered that laminar air flow favors generation of large particles, and introducing turbulence deteriorates (reduces) the particle size.

Modelling methods were used in some of the above examples to simulate the average air velocity, the maximum air velocity, and the turbulence intensity in the vicinity of the wick. A COMSOL model with three coupled physics has also been developed to obtain the vapor cooling rate.

All experimental and modelling results of the above examples support a cooling rate theory that slower vapor cooling rate is a significant factor in ensuring larger particle size. Slower air velocity, laminar air flow and higher inlet air temperature lead to larger particle size, because they all allow vapor to cool down at slower rates.

The features disclosed in the foregoing description, or in the following claims, or in the accompanying drawings, or in the above examples, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments and examples described above, many equivalent modifications and variations will be apparent to those skilled in the art when given this disclosure. Accordingly, the exemplary embodiments and examples of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

ILLUSTRATIVE EMBODIMENTS

In the following numbered "clauses", or illustrative embodiments, are set out statements of broad combinations of novel and inventive features of the present disclosure herein disclosed.

Development A

A1. A smoking substitute apparatus for generating an aerosol, comprising:

a housing;

an air inlet and an outlet formed at the housing;

a passage extending between the air inlet and outlet, air flowing in use along the passage for inhalation by a user drawing air through the apparatus; and an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage;

wherein the downstream portion of the passage comprises a flow converging section having a curved sidewall tapered towards the outlet, and wherein an upstream end of the flow converging section substantially conforms to a cross sectional profile of the aerosol generation chamber.

A2. The smoking substitute apparatus of clause A1, wherein the passage extends longitudinally through the aerosol generation chamber so as to allow an air flow to pass over the aerosol generator.

A3. The smoking substitute apparatus of clause A1 or clause A2, wherein the downstream portion of the passage extends without discontinuity from the aerosol generation chamber towards the outlet.

A4. The smoking substitute apparatus of any one of the preceding clauses A1 to A3, wherein a chamber inlet is opened at a base of the aerosol generation chamber, wherein the passage extends through said chamber inlet.

A5. The smoking substitute apparatus of clause A1, wherein an upstream portion of the passage extends externally to the aerosol generation chamber, and wherein said upstream portion of the passage is configured to allow some or all of the air flow entering the housing through the air inlet to bypass the aerosol generation chamber.

A6. The smoking substitute apparatus of clause A5, wherein a junction is provided along the passage to fluidly connect the upstream portion and the downstream portion of the passage with the aerosol generation chamber, the junction is configured to allow the aerosol in the aerosol generation chamber to entrain with the air flow across the junction.

A7. The smoking substitute apparatus of clause A5 or clause A6, wherein the aerosol generator is positioned in a stagnant cavity of the aerosol generation chamber, when the stagnant cavity is substantially free of the air flow.

A8. The smoking substitute apparatus of any one of the preceding clauses A1 to A7, wherein the curved sidewall of the flow converging section comprises a sigmoidal profile along a longitudinal axis of the downstream portion of the passage.

A9. The smoking substitute apparatus of any one of the preceding clauses A1 to A8, wherein a maximum angle subtended by an internal surface of a sidewall of the downstream portion of the passage is less than any one of 30 degrees, 20 degrees or 10 degrees from a longitudinal axis of said downstream portion, said angle measured in a plane including the longitudinal axis.

A10. The smoking substitute apparatus of any one of the preceding clauses A1 to A9, wherein the aerosol precursor comprises a liquid aerosol precursor, and wherein the aerosol generator comprises a heater configured to generate the aerosol by vaporizing the liquid aerosol precursor.

A11. The smoking substitute apparatus of any one of the preceding clauses A1 to A10, wherein the smoking substitute apparatus is configured to generate an aerosol having a droplet size, $d_{50}$, of at least 1 μm.

A12. A smoking substitute system for generating an aerosol, comprising:

i) the smoking substitute apparatus of any one of the preceding clauses A1 to A11; and ii) a main body configured to engage with the smoking substitute apparatus; wherein the main body comprises a controller and a power source configured to energize the aerosol generator.

A13. A method of using the smoking substitute apparatus according to any one of clauses A1 to A11, comprising:

i) generating the aerosol with the aerosol generator;

ii) drawing on the apparatus to induce an air flow along the passage for entraining the generated aerosol.

Development B

B1. A smoking substitute apparatus comprising:

a housing;

an air inlet and an air outlet provided at the housing, the air inlet is arranged to be in fluid communication with the air outlet through an air flow channel;

an aerosol generator for generating an aerosol, wherein the aerosol generator is arranged to be in fluid communication with a downstream portion of the air flow channel so as to allow the generated aerosol to flow towards the air outlet via said downstream portion;

wherein the downstream portion of the air flow channel is configured to induce a swirling annular flow path to a portion of the air flow in the air flow channel.

B2. A smoking substitute apparatus according to clause B1, wherein the downstream portion of the air flow channel is configured to induce a swirling annular flow path to a portion of the generated aerosol alongside a wall of the air flow channel.

B3. A smoking substitute apparatus according to clause B1 or B2, wherein the downstream portion of the air flow channel comprises a helical guide which protrudes from a wall of the air flow channel.

B4. A smoking substitute apparatus according to clause B3, wherein the helical guide protrudes radially inwardly from a wall of the air flow channel.

B5. A smoking substitute apparatus according to clause B4, wherein the downstream portion of the air flow channel has a width, orthogonal to a longitudinal axis of the air flow channel, and the helical guide protrudes radially inwardly from a wall of the air flow channel by at least 5% of the width of the air flow channel.

B6. A smoking substitute apparatus according to clause B4 or B5, wherein the downstream portion of the air flow channel has a width, orthogonal to a longitudinal axis of the air flow channel, and the helical guide protrudes radially inwardly from a wall of the air flow channel by up to 40% of the width of the air flow channel.

B7. A smoking substitute apparatus according to any one of clauses B4 to B6, wherein a width of the helical guide, in a direction parallel to the longitudinal axis of the air flow channel, reduces from a first width closest to a wall of the air flow channel to a second width at a radially innermost extent of the helical guide.

B8. A smoking substitute apparatus according to any one of clauses B3 to B7, wherein the helical guide has at least two rotations about the longitudinal axis of the air flow channel.

B9. A smoking substitute apparatus according to any of clauses B3 to B8, wherein the helical guide extends continuously along the downstream portion of the air flow channel.

B10. A smoking substitute apparatus according to any of one clauses B1 to B9 wherein the downstream portion of the air flow channel is configured to induce the swirling annular flow path surrounding a substantially axial flow path, and wherein the average magnitude of velocity of the flow in the substantially axial flow path is greater than average magnitude of velocity of the flow in the swirling annular flow path.

B11. A smoking substitute system comprising:

a main body; and a smoking substitute apparatus according to any of the preceding clauses B1 to B10.

Development C

C1. A smoking substitute apparatus for generating an aerosol, comprising:

a housing having a first end and a second end opposite to the first end;

at least one air inlet formed at a base of the housing at the first end;

an outlet opened at the second end;

a passage extending between the air inlet and the outlet, air flowing in use along the passage for inhalation by a user drawing on the apparatus; and an aerosol generation chamber at the first end of the housing, the aerosol generation chamber containing an aerosol generator being operable to generate an aerosol from an aerosol precursor, the aerosol generation chamber comprises at least one chamber outlet in fluid communication with the passage, the at least one chamber outlet permitting, in use, aerosol generated by the aerosol generator to be entrained into an air flow along the passage;

wherein said at least one air inlet is separated from a base of the aerosol generation chamber at the first end of the housing, said at least one air inlet and the base of the aerosol generation chamber being configured so that substantially all of the airflow that subsequently entrains the aerosol flows through said at least one air inlet.

C2. The smoking substitute apparatus of clause C1, wherein the aerosol generation chamber is sealed against air flow except for the at least one chamber outlet.

C3. The smoking substitute apparatus of clause C1 or clause C2, wherein the aerosol generation chamber is configured to allow the aerosol to entrain into the air flow along the passage based on the pressure difference between the aerosol generation chamber and the passage.

C4. The smoking substitute apparatus of any one of the preceding clauses C1 to C3, wherein passage is configured to allow all of the air flow entering the housing through the air inlet to bypass the aerosol generation chamber.

C5. The smoking substitute apparatus of any one of the preceding clauses C1 to C4, wherein the chamber outlet opens towards the second end of the housing.

C6. The smoking substitute apparatus of any one of the preceding clauses C1 to C5, wherein the chamber outlet is positioned adjacent to the passage and opens in the direction of air flow.

C7. The smoking substitute apparatus of any one of the preceding clauses C1 to C6, wherein the aerosol generator is located adjacent to the chamber outlet.

C8. The smoking substitute apparatus of any one of clauses C1 to C7, wherein the aerosol generator is spaced from the chamber outlet.

C9. The smoking substitute apparatus of any one of the preceding clauses C1 to C8, wherein the passage comprises a flow converging portion downstream to the aerosol generation chamber, and wherein the flow converging portion is configured to converge the aerosol with the air flow in the passage.

C10. The smoking substitute apparatus of any one of the preceding clauses C1 to C9, wherein the passage forms an annulus around the aerosol generation chamber.

C11. The smoking substitute apparatus of any one of clauses C1 to C9, wherein the passage comprises one or more passages each extending alongside the aerosol generation chamber.

C12. The smoking substitute apparatus of any one of the preceding clauses C1 to C11, wherein the aerosol precursor comprises a liquid aerosol precursor, and wherein the aerosol generator comprises a heater configured to generate the aerosol by vaporizing the liquid aerosol precursor.

C13. The smoking substitute apparatus of any one of the preceding clauses C1 to C12, wherein the smoking substitute apparatus is configured to generate an aerosol having a droplet size, $d_{50}$, of at least 1 μm.

C14. A smoking substitute system for generating an aerosol, comprising:

i) the smoking substitute apparatus of any one of clauses C1 to C13; and ii) a main body configured to engage with the smoking substitute apparatus; wherein the main body comprises a controller and a power source configured to energize the aerosol generator.

C15. A method of using the smoking substitute apparatus of any one of clauses C1 to C14, comprising:

i) generating the aerosol with the aerosol generator;

ii) drawing on the apparatus to entrain the generated aerosol, through the at least one chamber outlet, into the air flow along the passage.

What is claimed is:

1. A smoking substitute apparatus for generating an aerosol, comprising:

a housing;

an air inlet and an outlet formed at the housing;

a passage extending between the air inlet and outlet, air flowing in use along the passage for inhalation by a user drawing air through the apparatus; and an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage;

wherein the downstream portion of the passage comprises a flow converging section having a curved sidewall tapered towards the outlet, and wherein an upstream end of the flow converging section substantially conforms to a cross sectional profile of the aerosol generation chamber, and wherein the curved sidewall of the flow converging section comprises a sigmoidal profile along a longitudinal axis of the downstream portion of the passage.

2. The smoking substitute apparatus of claim 1, wherein the passage extends longitudinally through the aerosol generation chamber so as to allow an air flow to pass over the aerosol generator.

3. The smoking substitute apparatus of claim 1, wherein the downstream portion of the passage extends without discontinuity from the aerosol generation chamber towards the outlet.

4. The smoking substitute apparatus of claim 1, wherein a chamber inlet is opened at a base of the aerosol generation chamber, wherein the passage extends through said chamber inlet.

5. The smoking substitute apparatus of claim 1, wherein an upstream portion of the passage extends externally to the aerosol generation chamber, and wherein said upstream portion of the passage is configured to allow some or all of the air flow entering the housing through the air inlet to bypass the aerosol generation chamber.

6. The smoking substitute apparatus of claim 5, wherein a junction is provided along the passage to fluidly connect the upstream portion and the downstream portion of the passage with the aerosol generation chamber, the junction is configured to allow the aerosol in the aerosol generation chamber to entrain with the air flow across the junction.

7. The smoking substitute apparatus of claim 5, wherein the aerosol generator is positioned in a stagnant cavity of the aerosol generation chamber, wherein the stagnant cavity is substantially free of the air flow.

8. The smoking substitute apparatus of claim 1, wherein a maximum angle subtended by an internal surface of a sidewall of the downstream portion of the passage is less than any one of 30 degrees, 20 degrees or 10 degrees from a longitudinal axis of said downstream portion, said angle measured in a plane including the longitudinal axis.

9. The smoking substitute apparatus of claim 1, wherein the aerosol precursor comprises a liquid aerosol precursor, and wherein the aerosol generator comprises a heater configured to generate the aerosol by vaporizing the liquid aerosol precursor.

10. The smoking substitute apparatus of claim 1, wherein the smoking substitute apparatus is configured to generate an aerosol having a droplet size, $d_{50}$, of at least 1 μm.

11. A smoking substitute system for generating an aerosol, comprising:

i) a smoking substitute apparatus; and ii) a main body wherein the smoking substitute apparatus comprises:

a housing;

an air inlet and an outlet formed at the housing;

a passage extending between the air inlet and outlet, air flowing in use along the passage for inhalation by a user drawing air through the apparatus; and an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage;

wherein the downstream portion of the passage comprises a flow converging section having a curved sidewall tapered towards the outlet, and wherein an upstream end of the flow converging section substantially conforms to a cross sectional profile of the aerosol generation chamber, and wherein the curved sidewall of the flow converging section comprises a sigmoidal profile along a longitudinal axis of the downstream portion of the passage, wherein the main body is configured to engage with the smoking substitute apparatus, and wherein the main body comprises a controller and a power source configured to energize the aerosol generator.

12. A method of using a smoking substitute apparatus, the smoking substitute apparatus comprising:

a housing;

an air inlet and an outlet formed at the housing;

a passage extending between the air inlet and outlet, air flowing in use along the passage for inhalation by a user drawing air through the apparatus; and an aerosol generation chamber containing an aerosol generator being operable to generate an aerosol from an aerosol precursor; wherein the aerosol generator is in fluid communication with a downstream portion of the passage for allowing the aerosol to entrain into an air flow along the passage;

wherein the downstream portion of the passage comprises a flow converging section having a curved sidewall tapered towards the outlet, and wherein an upstream end of the flow converging section substantially conforms to a cross sectional profile of the aerosol generation chamber, and wherein the curved sidewall of the flow converging section comprises a sigmoidal profile along a longitudinal axis of the downstream portion of the passage, wherein the method comprises the steps:

i) generating the aerosol with the aerosol generator;

ii) drawing on the apparatus to induce an air flow along the passage for entraining the generated aerosol.

* * * * *